US012392562B2

(12) United States Patent
Parker et al.

(10) Patent No.: US 12,392,562 B2
(45) Date of Patent: Aug. 19, 2025

(54) INDIRECT HEAT EXCHANGER PRESSURE VESSEL WITH CONTROLLED WRINKLE BENDS

(71) Applicant: Baltimore Aircoil Company, Inc., Jessup, MD (US)

(72) Inventors: Daniel E. Parker, Union Bridge, MD (US); Advait Damle, Columbia, MD (US); Frank T. Morrison, Crownsville, MD (US)

(73) Assignee: Baltimore Aircoil Company, Inc., Jessup, MD (US)

( * ) Notice: Subject to any disclaimer, the term of this patent is extended or adjusted under 35 U.S.C. 154(b) by 600 days.

(21) Appl. No.: 17/576,061

(22) Filed: Jan. 14, 2022

(65) Prior Publication Data

US 2022/0228817 A1 Jul. 21, 2022

Related U.S. Application Data

(60) Provisional application No. 63/270,953, filed on Oct. 22, 2021, provisional application No. 63/138,655, filed on Jan. 18, 2021.

(51) Int. Cl.
*F28D 1/047* (2006.01)
*F28F 1/00* (2006.01)

(52) U.S. Cl.
CPC ..... *F28F 1/006* (2013.01); *F28D 1/0477* (2013.01); *F28F 2225/04* (2013.01)

(58) Field of Classification Search
CPC ..... F28D 1/0477; F28D 7/085; F28D 7/087; F28F 1/006; F28F 2225/04
See application file for complete search history.

(56) References Cited

U.S. PATENT DOCUMENTS 1,617,277 A 2/1927 Schmidt
1,786,882 A 12/1930 Whitsitt
(Continued)

FOREIGN PATENT DOCUMENTS

CN 1302366 A 7/2001
CN 1692264 A 11/2005
(Continued)

OTHER PUBLICATIONS

PCT Search Report and Written Opinion from related International Application No. PCT/US2022/012524 dated May 25, 2022; 16 pages.

(Continued)

*Primary Examiner* — Eric S Ruppert
*Assistant Examiner* — Hans R Weiland
(74) *Attorney, Agent, or Firm* — Fitch, Even, Tabin & Flannery LLP

(57) ABSTRACT

In one aspect of the present disclosure, an indirect heat exchanger pressure vessel is provided that includes an inlet header to receive a pressurized working fluid, such as water, glycol, ammonia, and/or $CO_2$. The indirect heat exchanger pressure vessel includes an outlet header to collect the pressurized working fluid and a serpentine circuit tube connecting the inlet and outlet headers. The serpentine circuit tube permits the pressurized working fluid to flow from the inlet header to the outlet header. The serpentine circuit tube includes runs and a return bend connecting the runs. The return bend has a controlled wrinkled portion comprising alternating ridges and grooves. The alternating ridges and grooves strengthen the return bend and permit the indirect heat exchanger pressure vessel to facilitate working fluid heat transfer at a high internal operating pressure.

50 Claims, 38 Drawing Sheets

(56) References Cited

U.S. PATENT DOCUMENTS

| | | | | |
|---|---|---|---|---|
| 1,958,447 | A | 5/1934 | Quartz | |
| 2,012,766 | A | 8/1935 | Meyer | |
| 2,054,404 | A | 9/1936 | Askin | |
| 2,126,235 | A | 8/1938 | Wesley | |
| 2,223,015 | A | 11/1940 | Hathorn | |
| 2,310,091 | A | 2/1943 | Kepler | |
| 2,357,873 | A | 9/1944 | Bower | |
| 2,406,838 | A | 9/1946 | Kepler | |
| 2,650,636 | A | 9/1953 | Jennings, Jr. | |
| 2,657,020 | A | 10/1953 | Hofmeister | |
| 2,667,762 | A | 2/1954 | Hornaday | |
| 2,746,727 | A | 5/1956 | Earl, Jr. | |
| 2,757,649 | A | 8/1956 | Coughlin | |
| 3,279,535 | A | 10/1966 | Huet | |
| D208,848 | S | 10/1967 | Nardone | |
| 3,346,043 | A | 10/1967 | Thurnauer | |
| 3,348,402 | A | 10/1967 | Reistad | |
| D209,382 | S | 11/1967 | Nardone | |
| 3,408,844 | A | 11/1968 | Strachauer | |
| 3,416,351 | A | 12/1968 | Thielsch | |
| 3,438,238 | A * | 4/1969 | Wallis | B21C 37/28 72/369 |
| 3,456,482 | A | 7/1969 | Maier | |
| 3,472,056 | A | 10/1969 | Gregg | |
| 3,675,710 | A | 7/1972 | Ristow | |
| 3,724,256 | A | 4/1973 | Kroetch | |
| 3,724,756 | A | 4/1973 | Maltenfort | |
| 4,009,601 | A | 3/1977 | Shimizu | |
| 4,446,915 | A | 5/1984 | Welch | |
| 4,464,923 | A | 8/1984 | Boggs | |
| 4,520,867 | A | 6/1985 | Sacca | |
| D284,694 | S | 7/1986 | Taylor | |
| D284,789 | S | 7/1986 | Taylor | |
| 4,638,665 | A | 1/1987 | Benson | |
| 4,755,331 | A | 7/1988 | Merrill | |
| 4,765,168 | A | 8/1988 | Stange | |
| 4,877,014 | A | 10/1989 | Beasley | |
| 4,995,453 | A | 2/1991 | Bartlett | |
| 5,012,767 | A | 5/1991 | Sheikh | |
| 5,142,895 | A * | 9/1992 | Schuchert | F28F 1/006 72/149 |
| 5,222,552 | A | 6/1993 | Schuchert | |
| 5,337,590 | A * | 8/1994 | Schuchert | B21D 7/02 72/157 |
| 5,540,276 | A | 7/1996 | Adams | |
| 5,799,725 | A | 9/1998 | Bradley, Jr. | |
| 6,101,821 | A | 8/2000 | Cates | |
| 6,123,113 | A | 9/2000 | Pontbriand | |
| 6,138,746 | A | 10/2000 | Livolsi | |
| 6,153,029 | A | 11/2000 | Lin | |
| 6,216,486 | B1 | 4/2001 | Aaron | |
| 6,415,615 | B1 | 7/2002 | Osborne | |
| 6,574,980 | B1 | 6/2003 | Morrison | |
| 6,644,079 | B2 | 11/2003 | Harman | |
| 6,651,475 | B1 * | 11/2003 | O'Donnell | B21D 7/024 72/157 |
| 6,820,685 | B1 | 11/2004 | Carter | |
| 7,296,620 | B2 | 11/2007 | Bugler, III | |
| 7,779,898 | B2 | 8/2010 | Morrison | |
| 8,129,036 | B2 | 3/2012 | Beringer | |
| 9,255,739 | B2 | 2/2016 | Aaron | |
| 9,279,619 | B2 | 3/2016 | Aaron | |
| D763,417 | S | 8/2016 | Hokazono | |
| 9,534,529 | B2 | 1/2017 | Capelle | |
| 10,107,506 | B2 | 10/2018 | Kraft | |
| 10,145,621 | B2 | 12/2018 | Anderson | |
| 10,401,055 | B2 | 9/2019 | Kraft | |
| 10,415,892 | B2 * | 9/2019 | Kanagala | F28F 13/08 |
| 10,563,930 | B2 | 2/2020 | Rede | |
| 10,655,918 | B2 | 5/2020 | Beaver | |
| 11,073,344 | B2 | 7/2021 | Williams | |
| D945,579 | S | 3/2022 | Kanagala | |
| D960,336 | S | 8/2022 | Kanagala | |
| 11,820,067 | B2 * | 11/2023 | Mentink | B29C 53/30 |
| 2003/0205074 | A1 | 11/2003 | O'Donnell et al. | |
| 2004/0079522 | A1 | 4/2004 | Paulman | |
| 2004/0104015 | A1 | 6/2004 | O'Donnell | |
| 2004/0177948 | A1 | 9/2004 | Cho | |
| 2004/0250422 | A1 | 12/2004 | Ali | |
| 2005/0160783 | A1 | 7/2005 | Ni | |
| 2007/0221365 | A1 | 9/2007 | Martin | |
| 2013/0240177 | A1 * | 9/2013 | Howard | F28F 9/0131 165/104.11 |
| 2016/0363388 | A1 | 12/2016 | Egolf | |
| 2018/0023895 | A1 | 1/2018 | Kraft | |
| 2018/0100703 | A1 * | 4/2018 | Beaver | F28F 1/006 |
| 2018/0252433 | A1 | 9/2018 | Kraft | |
| 2019/0017753 | A1 | 1/2019 | Plummer | |
| 2019/0368726 | A1 | 12/2019 | O'Donnell | |
| 2020/0049431 | A1 | 2/2020 | Alhassan | |
| 2020/0348085 | A1 | 11/2020 | Se | |
| 2022/0228817 | A1 | 7/2022 | Parker | |

FOREIGN PATENT DOCUMENTS

| | | | |
|---|---|---|---|
| CN | 101410687 | A | 4/2009 |
| CN | 110382977 | A | 10/2019 |
| DE | 666681 | | 11/1938 |
| DE | 852629 | | 10/1952 |
| DE | 1527244 | | 8/1969 |
| DE | 3537382 | | 4/1987 |
| FR | 578679 | | 10/1924 |
| FR | 2755382 | A1 | 5/1998 |
| GB | 271815 | | 7/1927 |
| GB | 347415 | | 4/1931 |
| GB | 2205260 | | 12/1988 |
| JP | S406746 | | 3/1965 |
| JP | S61222634 | | 10/1986 |
| JP | S6216820 | | 1/1987 |
| KR | 300469216 | | 1/2008 |
| KR | 300517385 | | 1/2009 |
| RU | 2016683 | C1 | 7/1994 |
| RU | 2085317 | C1 | 7/1997 |
| RU | 2616728 | C2 | 4/2017 |
| WO | 02070162 | | 9/2002 |

OTHER PUBLICATIONS

HUTH Control Wrinkle Die Bending for Stainless.mpg, frame 5:53, announced in YouTube on May 17, 2012[online], [site visited Oct. 7, 2023], Available from the internet URL: https://www.youtube.com/watch?v=4LMKb0TGAgo&t=1s (Year: 2012), 2 pages.

Non-Final Office Action from U.S. Design U.S. Appl. No. 29/812,659 dated Oct. 17, 2023; 28 pages.

YouTube Video entitled "HUTH Control Wrinkle Die Bending for Stainless.mpg"; screen captures and audio transcription of video from https://www.youtube.com/watch?v=4LMKb0TGAgo; published May 17, 2012, 32 pages.

Non-Final Office Action from Design U.S. Appl. No. 29/766,720 dated Aug. 9, 2024; 5 pages.

Invitation to Pay Additional Fees from related International Application No. PCT/US2022/012524 dated Mar. 31, 2022; 12 pages.

Kuboki, Takashi et al., A New Schedule-Free Mandrel-Less Bending Method for Straight/Pre-Shaped Long Tube; CIRP Annals Manufacturing Technology 62 (2013) pp. 303-306.

Design U.S. Appl. No. 29/766,720, filed Jan. 18, 2021 entitled Indirect Heat Exchanger Tube Controlled Wrinkle Bend; 43 pages.

Design U.S. Appl. No. 29/812,659, filed Oct. 22, 2021 entitled Indirect Heat Exchanger Tube Controlled Wrinkled Bend; 22 pages.

U.S. Appl. No. 63/138,655, filed Jan. 18, 2021 entitled Indirect Heat Exchanger Pressure Vessel with Controlled Wrinkle Bends; 94 pages.

U.S. Appl. No. 63/270,953, filed Oct. 22, 2021 entitled Indirect Heat Exchanger Pressure Vessel with Controlled Wrinkle Bends; 100 pages.

University of Regina; Question and Answer regarding Arc Radius; publicly available before Jan. 18, 2021; 1 page.

Winton, George; Embracing the Wrinkle; from https://www.wintonmachine.com/embracing-the-wrinkle; publicly available before Jan. 18, 2021; 4 pages.

(56) References Cited

OTHER PUBLICATIONS

YouTube Video entitled "Pines Bender Serpentine Bends with controlled Wrinkles"; screen captures of video from https://www.youtube.com/watch?v=Sf4c0QYPKsU&feature=youtu.be; published Oct. 24, 2010.
Office Action from related Russian Patent Application No. 2023119329 dated Mar. 25, 2025, with English translation; 11 pages.
Office Action from related Vietnamese Patent Application No. 1-2023-05399 dated Apr. 11, 2025, with English translation; 4 pages.
Office Action from related Chinese Patent Application No. 202280000732.3 dated Jun. 17, 2025, with English translation; 15 pages.

* cited by examiner

INDIRECT HEAT EXCHANGER PRESSURE VESSEL WITH CONTROLLED WRINKLE BENDS

CROSS-REFERENCE TO RELATED APPLICATIONS

This application claims the benefit of U.S. Provisional Patent Application No. 63/138,655, filed Jan. 18, 2021, and U.S. Provisional Patent Application No. 63/270,953 filed, Oct. 22, 2021, which are hereby incorporated herein by reference in their entireties.

FIELD

This disclosure relates to indirect heat exchangers and, more particularly, to indirect heat exchangers having serpentine circuit tubes with multiple formed bends that convey a pressurized working fluid through the serpentine circuit tube and permit heat transfer between the working fluid inside of the serpentine circuit tube and a fluid external to the serpentine circuit tube. The working fluid and the external fluid may each be gas, liquid or a mixture of gas and liquid.

BACKGROUND

Heat exchangers are known that include direct heat exchangers and indirect heat exchangers. A direct heat exchanger transfers heat between a working fluid and another fluid via contact between the fluids. An indirect heat exchanger transfers heat between a working fluid and another fluid indirectly through a medium separating the fluids.

Various types of heat exchange apparatuses are known that include direct heat exchangers, indirect heat exchangers, or both. Known heat exchange apparatuses include open circuit heat exchange apparatuses such as open circuit cooling towers and closed circuit heat exchange apparatuses such as closed circuit cooling towers. Open circuit cooling towers may exchange heat between a working fluid, such as water, and an external fluid such as ambient air by distributing the working fluid onto fill. The working fluid is directly cooled by ambient air as the working fluid travels along the fill. Closed circuit cooling towers, by contrast, keep the working fluid separated from the external fluid.

Closed circuit heat exchanger apparatuses include closed circuit cooling towers for fluids, evaporative condensers for refrigerants, dry coolers, air cooled condensers, and ice thermal storage systems. These heat exchange apparatuses utilize one or more heat exchangers to transfer heat between a pressurized working fluid and an external fluid such as ambient air, an evaporative liquid, or a combination thereof.

For example, a heat exchanger apparatus may include a closed circuit cooling tower having an indirect heat exchanger pressure vessel including an inlet header that receives a pressurized working fluid, an outlet header, and an indirect heat exchange coil connecting the inlet and outlet headers. The indirect heat exchange coil may include one or more serpentine circuit tubes configured to transfer heat between the pressurized working fluid inside the indirect heat exchange coil and a fluid, such as an evaporative liquid, external to the indirect heat exchange coil. The inlet header receives the internal working fluid from an upstream component of the heat exchange apparatus and the outlet header collects the pressurized working fluid before the working fluid is directed to a downstream component of the heat exchange apparatus.

Indirect heat exchanger pressure vessels, which includes the inlet header, outlet header, and one or more serpentine circuit tubes, are required to withstand high pressures appropriate for the specific application and satisfy domestic and international engineering standards such as ASME Standard B31.5. For example, an indirect heat exchanger pressure vessel of a closed circuit cooling tower may be rated to withstand an internal pressure of 150 psig for fluids such as water, glycols and brines. As another example, the indirect heat exchanger pressure vessel of an evaporative condenser may be able to withstand an internal pressure of up to 410 psig or higher for typical refrigerants such as ammonia or R-407C. As yet another example, some evaporative condensers have indirect heat exchanger pressure vessels with internal pressure ratings of 1200 psig or greater for refrigerants such as $CO_2$.

Serpentine circuit tubes of indirect heat exchanger pressure vessels typically include straight lengths and bends connecting the straight lengths. The straight lengths of the serpentine circuit tubes are typically joined with bends of approximately 180 degrees or by compound bends having multiple bends, such as two 90 degree bends joined by a tube length.

The serpentine circuit tubes may be stacked together during assembly of the heat exchange apparatus with the serpentine circuit tubes contacting one another, typically in the area of the return bends, and with the serpentine circuit tubes having a vertically staggered positioning.

Serpentine circuit tubes are often made by first forming an elongated tube from a long, flat strip of metal such as mild steel or stainless steel. The flat strip of metal is roll formed into a generally circular cross section and the longitudinal edges are welded together with a continuous, longitudinal weld to form a straight tube. In another approach, a seamless tube forming process is used to form the straight tube. The resulting straight tube may then be bent at spaced locations along the tube to form the tube into a serpentine shape with straight runs connected by bends. Tube bending is a complicated process and often utilizes a hydraulically, electrically, or manually-powered tube bender having a bend die, a clamp die, a pressure die, and optionally a mandrel and wiper die. The tube bender may be setup to form bends with any desired angle up to and including 180 degree bends, such as 80 degrees, 90 degrees, 100 degrees, or 180 degrees. As noted above, the return bends of a serpentine circuit tube may include compound bends each having two or more bends, such as an 80 degree bend and a 100 degree bend, connected by a length of straight tube.

To form a bend in a tube, the tube is fed into the tube bender and a portion of the tube is nestled in a recess of the bend die. The pressure die and clamp die, with recesses for the tube, are moved against the opposite side of the tube such that the pressure die is positioned to support the tube and the clamp die clamps the tube portion between the clamp die and the bend die. The tube bender then rotates or pivots the bend die and the clamp die through the desired bend angle. The pressure die moves forward as the bend die and clamp die pivot to support the tube and ensure the tube follows the profile of the bend die. Once the bend has been formed in the tube, the clamp die and pressure die retract from their clamped positions, the tube is fed forward until the next bend location of the tube is positioned in the tube bender, and the bend die, clamp die, and pressure die all move back to their initial positions. The bending process is repeated for each bend to be formed in the serpentine circuit tube. Some tubes are bent only once to form single-bend tubes, which commonly are referred to as hairpin or candy-cane tubes, that can be subsequently butt welded together.

The bending of a tube that is to receive a pressurized working fluid is a process that balances various considerations including performance, safety, and packaging criteria for a particular application. Further, unintended deformations in the tube wall during the bending process may lead to tube failures due to the pressure of the working fluid within the tube, corrosion of the tube, and/or a higher pressure drop of the working fluid through the tube. In some tube bending processes, an internal mandrel is advanced into the interior of the tube to support the tube wall during bending and a wiper die may be used to stiffen the tube wall at a trailing end of the inside of the bend to prevent unintended deformations in the tube. The internal mandrel may be a plug mandrel or may have one or more balls or rings, in which case the internal mandrel is referred to as a ball mandrel.

Tube bending generally involves the following parameters:

OD=Outside diameter of the tube

WT=Wall thickness of the tube

CLR=Centerline radius of the bend

The dimensions are measured using a common measurement scale, such as inches or millimeters. These parameters are used to calculate the following two characteristic ratios:

$$\text{Wall Factor} = W = \frac{OD}{WT}$$

$$D \text{ of Bend} = D = \frac{CLR}{OD}$$

Two other parameters that are featured in the bending process are the Outside Radius (OSR) of the bend, usually referred to as the extrados, and the Inside Radius (ISR) of the bend, usually referred to as the intrados.

The W and D ratios are further consolidated into a single factor that is indicative of the complexity of the bend. This factor is calculated as:

$$\text{Bend Complexity} = C_B = \frac{W}{D} = \frac{OD^2}{CLR \times WT}$$

The values of W, D, and/or CB may be used to determine whether a bend can be formed without an internal mandrel, called empty bending, or if an internal mandrel will be required, in which case the process is called mandrel bending. For mandrel bending, these ratios help determine whether the internal mandrel required should be a multiple ball, single ball or a simpler plug mandrel. Finally, these ratios help determine whether a wiper die will be required in combination with the internal mandrel. As an example, process recommendations for various bend complexities are shown in the table below:

TABLE 1

Table of Bend Complexity Values and Recommended Bending Process

| $C_B$ value | Recommended Bending Process |
|---|---|
| Less than 5 | Empty Bending |
| 5-10 | Internal Mandrel recommended; Wiper Die not required |
| 10-20 | Internal Mandrel either Plug or Ball required; Wiper Die optional |
| 20-50 | Internal Mandrel with multiple balls required; Wiper Die required |
| Greater than 50 | High Pressure Internal Mandrel and Wiper Die required |

It is typical to look up the W, D, and/or $C_B$ ratios on industry standard tube bending charts to decide the type of bending process required. For example, to determine the process parameters to bend a tube with outside diameter of 1" and a wall thickness of 0.05" with a centerline radius of 2", then the ratios W and D are:

$$W = \frac{1}{0.05} = 20$$

$$D = \frac{2}{1} = 2$$

An industry standard tube bending chart may recommend, in view of the W ratio of 20 and the D ratio of 2, that a regular pitch internal mandrel with 1 ball, supplemented with a wiper die, should be used.

Alternately, the $C_B$ for the example bend above is:

$$C_B = \frac{20}{2} = 10$$

Referring to the table above, this $C_B$ value also indicates that an internal mandrel is recommended, although a wiper die could be optional. The small differences in recommendations on mandrels and wipers are indicative of a certain amount of flexibility in bend configurations where tool design and tube material choices can sometimes compensate for the absence of an internal mandrel and/or wiper die.

The conventional bending charts used in industry and the bend complexity value ($C_B$) ranges discussed above are based on the assumption that the profile of the tooling groove formed by the bending and clamp dies, where the tube is seated during the bending process, is circular, complementing the shape of the round tube. However, bending tool design has made several advances in recent years and it is possible to design bend tooling with a composite radius in the tooling groove to compress and support the tube during the bending process and extend the range of empty bending up from a $C_B$ value of approximately 5 to approximately 12.

Beyond this, especially as $C_B$ approaches and exceeds 20, it becomes progressively more necessary to use internal mandrels and wiper dies to successfully bend the tube. The internal mandrel bending process has several disadvantages including that using a mandrel requires additional tooling which adds cost, may increase scrap if mandrels are not used correctly, may add to cycle time, and requires the use of lubricants which adds time and cost for the lubricant and subsequent environmental mitigation.

One issue as $C_B$ approaches and exceeds 20 is that the associated mandrel bending imposes a limit on the continuous length of the tube. Serpentine circuit tubes can be very long, up to 400 feet long for some applications. The physical limits on the length of the mandrel rod and setup mean that internal mandrels cannot be used to bend long, continuous serpentine circuit tubes with several bends. This forces a manufacturer to form one or two bends in short segments of tube, sometimes called candy canes, and then butt weld the tube segments together to create larger circuits. Not only does this involve additional labor and cost, but additional butt welds increase the possibility of leaks and may not be permitted in many applications due to the high operating pressure the serpentine circuit tube will experience.

Another issue that may arise as $C_B$ approaches and exceeds 20 is that the associated internal mandrel bending moves the neutral axis of the bend closer to the inside of the bend and may cause excessive thinning of the outside wall portion of the bend. Thinning of the outside wall portion of the bend may weaken the serpentine circuit tube such that the serpentine circuit tube cannot withstand the pressure of the working fluid for a particular application. Excessive thinning of the outside bend wall also creates variability in the process when forming the bends causing reduced quality in the bend areas.

The above issues make it desirable for a manufacturer to avoid the use of internal mandrels for tube bending. One way to avoid using internal mandrels for a tube with a given OD is to increase WT or increase CLR to a suitable value to bring the bend within the range of empty bending. Increasing the wall thickness (WT) may not be an option for manufacturers whose products do not require such relatively thick walls from an operational perspective. In certain cases, the thicker walls may increase the fluid side pressure drop, may make the products less thermally efficient, increase the weight of the assembly, and may increase the material cost of the serpentine circuit tube. Further, increasing CLR may not be an option where the serpentine circuit tube needs to fit in a given space for other operational considerations. Increasing CLR can also have negative impact on overall coil thermal and hydraulic efficiency in some cases.

SUMMARY

In one aspect of the present disclosure, an indirect heat exchanger pressure vessel is provided that includes an inlet header to receive a pressurized working fluid, an outlet header to collect the pressurized working fluid, and a serpentine circuit tube connecting the inlet and outlet headers and permitting the pressurized working fluid to flow from the inlet header to the outlet header. The pressurized fluid may be, for example, water, glycol, a glycol mixture, ammonia, or $CO_2$ as some examples. The pressurized fluid may be a liquid such as water or a liquid/gas combination such as refrigerant liquid and refrigerant vapor. The serpentine circuit tube includes runs and a return bend connecting the runs. The return bend includes a controlled wrinkled portion including alternating ridges and grooves. The controlled wrinkled portion of the return bend provides a rigid structure that resists internal pressure during operation of the indirect heat exchanger pressure vessel. Further, the controlled wrinkled portion provides a constructive bend centerline radius that is larger than an actual bend centerline radius of the return bend. The larger constructive bend centerline radius reduces the bend complexity factor for the return bend compared to a return bend of a conventional serpentine circuit tube having the same outer diameter and wall thickness. Due to the reduced bend complexity factor, the return bend having controlled wrinkled portions may be bent without the use of an internal mandrel which simplifies the manufacturing process of the serpentine circuit tube.

The present disclosure also provides an indirect heat exchanger pressure vessel including an inlet header to receive a pressurized working fluid, an outlet header to collect the pressurized working fluid, and a serpentine circuit tube connecting the inlet and outlet headers to permit flow of pressurized working fluid from the inlet header to the outlet header. The serpentine circuit tube includes runs, a return bend connecting the runs, and tangent points at junctures between the return bend and the runs. The return bend includes a bend angle and a controlled wrinkled portion. The controlled wrinkled portion is spaced from the tangent points along the serpentine circuit tube and has an angular extent about an inside of the return bend that is less than the bend angle. In this manner, the controlled wrinkled portion may be formed using a bend die having corresponding controlled wrinkle-forming features for less than the entire intrados of the return bend to permit the serpentine circuit tube to be slid out lengthwise from the bend die and increases the rapidity at which return bends may be formed in the serpentine circuit tube. In one embodiment, the controlled wrinkled portion includes ridges having amplitudes that are smaller adjacent the tangents points and increase as the wrinkled portion extends away from the tangent points to reduce resistance to fluid flow through the return bend and reduce the internal fluid pressure drop at the return bend relative to a non-tapered or non-eased configuration of the wrinkle ridges.

In another aspect, an indirect heat exchanger pressure vessel is provided that includes an inlet header to receive a pressurized working fluid, an outlet header, and a serpentine circuit tube connecting the inlet header and the outlet header to facilitate flow of the pressurized working fluid from the inlet header to the outlet header. The serpentine circuit tube includes a pair of runs and a return bend connecting the runs. The return bend includes an inner portion having a sinusoidal wave pattern at an intrados of the return bend, the sinusoidal wave pattern including peaks and valleys. The inner portion of the bend includes an arc pattern intersecting the sinusoidal wave pattern, the arc pattern comprising peak arcs intersecting the peaks and valley arcs intersecting the valleys. The intersecting sinusoidal wave pattern and arc pattern provide a smooth, continuously curving side wall of the serpentine circuit tube which strengthens the return bend against internal pressure. In one embodiment, the sinusoidal wave pattern has one or more end portions with shallower peaks and valleys and an intermediate portion with deeper peaks and valleys to reduce the internal fluid pressure drop across the return bend compared to a sinusoidal wave pattern having a constant peak and valley size.

The present disclosure also provides a closed circuit cooling tower including an indirect heat exchanger comprising a plurality of serpentine circuit tubes having runs and return bends connecting the runs. The return bends include wrinkled bends having controlled wrinkled portions. The closed circuit cooling tower comprises a fan operable to generate airflow relative to the serpentine circuit tubes and an evaporative liquid distribution assembly configured to distribute evaporative liquid onto the serpentine circuit tubes. The closed circuit cooling tower further comprises a sump to receive falling evaporative liquid from the serpentine circuit tubes and a pump operable to pump evaporative fluid from the sump back to the evaporative liquid distribution assembly. The controlled wrinkled bends strengthen the serpentine circuit tubes to withstand internal pressure from the working fluid within the serpentine circuit tubes during operation of the cooling tower. The controlled wrinkled bends also provide a constructive centerline radius of the wrinkled bends that is larger than the actual centerline radius of the controlled wrinkled bends and provides a reduced bend complexity factor compared to a return bend of a conventional serpentine circuit tube having the same outer diameter and wall thickness. The reduced bend complexity factor permits the controlled wrinkled bend to be bent without the use of an internal mandrel which simplifies the manufacturing process of the serpentine circuit tube.

DETAILED DESCRIPTION

Figure 1:
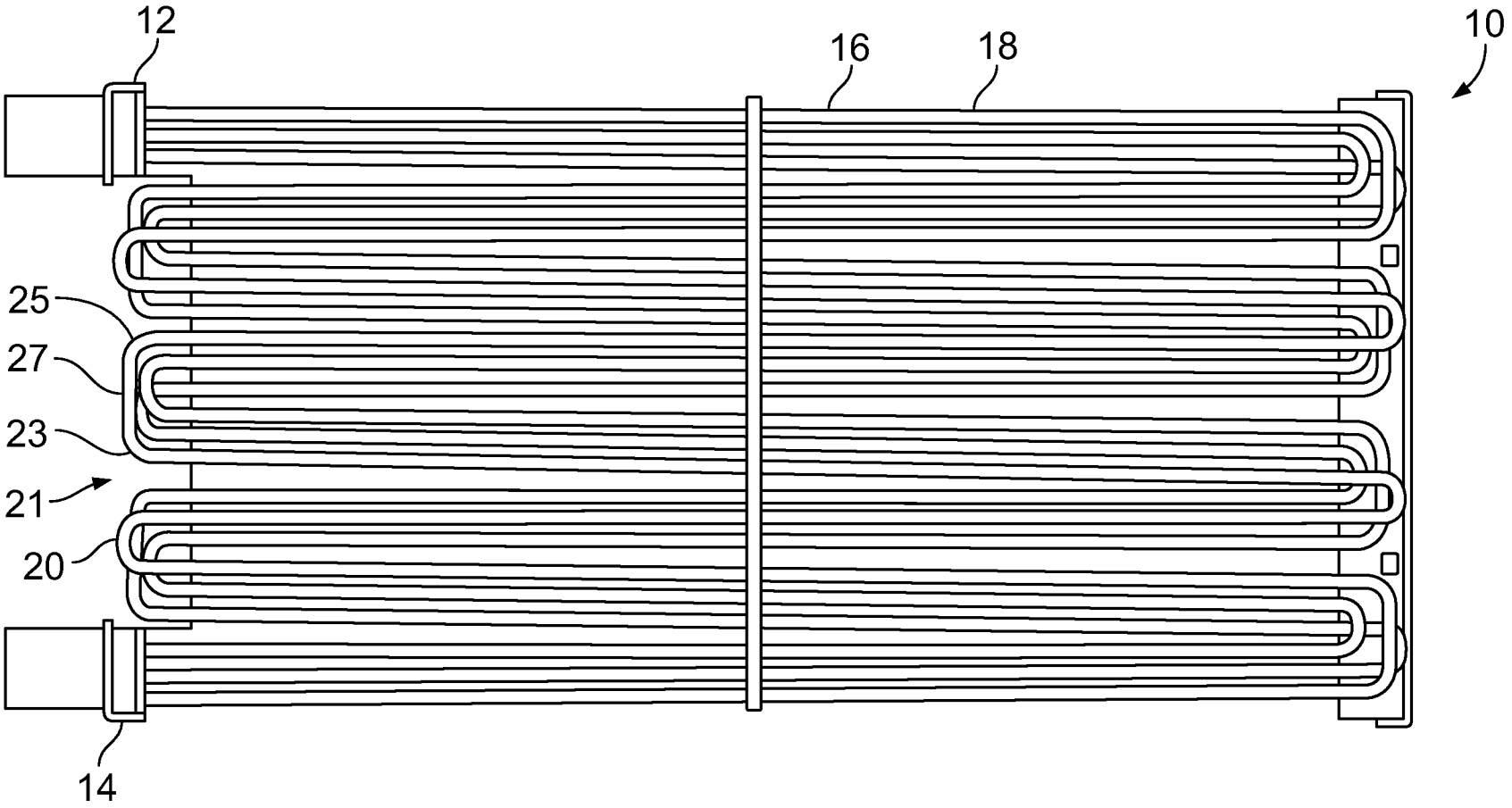
FIG. 1 is a perspective view of an indirect heat exchange apparatus having serpentine circuit tubes with runs connected by bends of the serpentine circuit tubes.

Regarding FIG. 1, an indirect heat exchanger pressure vessel such as a coil assembly 10 is provided that may be used in a heat exchange apparatus, such as an evaporative condenser, closed circuit fluid cooler, or an ice thermal storage system. The coil assembly 10 includes an inlet header 12, outlet header 14, and serpentine circuit tubes 16. The serpentine circuit tubes 16 each include runs 18 that are connected with 180 degree bends 20 or compound bends 21 including two 90 degree bends 23, 25 separated by a straight length 27. The serpentine circuit tubes 16 permit working fluid to flow from the inlet header 12, through the serpentine circuit tubes 16, and to the outlet header 14.

Figure 2:
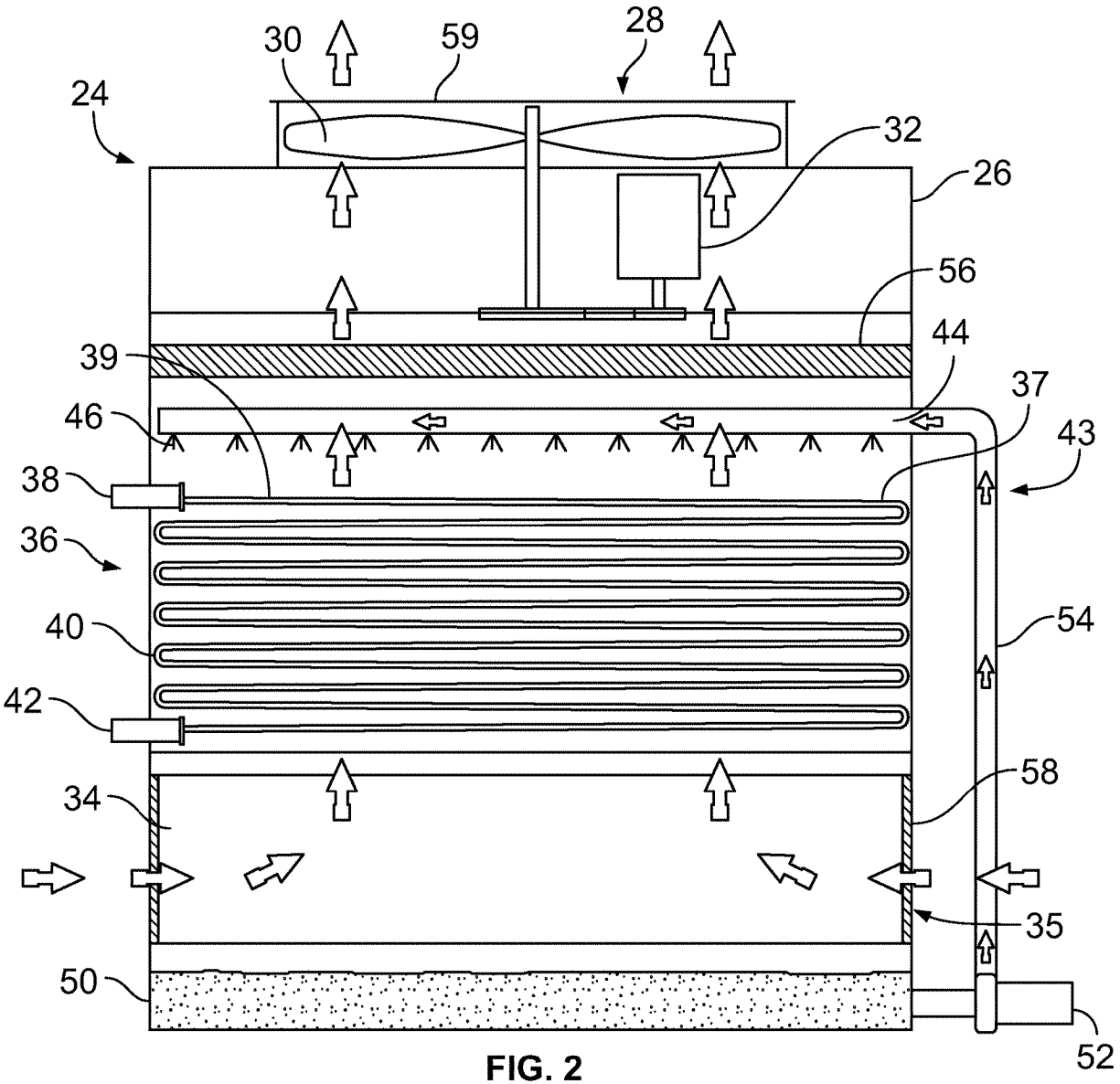
FIG. 2 is a schematic view of a heat exchange apparatus including serpentine circuit tubes.

Regarding FIG. 2, a heat exchange apparatus such as a cooling tower 24 is provided that includes an outer structure 26, one or more fans 28 including fan blades 30 and motor(s) 32, a direct heat exchanger such as fill 34, and an indirect heat exchanger pressure vessel 36. The cooling tower 24 may be an evaporative condenser, closed circuit cooing tower, or dry cooler heat exchanger as some examples. The indirect heat exchanger pressure vessel 36 includes inlet header 38, one or more serpentine circuit tubes 37 with circuit runs 39 and bends 40 and outlet header 42. The inlet and outlet headers 38, 42 may be reversed depending on the application. In some embodiments, the fill 34 is above the indirect heat exchanger pressure vessel 36 and/or the fill 34 is located between runs of the serpentine circuit tubes 37.

Regarding FIG. 2, the cooling tower 24 includes an evaporative liquid distribution system 43 including a spray assembly 44 having spray nozzles or orifices 46 that distribute an evaporative fluid, such as water, onto the serpentine circuit tubes 37 and the fill 34. The evaporative liquid distribution system 43 includes a sump 50 for collecting evaporative fluid from the fill 34 and the coil 36 and a pump 52 that pumps the collected evaporative fluid through a pipe 54 to the spray assembly 44. The cooling tower 24 further includes one or more air inlets 35, inlet louvers 58 which keep the evaporative liquid from leaving cooling tower 24, an air outlet 59, and an eliminator 56 to collect water mist from the air before the air leaves the air outlet 59. The fan 28 is operable to generate or induce air flow upwards relative to the serpentine circuit tubes 37 and the fill 34. In other embodiments, the cooling tower 24 may have one or more fans configured to induce airflow in upflow, downflow, or crossflow directions relative to the indirect heat exchanger and/or direct heat exchanger of the cooling tower 24.

Figure 3:
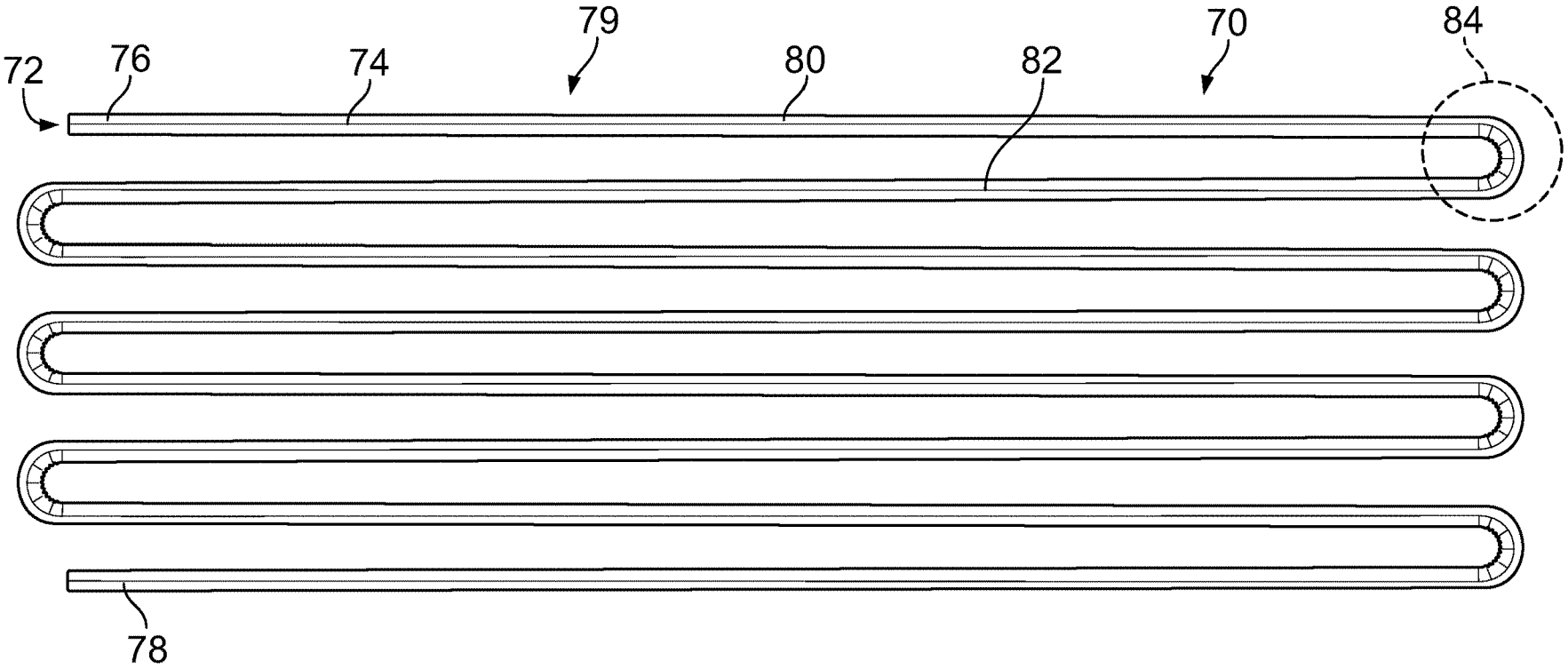
FIG. 3 is a side elevational view of a serpentine circuit tube having runs connected by 180 degree bends.

Regarding FIG. 3, a serpentine circuit tube 70 is provided that may be utilized with a heat exchange apparatus, such as the coil assembly 10 in FIG. 1, or the cooling tower 24 discussed above with respect to FIG. 2. The serpentine circuit tube 70 includes an internal passageway 72 and a tubular side wall 74 extending thereabout. The serpentine circuit tube includes an end portion 76 that may be connected to an inlet header and an end portion 78 that may be connected to an outlet header. Depending on the application, the end portion 76 may alternatively be connected to an outlet header and the end portion 78 may be connected to an inlet header. The serpentine circuit tube 70 includes runs 79, such as runs 80, 82, and bends 84. In one embodiment, the runs 79 may be parallel. In other embodiments, one or more of the runs 80 extend transversely, e.g., sloped, relative to one another to allow for internal fluid draining. The serpentine circuit tube 70 may be self-draining such that any liquid in the internal passageway 72 travels down toward the end portion 78 under the effect of gravity. The material of the serpentine circuit tube 70, outer diameter of the serpentine circuit tube 70, wall thickness of the side wall 74, number of runs 79, length of runs 79, number of bends 84, angular extent of bends 84, centerline radius of the bends 84, and intrados/extrados of the bends 84 may be selected for a particular heat exchange apparatus. As another example in this regard, instead of a single angle bend 84 connecting a pair of runs 79, the serpentine circuit tube may have one or more bends 84 that each include a pair of bends, such as 90 degrees, connected by a straight segment similar to the compound bend 21 shown in FIG. 1. The runs 80 may have circular cross-sections throughout the runs 80. In other embodiments, the serpentine circuit tube 70 includes one or more runs 80 with non-circular cross-sections such as cross sections that are elliptical or obround.

The serpentine circuit tube 70 may be formed from a single straight tube that is bent at spaced locations along the tube to form the bends 84. The serpentine circuit tube 70 may be formed by progressively roll forming an elongated strip of material into a tubular shape and welding longitudinal edges of the elongate strip together to form a single weld running along the length of the serpentine circuit tube 70. In another approach, the serpentine circuit tube 70 may be made from a plurality of separately formed components. For example, the runs 79 may be separate components that are welded to the bends 84. Alternately the serpentine circuit tube 70 may be formed by welding separate lengths of tube together and then bending the longer welded tube. The serpentine circuit tube 70 may be made of a metallic material, such as carbon steel or stainless steel.

Figure 4:
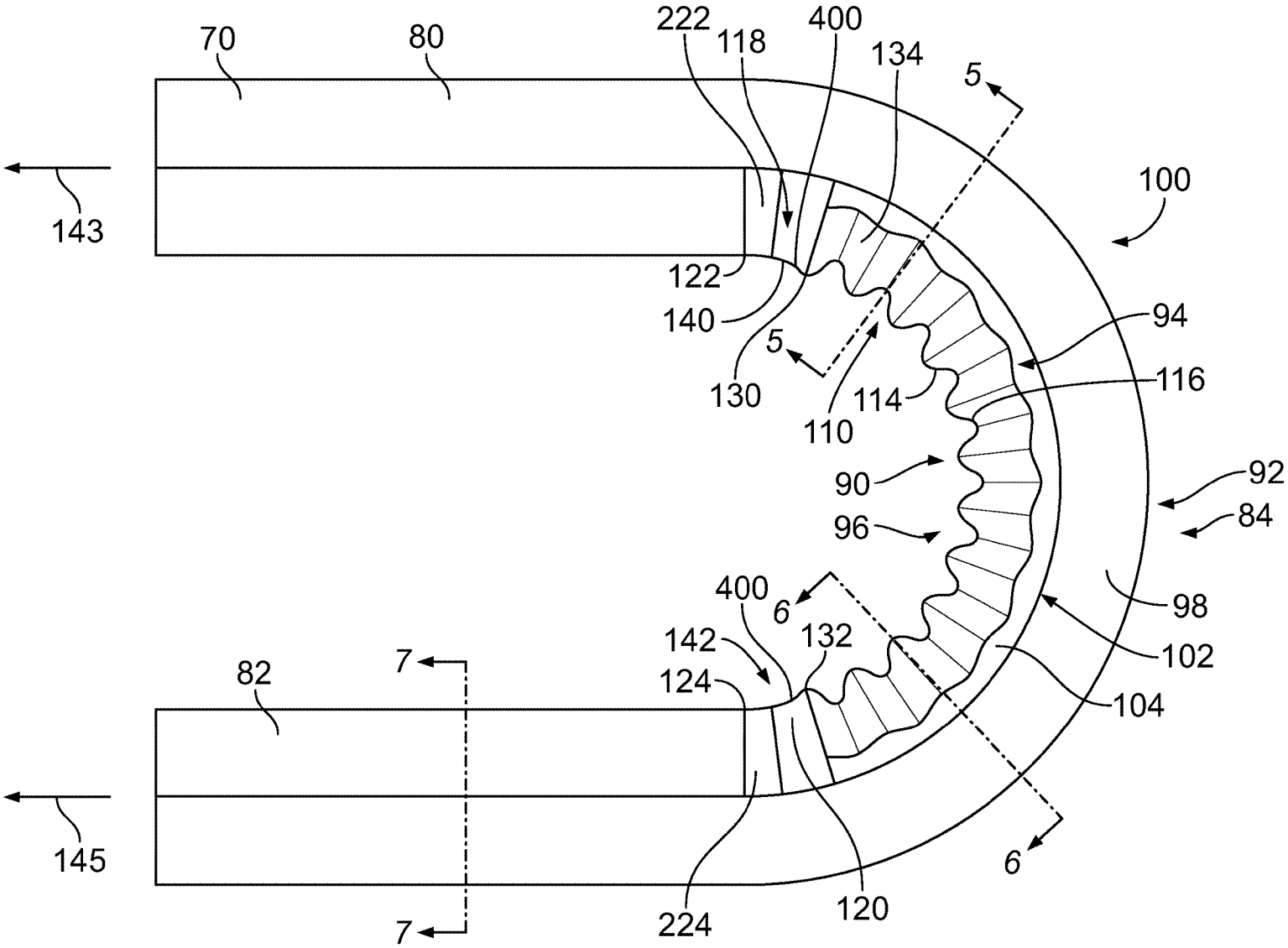
FIG. 4 is an enlarged view of the bend shown in a dashed circle of FIG. 3 showing a controlled wrinkled portion of an inside of the bend.

Regarding FIG. 4, each bend 84 includes an intrados 90, an extrados 92, and a controlled wrinkled portion 94 of an inside 96 of the bend 84 and a smooth outer surface 98 at an outside 100 of the bend 84. The controlled wrinkled portion 94 includes a continuously curving and controlled wrinkled surface 134 of the ridges 114 and the grooves 116. The continuously curving controlled wrinkled surface 134 is uninterrupted by edges, corners, or flats to avoid localized areas of stress. The continuously curving and controlled wrinkled surface 134 is shaped by ridges 114 and grooves 116 of the bend 84 that are, in turn, defined at least in part by an intersecting sinusoidal wave pattern 110 and an arc pattern 150 as discussed in greater detail below with respect to FIG. 15. The bend 84 shown in FIG. 4 has a 180 degree bend angle. When the subject disclosure refers to a particular bend angle of a bend, it is intended that the bend angle is an approximate value, such as +/−5 degrees. In some embodiments, all of the bends 84 of the serpentine circuit tube 70 have controlled wrinkled portions 94. In other embodiments, fewer than all of the bends 84 have controlled wrinkled portions 94.

The serpentine circuit tube 70 has a tube center line 102 extending through the runs 80, 82 and in the bend 84. The controlled wrinkled portion 94 is radially inward from the tube center line 102 and separated therefrom by a side surface portion 104. The smooth outer surface portion 98 and the side surface portion 104 permits the bend 84 to be stacked with bends of other serpentine circuit tubes in conventional arrangements as would a prior art tube having a smooth inner bend.

Referring to FIG. 4 at the intrados 90 of the bend 84, the controlled wrinkled portion 94 has a sinusoidal wave pattern 110 at the intrados 90 of the bend 84 as discussed below with respect to FIGS. 8 and 9A. The wrinkled portion 94 includes an alternating series of ridges 114 and grooves 116. In one embodiment, the bend 84 has relief portions 222, 224 intermediate the sinusoidal wave pattern 110 and tangent points 122, 124 between the runs 80, 82 and the bend 84. The relief portions 222, 224 facilitate provision of a controlled wrinkled portion angle 240 that is less than a bend angle 220 as discussed in greater detail below. The relief portions 222, 224 extend from the tangent points 122, 124 to points 216, 218. The wrinkled portion 94 further includes tapered lead-in portions 140, 142 extending between points 216, 218 and points 400 (see FIG. 4) wherein the sinusoidal wave pattern 110 begins and ends. In one embodiment, the relief portions 222, 224 each have a first radius and the tapered lead-in portions 140, 142 each have a smaller, second radius. The sinusoidal wave pattern 110 starts at one point 400, extends through a peak 130 of the end ridge 118, undulates through the ridges 114 and grooves 116, extends through a peak 132 of the end ridge 120, until reaching the other point 400.

The ridges 114 include end ridges 118, 120 that optionally have tapered lead-in portions 140, 142. The tapered lead-in portions 140, 142 provide a smooth transition between the relief portions 222, 224 and the sinusoidal wave pattern 110. The tapered lead-in portions 140, 142 smooth flow of the working fluid through the bend 84 and assists the material of the bend 84 to flow during bending. The tapered lead-in portions 140, 142, ridges 114, and grooves 116 reduce the internal fluid pressure drop caused by the working fluid flowing through the bend 84. Further, the tapered lead-end portion 140 facilitates better draining of the serpentine circuit tube 70. The bend 84 may have both tapered lead-in portions 140, 142 if the working fluid may flow through the bend 84 in either direction 143, 145. If the working fluid will only be flowing through the bend 84 in one direction 143, 145, the bend 84 may have only one tapered lead-in portion 140, 142.

Figure 9A:
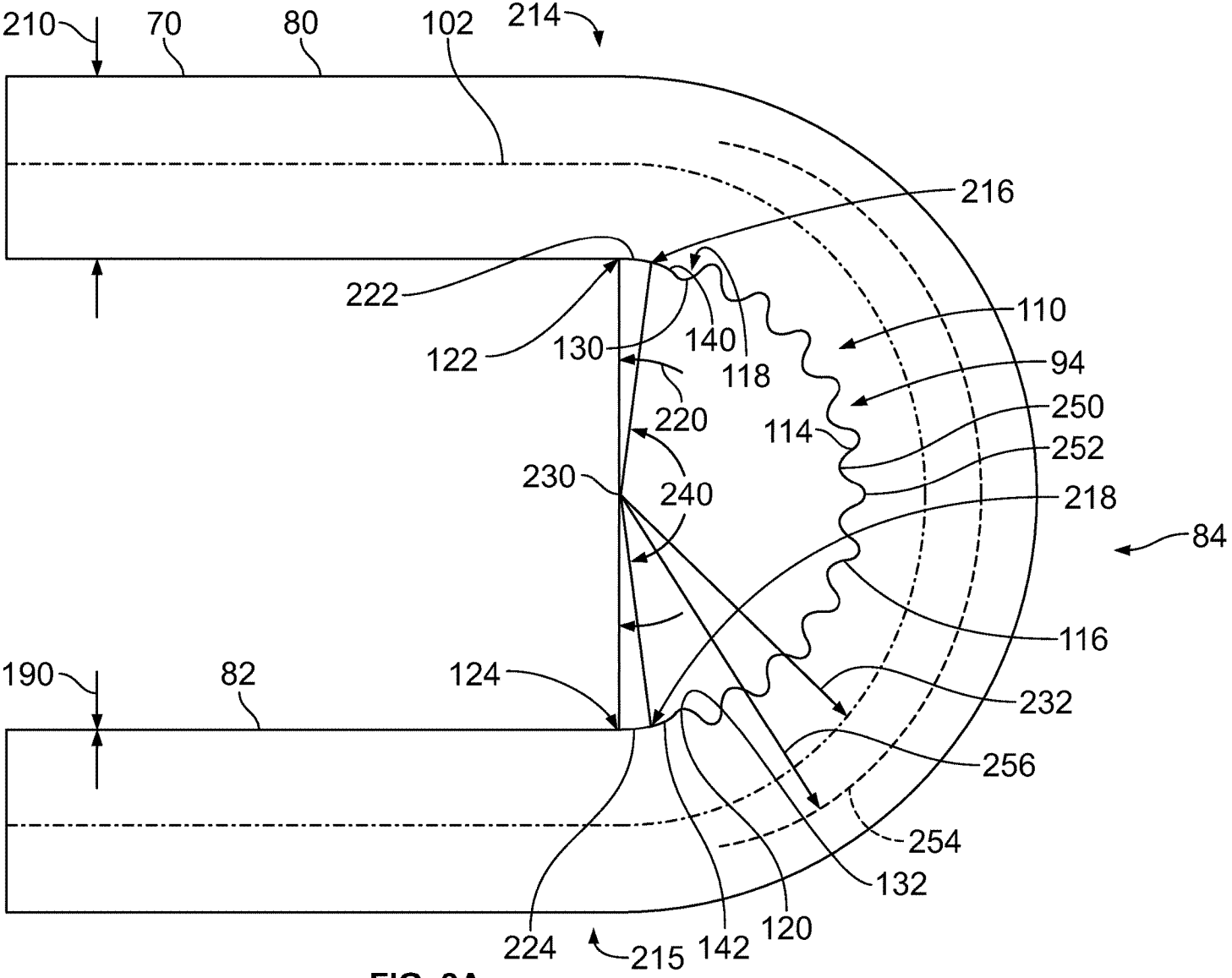
FIG. 9A is a cross-sectional view taken across line 9A-9A in FIG. 8 showing a sinusoidal pattern of the wrinkled portion that is spaced from tangent points of the bend and the runs so that the wrinkled portion has an angular extent that is less than the 180 degree bend angle of the bend.
Figure 9B:
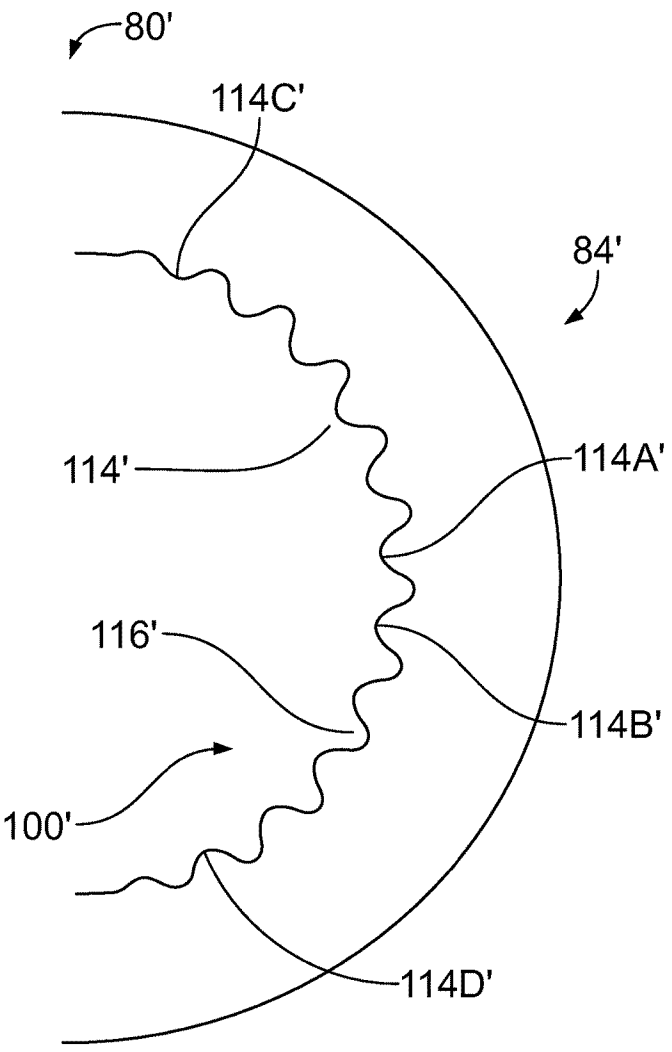
FIG. 9B is a cross-sectional view similar to FIG. 9A of another embodiment of the bend having a wrinkled portion with a varying amplitude of ridges and valleys of the sinusoidal pattern.

Regarding FIG. 9B, a cross-sectional view of a bend 84' is provided that is similar to the bend 84 and has a sinusoidal wave pattern 110' at a midline of the bend 84'. The bend 84' has ridges 114' and grooves 116' that vary in amplitude around the bend 84'. Specifically, the ridges 114' and grooves 116' closer to runs 80', 82' have small amplitudes and the ridges 114' and grooves 116' near a middle of the bend 84' have larger amplitudes. For example, ridges 114A', 114B' have larger amplitudes than ridges 114C', 114D'. The more gradual increase in the amplitude of the ridges 114' and grooves 116' provide a reduced resistance to fluid flow through the bend 84' such that the bend 84' has a reduced pressure drop across the bend 84' compared to the bend 84 in some applications. The more gradual increase in the amplitude of ridges 114' and grooves 116' may also reduce stress in the material of the bend 84' during the bending operation compared to the bend 84 in some applications. In other embodiments, the amplitude of the sinusoidal wave pattern of the bend 84' may increase from adjacent one run connected to the bend 84' to adjacent the other run connected to the bend 84'.

Figure 9C:
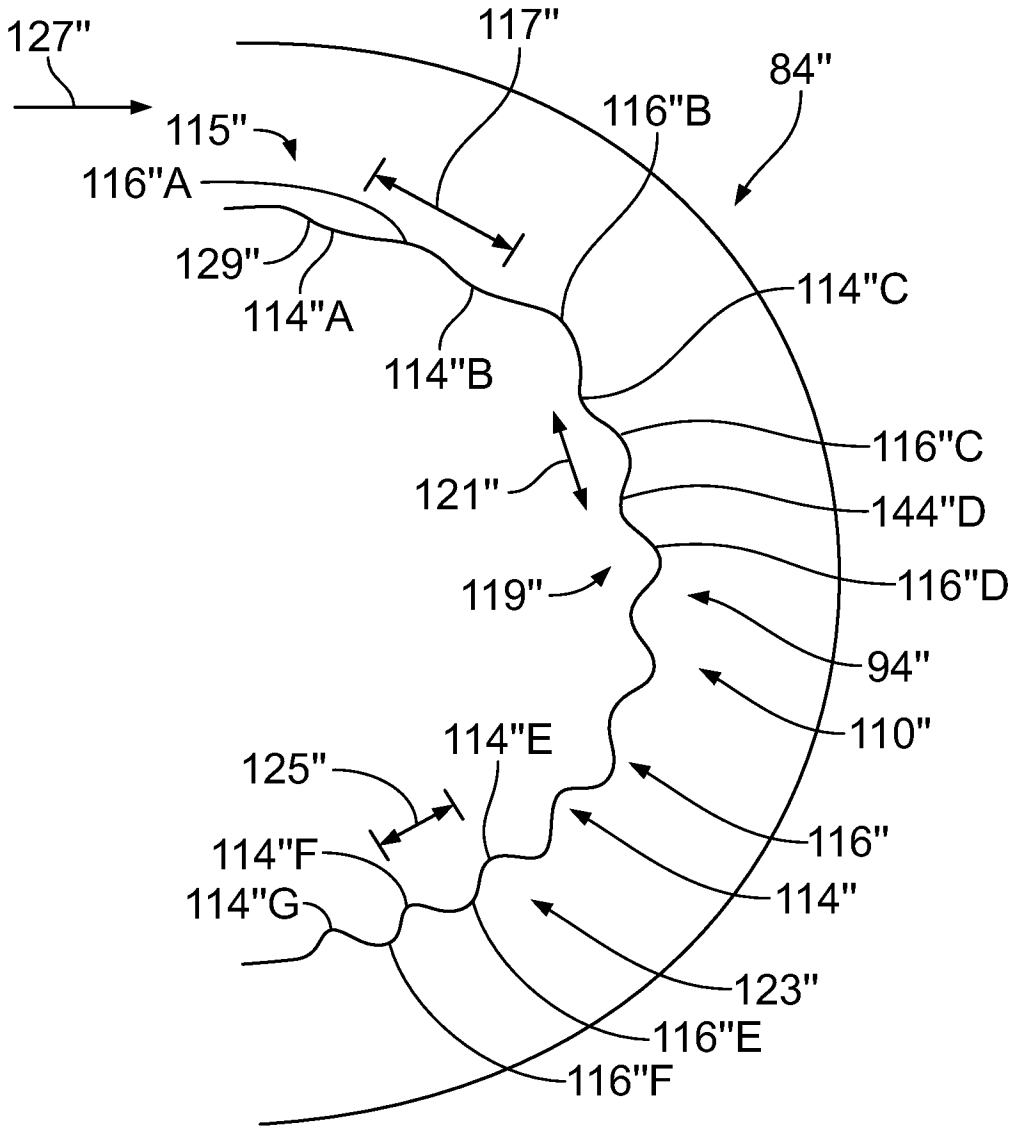
FIG. 9C is a cross-sectional view similar to FIG. 9A of another embodiment of the bend having a wrinkled portion with a varying period and a varying amplitude of ridges and valleys of the sinusoidal pattern.

Regarding FIG. 9C, a cross-sectional view of a bend 84" is provided that is similar to the bend 84 and has a controlled wrinkled portion 94" with a sinusoidal wave pattern 110" at an intrados of the bend 84". The controlled wrinkled portion 94" includes ridges 114" and grooves 116". The controlled wrinkled portion 94" includes a first portion 115" having ridges 114"A, B and grooves 116"A, B with a first amplitude and a first period 117". The controlled wrinkled portion 94" includes a second portion 119" having ridges 114"C, D and grooves 116"C, D with a second amplitude greater than the first amplitude. The ridges 114"C, D and grooves 116" C, D have a second period 121" that is less than the first period 117". The controlled wrinkled portion 94" further includes a third portion 123" having ridges 114"E, F and grooves 116"E, F with a third amplitude that is substantially the same as the second amplitude of the second portion 119" and a third period 125" that is less than the second period 121". The bend 84" receives fluid in direction 127" and the ridge 114"A includes a tapered lead-in portion 129" to smooth fluid flow through the bend 84". The tapered lead-in portion 129" reduces pressure drop across the bend 84" and improves draining of fluid in the bend 84".

The characteristics of the sinusoidal wave pattern 110 utilized for a given return bend may be selected for a particular application. For example, the number of ridges/grooves, amplitude, period, and/or one or more tapered lead-in portions may be selected for a particular application. The characteristics of the return bend may vary throughout the return bend, such as the amplitude and period varying throughout the return bend. The shape of the controlled wrinkled portion 94 as formed at least in part by two different intersecting cross-sectional profiles. Regarding FIGS. 4 and 15, the controlled wrinkled portion 94 includes a sinusoidal wave portion 110 at the intrados 90 of the bend 84. The other pattern is an arc pattern 150 that includes alternating peak arcs 152 and valley arcs 154. Referencing FIGS. 16A and 17A, the peak arc 152 has a peak arc radius 152' and a center 182 and the valley arc 154 has a valley arc radius 158 and a center 172. In this embodiment, the peak arc 152 and valley arc 154 are substantially the same. As used herein, the term substantially the same refers to dimensions that are effectively the same when taking manufacturing variation into account, such as within +/−10% of one another. The peak arc 152 extends through an angle 160 that is greater than an angle 162 through which the valley arc 154 extends.

Figure 5:
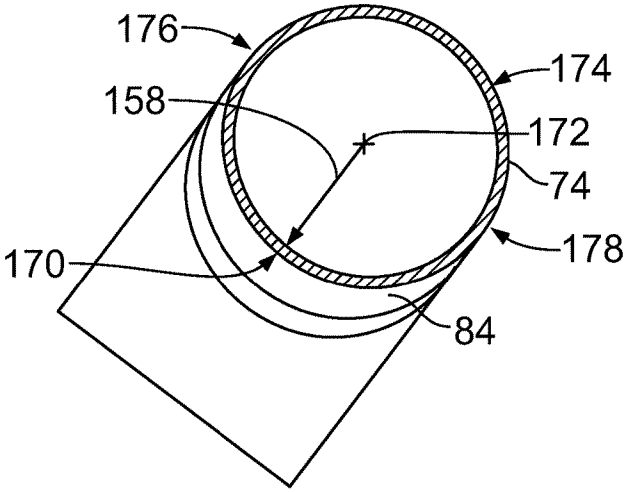
FIG. 5 is a cross-sectional view taken across line 5-5 in FIG. 4 showing a cross-section of the bend at a groove of the wrinkled portion.

Returning to FIGS. 5 and 15, the valley arc 154 forms a valley semicircular inner wall portion 170 having the valley arc radius 158 and the center 172. Opposite the valley semicircular inner wall portion 170, the bend 84 includes an outer wall portion 174 that may be semicircular. In some embodiments, the outer wall portion 174 may be curved with a flattened portion due to extrados 92 (see FIG. 4) of the bend 84 being tensioned during the bending process. The bend 84 includes connecting wall portions 176, 178 that connect the valley semicircular inner wall portion 170 to the outer wall portion 174. The connecting wall portions 176, 178 have a curvature that may be dissimilar from the inner and outer wall portions 170, 174. The connecting wall portions 176, 178 provide a smooth transition between the geometries of the inner and outer wall portions 170, 174 to minimize stress concentration at the junctures between the geometries of the inner and outer wall portions 170, 174. By reducing stress concentration at the juncture between the geometries of the inner and outer wall portions 170, 174, the connecting wall portions 176, 178 assist in the bend 84 being able to withstand high internal operating pressure.

Figure 6:
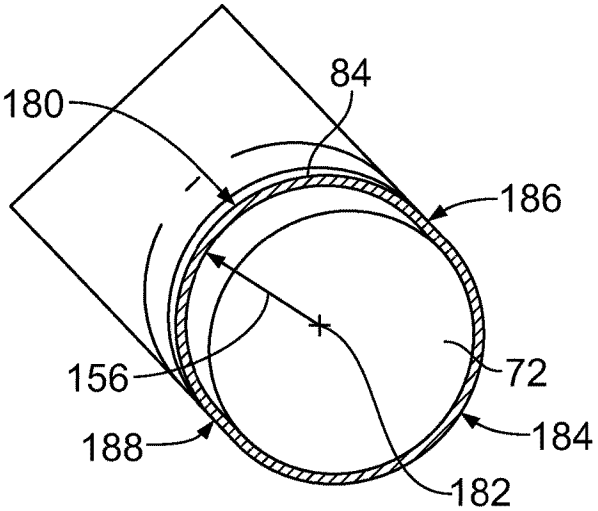
FIG. 6 is a cross-sectional view taken across line 6-6 in FIG. 4 showing the cross-section of the bend at a ridge of the wrinkled portion.
Figure 15:
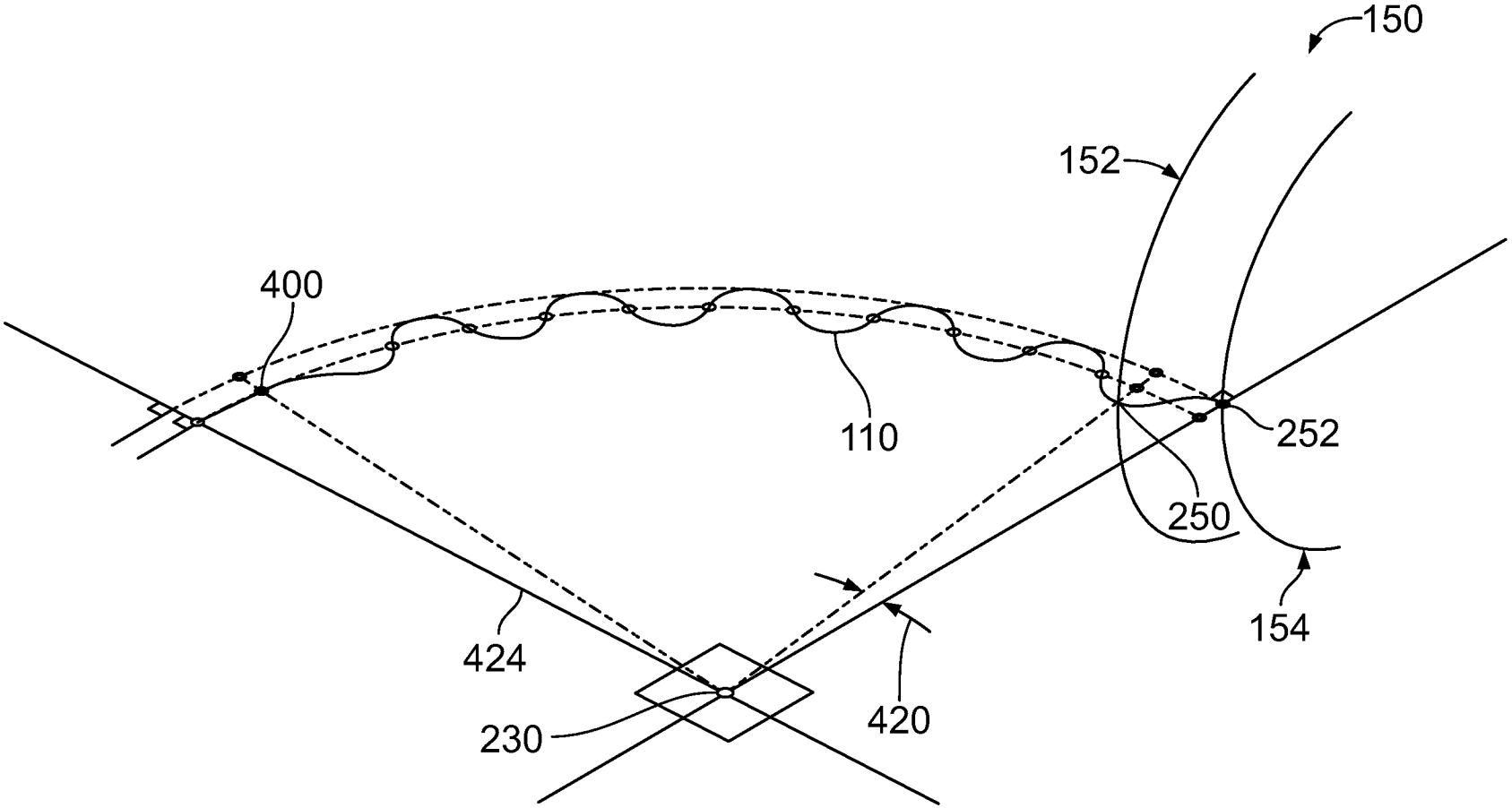
FIG. 15 is a graphical representation of a portion of the sinusoidal pattern of the return bend intersecting with an arc pattern of the return bend, the arc pattern including a peak arc that intersects a peak of the sinusoidal pattern and a valley arc that intersects a valley of the sinusoidal pattern.
Figure 16A:
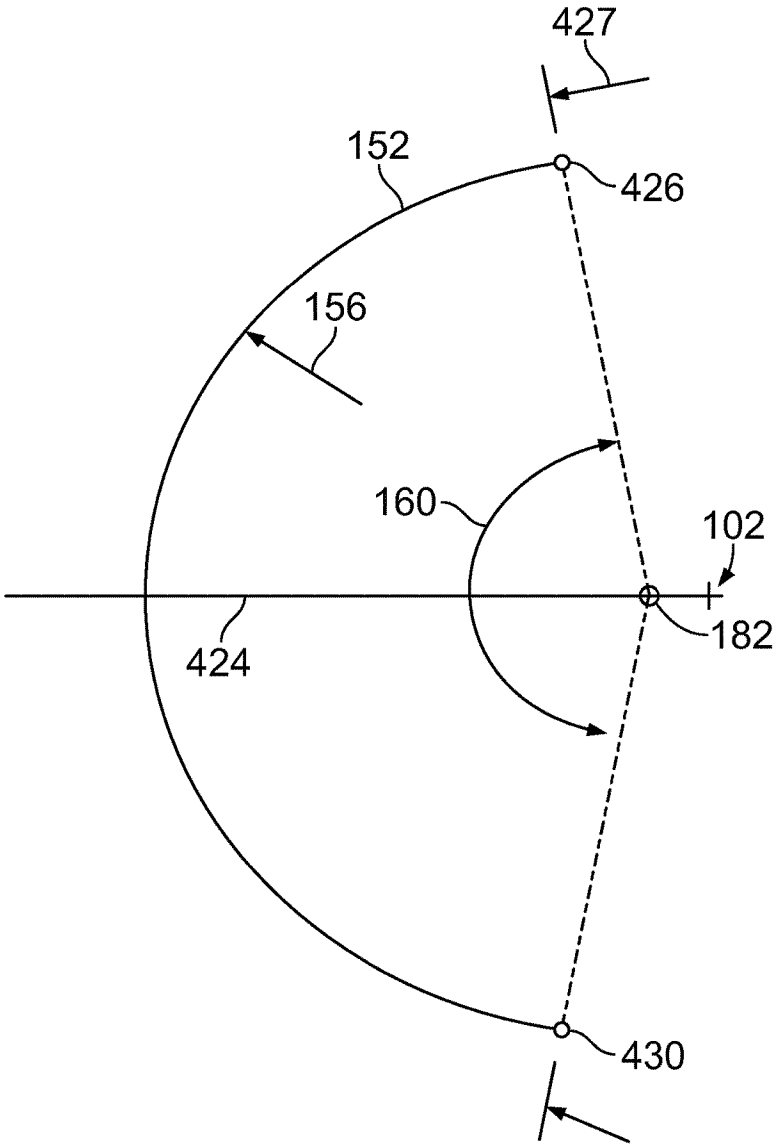
FIG. 16A is a graphical representation of the peak arc of FIG. 15 showing the peak arc having a radius of curvature, an angular extent, and a center, wherein the center is radially inward of a center line of the serpentine circuit tube.
Figure 16B:
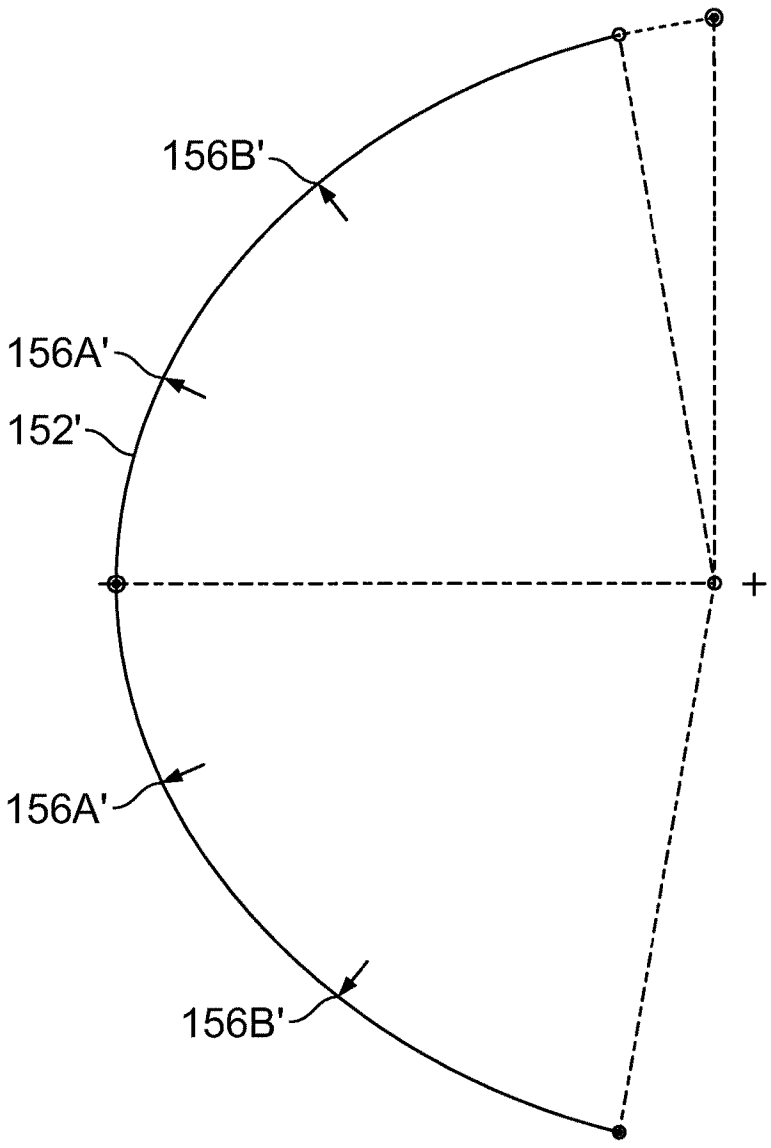
FIG. 16B is a graphical representation similar to FIG. 16A of a peak arc having a composite radius of curvature.
Figure 17A:
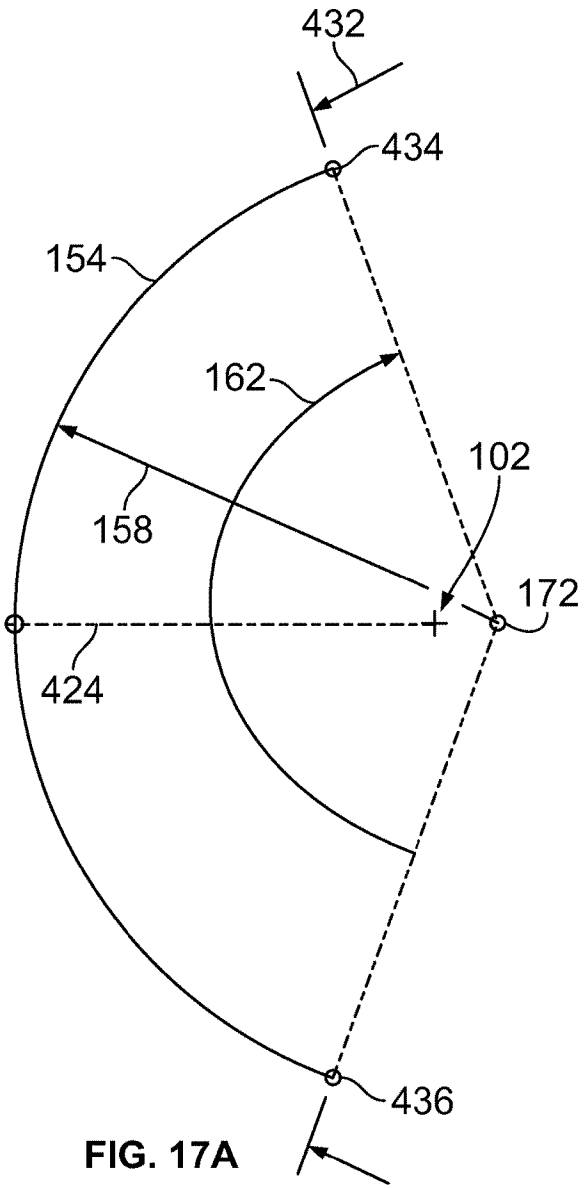
FIG. 17A is a graphical representation of the valley arc of FIG. 15 showing the valley arc having substantially the same radius of curvature as the peak arc, a shorter angular extent than the peak arc, and a center, wherein the center is radially outward from a center line of the tube.
Figure 17B:
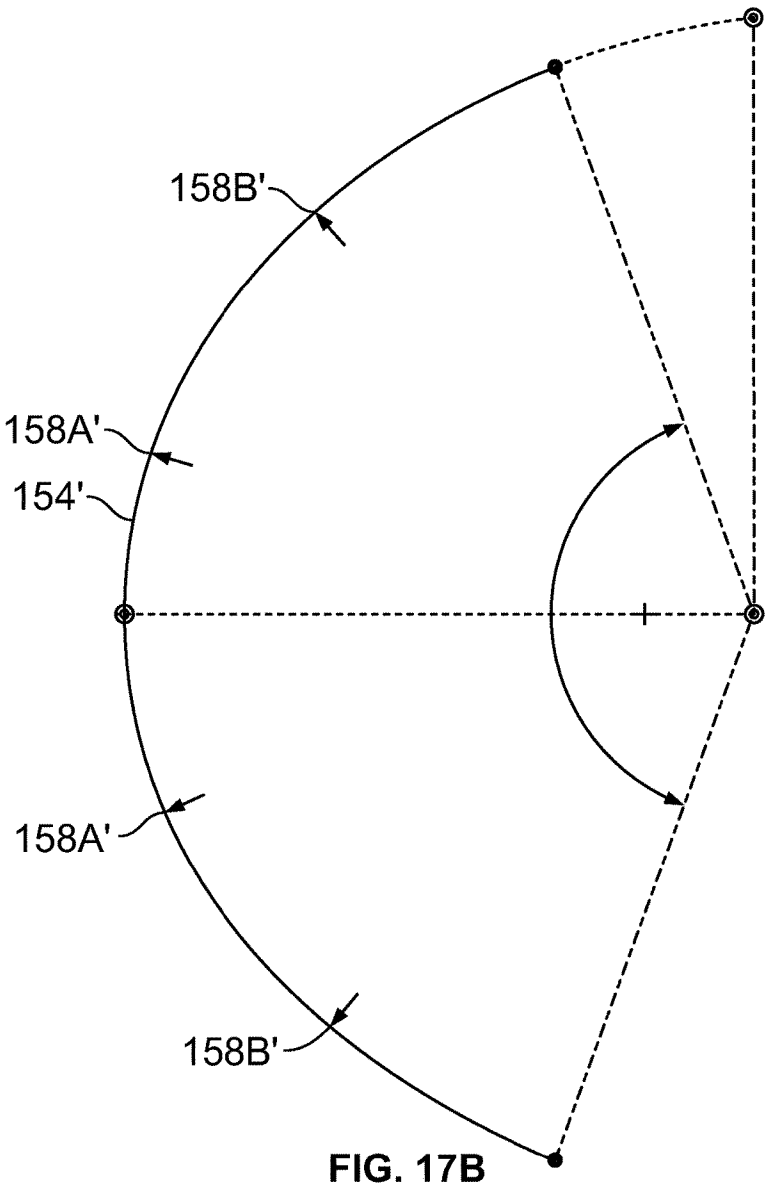
FIG. 17B is a graphical representation similar to FIG. 17A of a valley arc having a composite radius of curvature.

Regarding FIGS. 6 and 15, the peak arc 152 defines a peak semicircular inner wall portion 180 having the peak arc radius 156 with the center 182. The bend 84 has an outer wall portion 184 opposite the peak semicircular inner wall portion 180. Like the outer wall portion 174 (see FIG. 5), the outer wall portion may be semicircular. In some embodiments, the outer wall portion 184 may be curved with a flattened portion due to the extrados 92 (see FIG. 4) of the bend 84 being tensioned during the bending process. The bend 84 further includes connecting wall portions 186, 188 connecting the peak semicircular inner wall portion 180 and the outer wall portion 184. Like the outer wall portion 174, the outer wall portion 184 may have a semicircular shape or generally curved shape in some embodiments. Further, the connecting wall portions 186, 188 provide a smooth transition between the geometries of the inner and outer wall portions 180, 184 to minimize stress concentration at the junctures between the geometries of the inner and outer wall portions 180, 184. The connecting wall portions 186, 188 contribute to the ability of the bend 84 to withstand high internal operating pressure. The peak arc 152 and valley arc 154 may each have a respective single radius as shown in FIGS. 16A and 17A. In another embodiment, the peak arc 152 and/or the valley arc 154 has a compound or composite radius. For example, and with reference to FIG. 16B, the peak arc 152' has different radii 156A', 156B'. Each radius of the peak arc 152' is tangent at the point where the radius joins an adjacent radius. Likewise in FIG. 17B, the valley arc 154' has different radii 158A', 158B'.

Figure 16C:
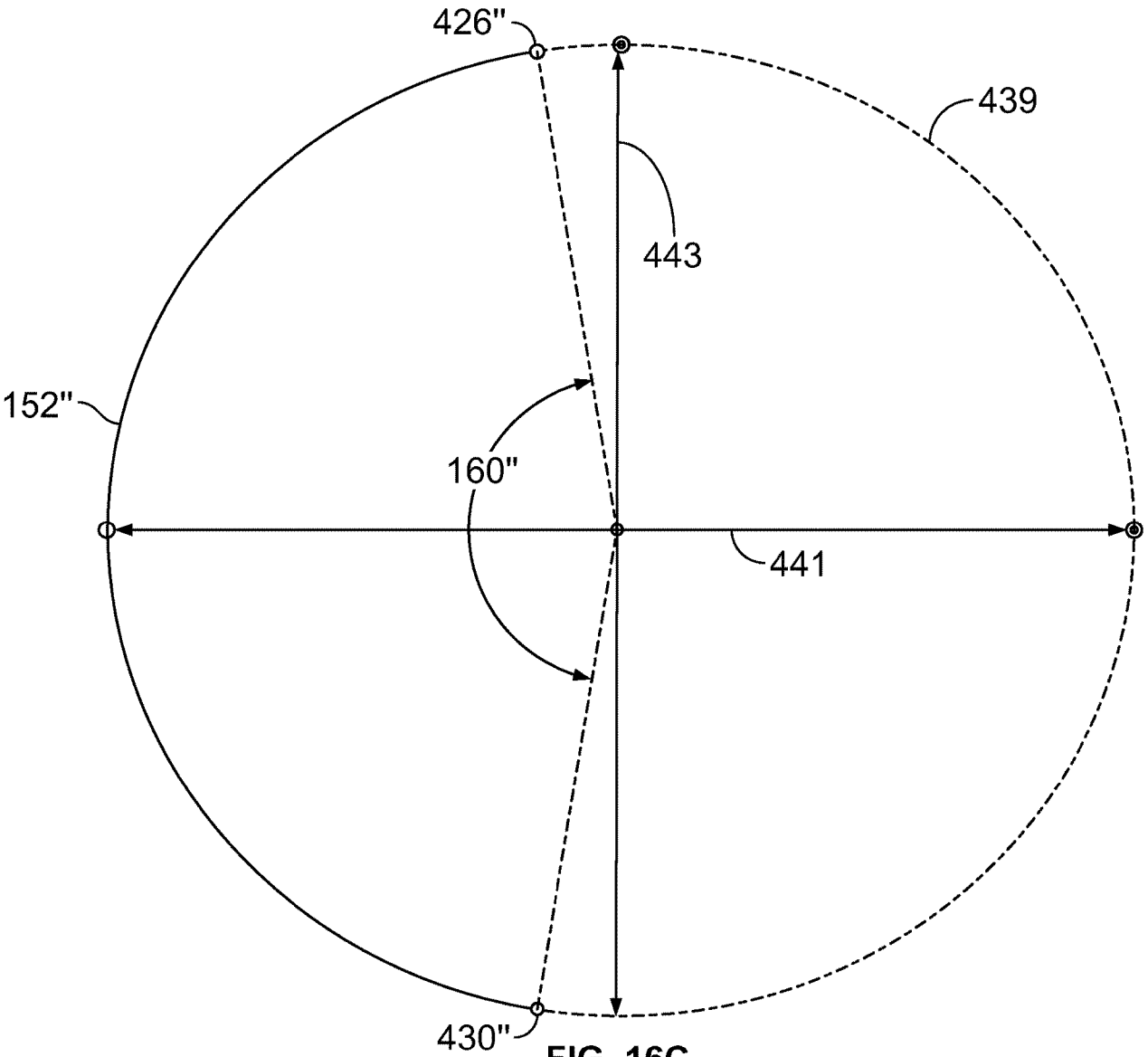
FIG. 16C is a graphical representation similar to FIG. 16A of a peak arc having a shape defined by a portion of an ellipse.
Figure 17C:
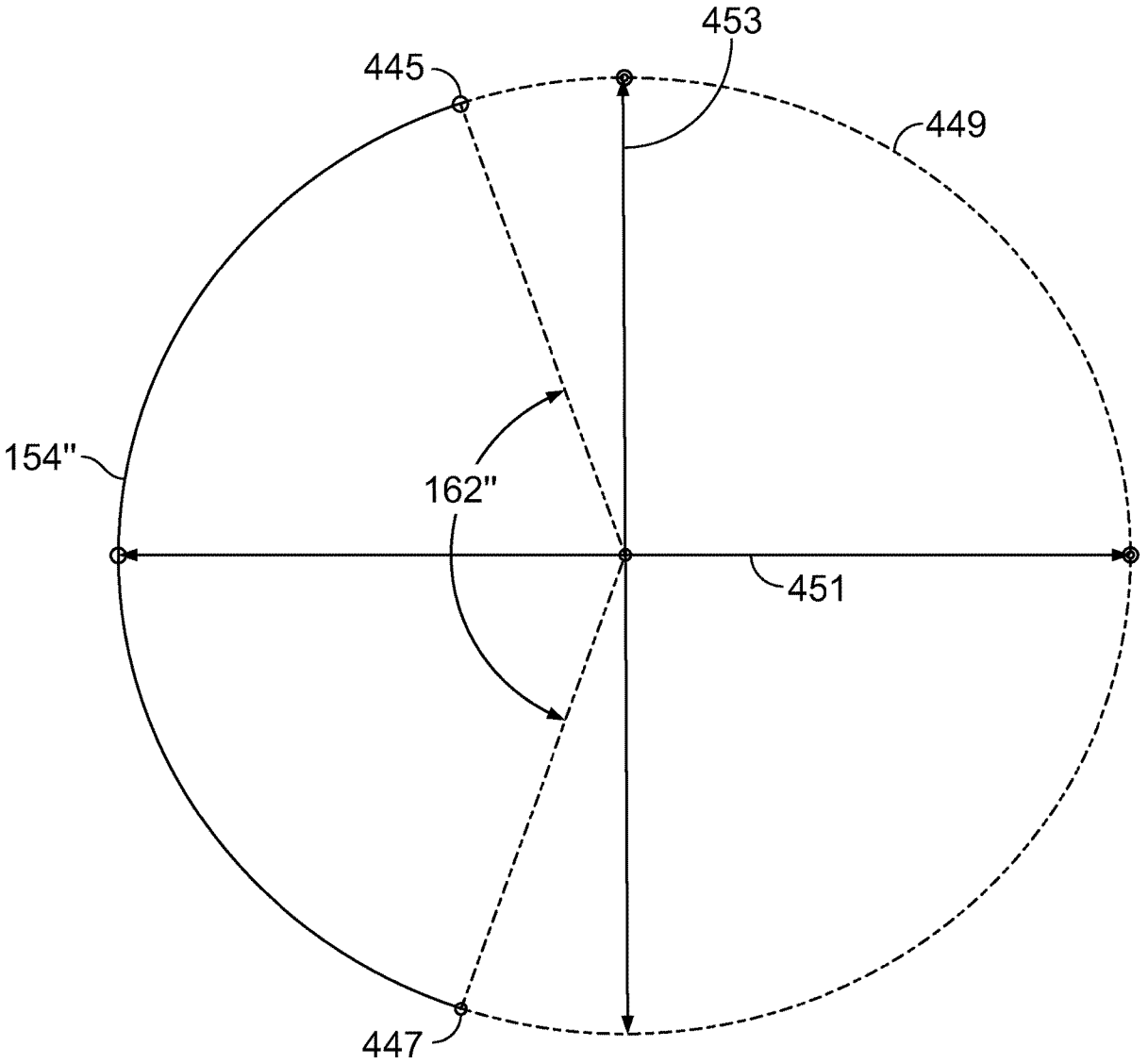
FIG. 17C is a graphical representation similar to FIG. 17B of a valley arc having a shape defined by a portion of an ellipse.

In another embodiment, the peak arc 152 and/or the valley arc 154 has a shape that is a portion of an ellipse. For example, the peak arc 152" of FIG. 16C is an arc defined by an angle of 160", such as 160 degrees, between points 426", 430" of an ellipse 439 having a major dimension 441 and a minor dimension 443. Similarly, the valley arc 154" in FIG. 17C has a shape that is defined by an angle 162", such as 142 degrees, between points 445, 447 of an ellipse 449 having a major axis 451 and a minor axis 453.

Figure 7:
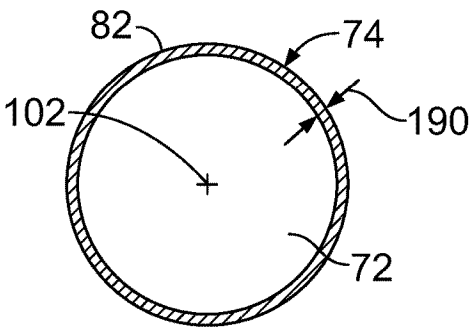
FIG. 7 is a cross-sectional view taken across line 7-7 in FIG. 4 showing the cross-section of one of the runs of the circuit tube.

Regarding FIG. 7, the run 82 is shown with the side wall 74 having a circular cross-section with a center at the tube center line 102. Side wall 74 may also have a non-circular cross section such as elliptical or oblong cross-section. The side wall 74 of the serpentine circuit tube 70 has a wall thickness 190 that extends about the inner passageway 72.

Figure 8:
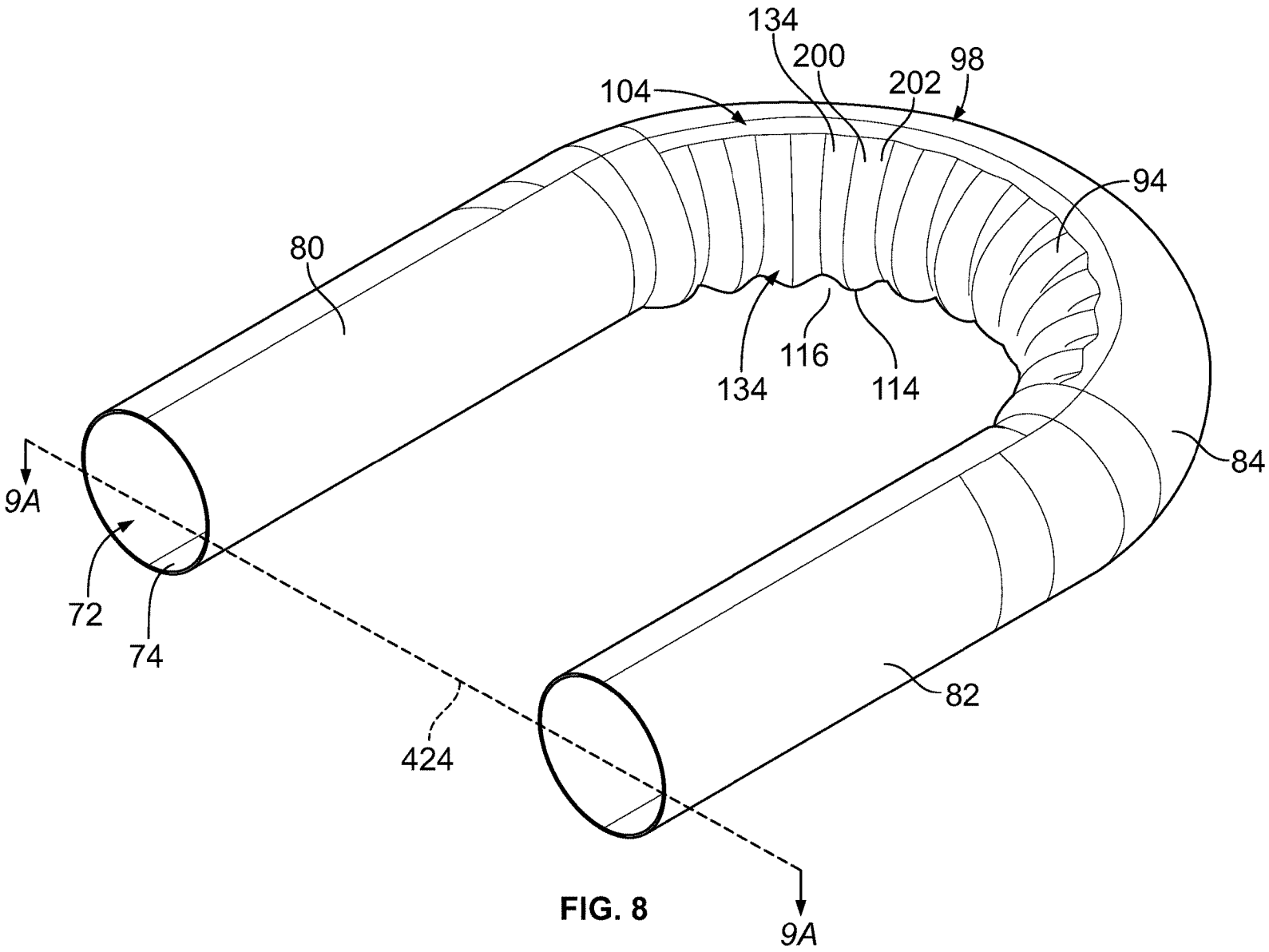
FIG. 8 is a perspective view of the bend of FIG. 4 showing the wrinkled portion of the inside of the bend and a smooth outer wall portion of the outside of the bend.

Regarding FIG. 8, the sections of the runs 80, 82 and the bend 84 are shown in a perspective view. As noted above, the controlled wrinkled portion 94 has a continuously curving controlled wrinkled surface 134 including curved ridge surface portions 200 on opposite sides of each ridge 114 and curved groove surface portions 202 on opposite sides of each groove 116 connecting the curved ridge surface portions of adjacent ridges 114. The ridge surface portions 200 and groove surface portions 202 form the continuous, undulating appearance of the controlled wrinkled portion 94.

Regarding FIG. 9A, the serpentine circuit tube 70 has an outer diameter 210 and the wall thickness 190. The tube center line 102 extends through the runs 80, 82 and the bend 84. The serpentine circuit tube has junctures 214, 215 between the runs 80, 82 and the bend 84. At the junctures 214, 215, the tube 70 includes the tangent points 122, 124 between the runs 80, 82 and the bend 84. The bend 84 includes the reliefs 222, 224 extending away from the tangent points 122, 124 and the tapered lead-in portions 140, 142 ramp radially inward toward the peaks 130, 132 of the end ridges 118, 120. The bend 84 has a center 230 and a center line radius 232 extending from the center 230 to the tube center line 102. In the embodiment shown, the bend 84 has a bend angle 220 of 180 degrees and the controlled wrinkled portion 94 extends about the center 230 through a controlled wrinkled portion angle 240 that is less than the bend angle 220. For example, the controlled wrinkled portion angle 240 may be 5° or less, 10° or less, or 15° or less than the bend angle 220. In one embodiment, the bend angle is 180 degrees and the wrinkled portion angle 240 is approximately 166 degrees.

Referring again to FIG. 9A, the controlled wrinkled portion 94 positions peaks 250 of the ridges 114 at the intrados 90 (see FIG. 4) of the bend 84 and positions valleys 252 of the grooves 116 radially outward from the peaks 250. By positioning the valleys 252 outward of the intrados 90 of the bend 84, the wrinkled portion 94 creates a constructive bend center line 254. The constructive bend center line 254 has a constructive bend center line radius 256 that is greater than the center line radius 232 of the tube centerline 102. Because the constructive bend center line radius 256 is larger than the bend center line radius 232, the bend complexity ratio of the bend 84 for a given bend intrados and extrados is less than the bend complexity ratio of a conventional bend having the same intrados, extrados, outer diameter, and wall thickness. The bend 84 has a lower bend complexity ratio because of the larger constructive bend center radius 256.

For example, a tube bend for a particular application may be provided with the following characteristic ratios:

$$\text{Wall Factor} = W_1 = \frac{OD_1}{WT_1}$$

$$D \text{ of Bend} = D_1 = \frac{CLR_1}{OD_1}$$

$$\text{Bend Complexity} = C_{B1} = \frac{W_1}{D_1}$$

Wherein OD refers to tube outer diameter, WT refers to wall thickness, and CLR refers to the bend centerline radius. Assuming that the values of these ratios for the tube bend are:

$W_1$=20 and $D_1$=2 therefore $C_{B1}$=10

Referring to Table 1 above, these values indicate that internal mandrel bending may be required if a conventional tube bender is used.

Now certain parameters of the bend are changed to show improved serpentine tube characteristics such as tighter bend radius for the same wall thickness, reduced coil weight, reduced internal fluid side pressure drop, reduced bend wall stresses, increased tube strength, increased tube stiffness, and/or increased heat transfer efficiency. These changes affect the characteristic ratios. For example, the new characteristic ratios may be selected as:

$W_2$=30 and $D_1$=2 therefore $C_{B2}$=15

The Bend Complexity characteristic ratio is now in the range where conventional tube benders can no longer compensate, and an internal mandrel is conventionally used to make this bend.

Internal mandrel bending is often undesirable for a variety of reasons as discussed above, making internal mandrel bending impractical for manufacturers that utilize long continuous lengths of tube to fabricate heat exchanger coils.

Referring again to FIG. 9A, one way to overcome the internal mandrel requirement is to lower the Bend Complexity by increasing the Bend CLR. In our example, if we can increase the CLR of the bend while the tube outer diameter and wall thickness remains the same, we can increase the D of the bend from two to three and obtain the following bend complexity ($C_B$) ratio:

$W_2$=30 and $D_2$=3 therefore $C_{B2}$=10

Because the $C_{B2}$ ratio is in the range of five to ten, the bend may be formed without an internal mandrel. However, simply increasing the bend CLR for a given application may not be acceptable because the new bend would be larger and occupy more space than the original bend. For example, the center-to-center distance between tube runs would be greater which means fewer tube runs could be fit into a certain envelop or coil height. Further, because each bend of the serpentine circuit tube would be taller, the serpentine circuit tube would have fewer runs for a given coil envelope or height which would reduce heat exchange capacity of the serpentine circuit tube. Reducing the number of runs of a serpentine circuit coil to increase the bend CLR is not an acceptable solution for many applications.

Referring again to FIG. 9A, the controlled wrinkled portion 94 of the bend 84 provides the constructive bend center line radius 256 that is larger than the actual bend center line radius 232 without increasing the distance between the runs 80, 82. The larger constructive bend center line radius 256 increases the CLR of the bend 84, which increases the D of the bend for a given OD and permits the $C_B$ to be in a range such that mandrel bending is not required.

More specifically, the controlled wrinkled portion 94 provides a constructive bend center line 254 in the available space of the bend 84 thereby allowing for sufficient length along the inside of the bend 84 for the material to form the ridges 114 and grooves 116 in a controlled manner without buckling. The wrinkled portion 94 also maintains or improves other coil characteristics such as internal fluid pressure drop and heat transfer efficiency. Other characteristics of the bend 84 such as a reduction of the thinning of the wall on the extrados and overall stiffness of the bend 84 are also improved.

Referring to FIG. 4, the alternating ridges 114 and grooves 116 of the controlled wrinkled portion 94 provide space for the material of the tube 70 to fold itself into the smaller available arc length during bending of the tube 70. The material of the tube 70 is folded in the sinusoidal wave pattern 110 along the intrados of the bend 84. The specific variables of the sinusoidal wave pattern 110, e.g., number of peaks/valleys, depth of the valleys (amplitude of the sinusoidal wave), span of arc, etc. are calculated for a particular application as discussed below. This method can be used to calculate the variables for various combinations of material, OD, WT and CLR, and to optimize for various characteristics such as pressure drop and thermal efficiency.

The controlled wrinkled portion 94 provides advantages over conventional tube bends. For example, compared to other bends having wrinkles, the sinusoidal wave pattern 110 minimizes the stresses developed in the material of the tube 70 which allow for much higher internal fluid pressures. The ridges 114 and grooves 116, including the tapered lead-in portions 140, 142 may be sized to limit obstruction to the flow of fluid within the bend 84 and minimize internal fluid pressure drop through the bend 84. The sinusoidal wave pattern 110 increases the length of the material along the intrados 90 compared to a conventional bend having the same bend center line radius which increases the total surface area of the bend 84 and improves heat transfer efficiency by increasing fluid turbulence within the bend area. Further, the ridges 114 and grooves 116 operate as corrugated structure that stiffens the bend 84 as compared to a smooth, non-wrinkled bend. Still further, the controlled wrinkled portion 94 pushes the neutral axis of the bend 84 outward toward the extrados 92 of the bend 84 thereby reducing thinning of the material of the bend 84 along the extrados compared to a smooth, non-wrinkled bend.

Regarding FIGS. 10-13B, a process is provided for determining the geometry of the bend 84 of the serpentine circuit tube 70 to replace a bend 306 of a conventional serpentine circuit tube 300 while, at the same time, fitting within the coil envelope of the conventional serpentine circuit tube 300 and utilizing a tighter bend radius for a given wall thickness.

Figure 10:
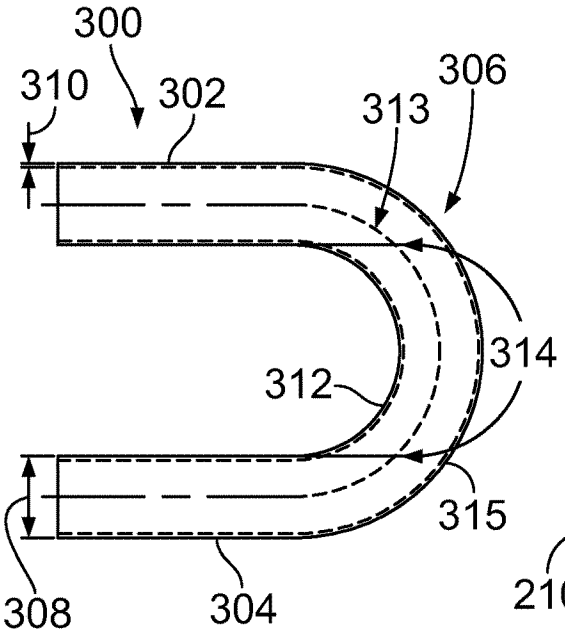

Regarding FIG. 10, the conventional serpentine circuit tube 300 has runs 302, 304, a bend 306, an outer diameter 308, a wall thickness 310. The bend 306 is a 180° bend and the bend 306 has an intrados 312 with an arc length 314 and an extrados 315. Initially and with respect to FIG. 11, the serpentine circuit tube 70 is provided with the outer diameter 210 that is the same as outer diameter 308 and a wall thickness 190 that is less than the wall thickness 310. For example, the outer diameter 308 and the outer diameter 210 may both be 1.05 inches, the wall thickness 310 may be in the range of approximately 0.04 inches to approximately 0.07 inches, such as 0.048 inches, and the wall thickness 190 may be in the range of approximately 0.02 inches to approximately 0.05 inches, such as approximately 0.03 inches to approximately 0.04 inches. The outer diameter 210 is selected to be the same as the outer diameter 308 so that the bend 84 stacks with adjacent bends 84 as would the bend 306 when stacked with adjacent bends 306. The tighter bend radius for a given thickness 190 may improve the efficiency of heat transfer between the working fluid inside of the serpentine circuit tube 70 and the fluid outside of the serpentine circuit tube 70. Further, the tighter bend radius for a given wall thickness 190 may reduce the internal fluid pressure drop in the serpentine circuit tube 70 since the inner diameter of the tube run increases.

Figure 11:
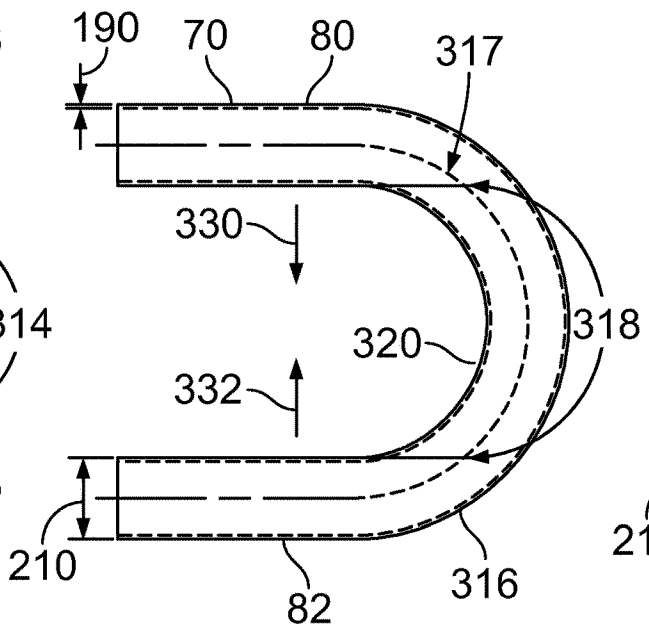

Referencing FIG. 11, the process of determining the geometry of the bend 84 includes initially setting the serpentine circuit tube 70 to have an initial bend 316 connecting the runs 80, 82. The initial bend 316 has a 180° bend angle and a center line radius 317 that is larger than a center line radius 313 of the bend 306 shown in FIG. 10. Referencing FIGS. 10 and 11, the initial bend 316 has an intrados 320 with an arc length 318 that is larger than the arc length 314 due to the center line radius 317 being greater than the center line radius 313.

Figure 12:
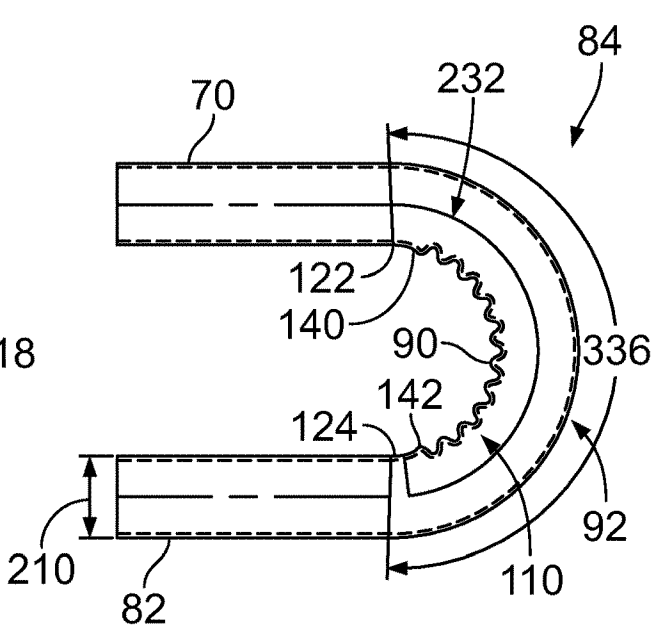
FIGS. 10, 11, 12, 13A, and 13B show a process of determining the sinusoidal pattern of the bend.

Regarding FIG. 12, in order for the bend 84 to fit within the same coil envelope as the conventional bend 306 of FIG. 10, meaning the center-to-center distance between the tube runs is equivalent, the bend 84 has the extrados 92 that matches the extrados 315 of the bend 306 and the tube 70 has the outer diameter 210 that matches the outer diameter 308. To provide the matching extrados 92, 315, the process of determining the geometry of the bend 84 includes moving the tangent points 122, 124 of the runs 70, 82 toward one another in directions 330, 332 (FIG. 11) until: 1) the bend 84 has the actual center line radius 232 equal to the center line radius 313 of the bend 306; and 2) an arc length of the intrados 90 of the bend 84 equals the intrados 312 of the bend 306.

To compensate for the reduced vertical distance between the tangent points 122, 124, the material of the serpentine circuit tube 70 at the inside of the bend 84 is shaped to have the sinusoidal wave pattern 110. The sinusoidal wave pattern 110 has variables that define the shape of the sinusoidal wave pattern 110, such as the length of the sinusoidal wave pattern 110, number of peaks/valleys, period, and/or amplitude.

Figure 13A:
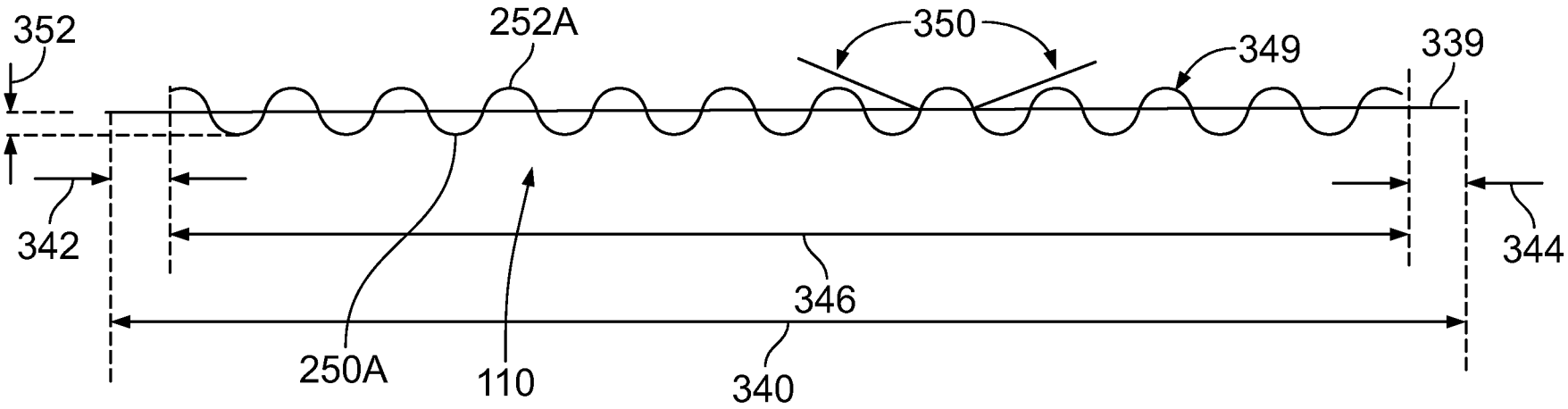

Referring now to FIG. 13A, the process of determining the geometry of the bend 84 next includes providing a line 339 having an intrados arc length 340 that matches the arc length 336 of the intrados 90 from FIG. 12. The arc length 336 of the intrados 90 extends between the transition points 122, 124 in FIG. 12.

The sinusoidal wave pattern 110 is offset from the tangent points 122, 124 of the bend 84 by two portions of the serpentine circuit tube 70. The first portion is the relief portions 222, 224 corresponding to the offset angle, such as 7° on either side of the sinusoidal wave pattern 110, and measured between angles 220, 240 (see FIG. 4). The second portion is the tapered lead-in portions 140, 142. The sinusoidal wave pattern 110 starts and ends at points 400 (see FIG. 4). To create the offset of the sinusoidal wave pattern 110 from the tangent points 122, 124, the process of determining the geometry of the bend 84 includes removing lengths 342, 344 from the length 340 to give a sinusoidal pattern length 346 that is less than the intrados arc length 340 as shown in FIG. 13A. Thus, the lengths 342, 344 each include two length portions: 1) a length portion corresponding to one of the relief portions 222, 224; and 2) a length portion corresponding one of the tapered lead-in portions 140, 142. The lengths 342, 344 are determined, for example, by solving for the length portions using the intrados radius and the angular offset.

The difference between the length 340 of the line 339 (see FIG. 13A) and the arc length 318 (see FIG. 11) is taken up by the total arc length 346 of the sinusoidal wave pattern 110. Referencing FIG. 13A, the total arc length 346 of the sinusoidal wave pattern 110 may be expressed as:

$$\text{Total arc length of sinusoidal pattern}_{346}=\text{Intrados arc length}_{340}-\text{Lengths}_{342,344} \quad \text{[Equation 1.1]}$$

Once the total arc length 346 of the sinusoidal wave pattern 110 is known, the total arc length 346 is divided by the number of peak portions 250A and valley portions 252A, such as in the range of 6 to 18 peaks and valleys, such as 8 to 12 peaks and valleys, to determine the arc length 350 for each peak portion 250A and valley portion 252A. Each peak portion 250A and valley portion 252A has a radius 349 and an arc length 350 given by:

$$\text{Arc Length}_{350}=\text{Radius}_{349}\times\theta \quad \text{[Equation 1.2]}$$

Wherein θ is the angular extent of the peak portion 250A and valley portion 252A. The radius of each peak portion 250A and valley portion 252A may be determined using the following operations.

Figure 13B:
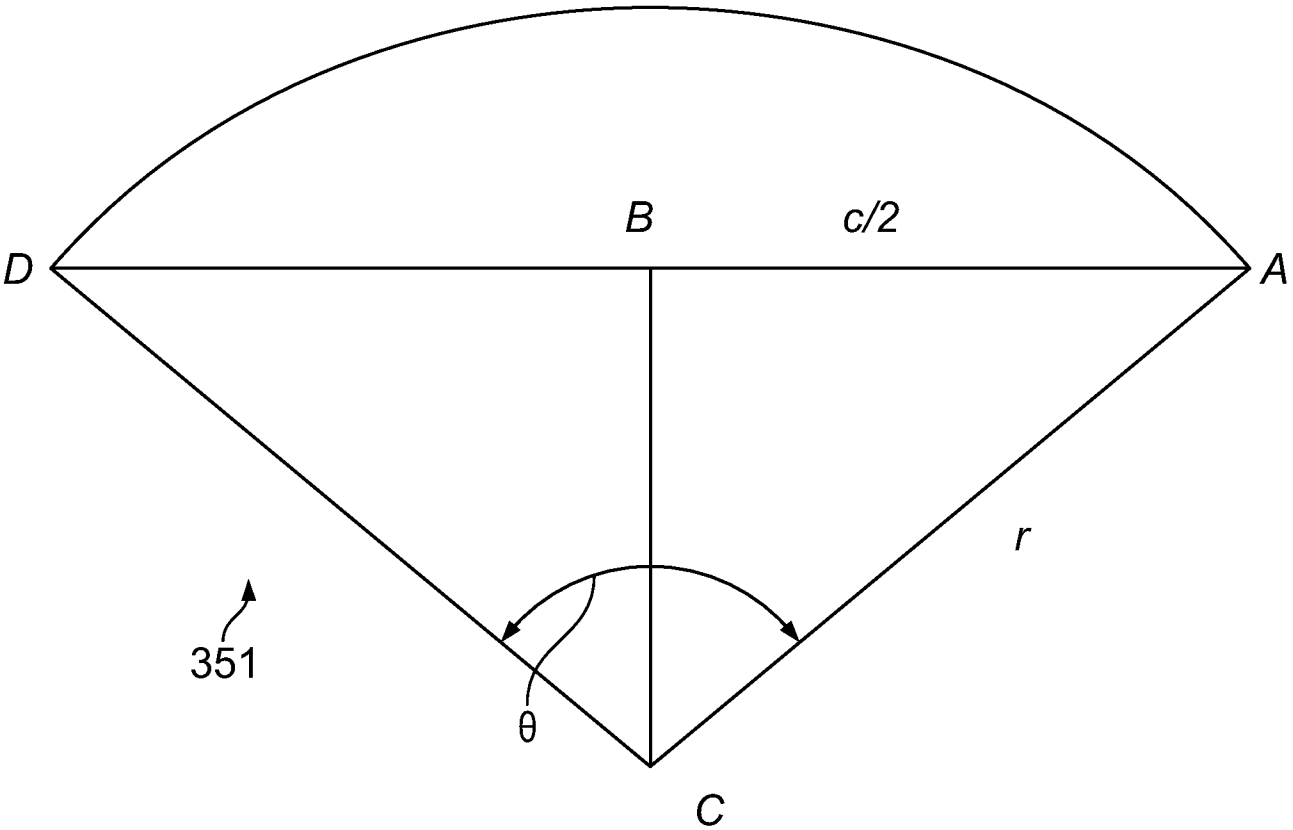

Referencing FIG. 13B, a geometric shape 351 is provided having an arcuate line AD and triangles formed by ABCD. Because the triangle ABC is a right triangle, the following equation may be recognized:

$$\sin\left(\frac{\theta}{2}\right)=\frac{AB}{CA} \quad \text{[Equation 1.3]}$$

The equation may be rearranged to be:

$$\sin\left(\frac{\theta}{2}\right)=\frac{c}{2r} \quad \text{[Equation 1.4]}$$

The relationship of a=r×θ may be substituted into equation 1.4 to result in:

$$\sin\left(\frac{\theta}{2}\right)=\frac{c\theta}{2a} \quad \text{[Equation 1.5]}$$

At this point, the "a" value is known, i.e., the total arc length 346 of the sinusoidal wave pattern 110 divided by the number of peak portions 250 and valley portions 252 (FIG. 13A). The "c" value is known (see c/2 in FIG. 13B), i.e., the length 346 divided by the number of peak portions 250 and valley portions 252 selected.

The foregoing equation may then be solved for theta using a numerical method such as Newton-Raphson iteration. Once theta has been determined, the radius of the peak portions 250A and valley portions 252A may be determined by solving for radius 349 in equation 1.2.

The radius 349 and theta permits the amplitude of the sinusoidal wave pattern 110 to be determined using the following equation:

$$\text{Amplitude}_{352}=\text{Radius}_{349}-(\text{Radius}_{349}\times\cos\theta)$$

It will be appreciated that ad-hoc adjustment to the sinusoidal wave pattern 110 may be utilized to tailor the sinusoidal wave pattern 110 for a particular application.

Regarding FIG. 12, the tapered lead-in portions 140, 142 to smooth the bending of the material of the serpentine circuit tube 70 to reduce stress risers at the transition between the reliefs 222, 224 (see FIG. 4) and the sinusoidal wave pattern 110.

Regarding FIGS. 14-18, the intersecting sinusoidal wave pattern 110 and arc pattern 150 of the controlled wrinkled portion 94 will be discussed in greater detail. The intersecting sinusoidal wave pattern 110 and arc pattern 150 provide a three-dimensional profile of the inner bend. The three-dimensional profile of the inner bend provides a corrugated structure that has a high strength to resist internal fluid pressure within the serpentine circuit tube 70. The intersecting sinusoidal wave pattern 110 and arc pattern 150 cause the bend 84 to experience low stress even when the bend 84 is under a high internal pressure.

Figure 14:
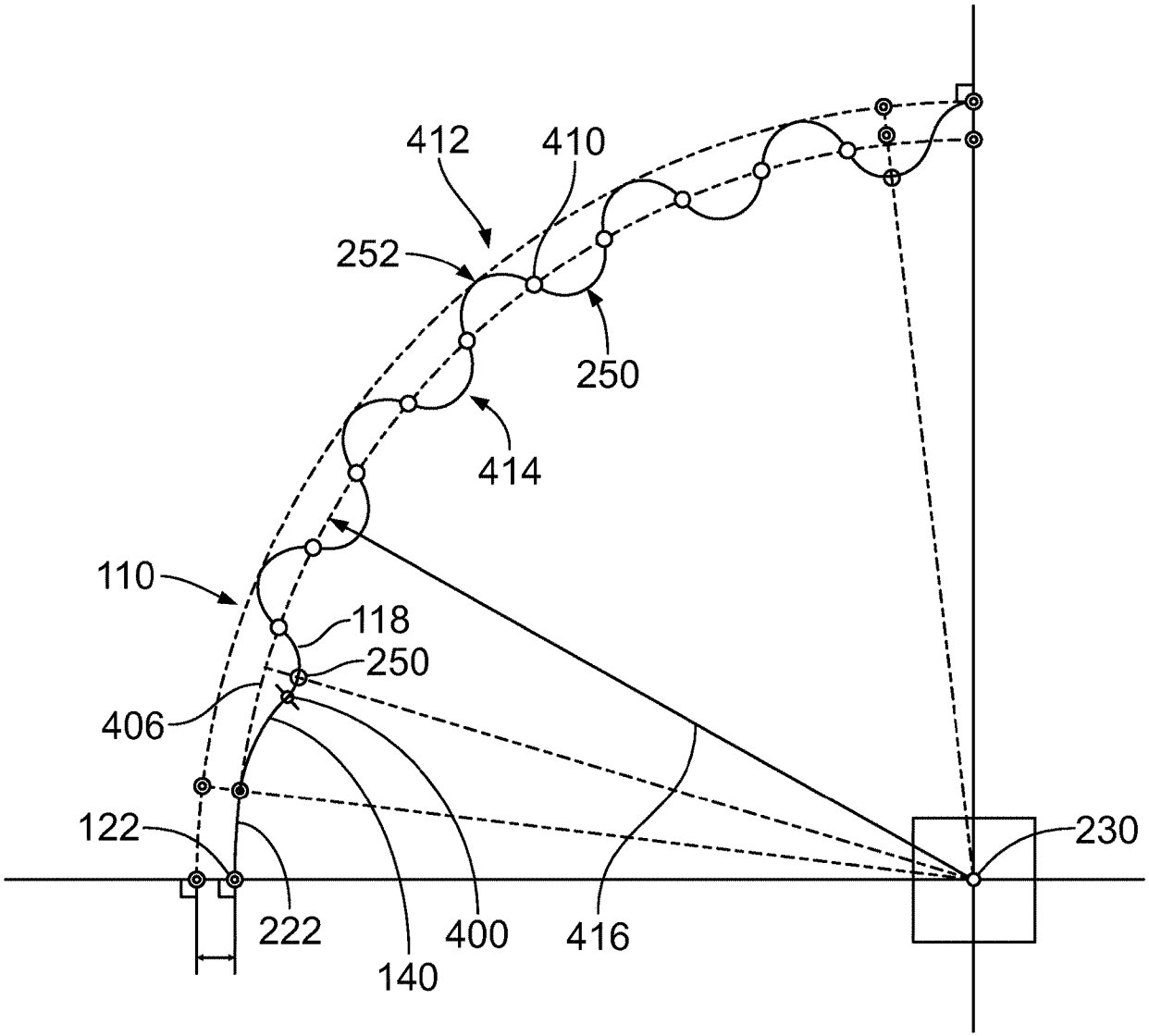
FIG. 14 is a graphical representation of a portion of the sinusoidal pattern of the wrinkled portion of the return bend showing peaks and valleys of the sinusoidal pattern.

Referencing FIG. 14, one half of the sinusoidal wave pattern 110 will be discussed, with the other half of the sinusoidal wave pattern 110 being identical in the embodiment of FIG. 9A. The sinusoidal wave pattern 110 begins at point 400 and is spaced from the tangent point 122 by the relief 222 and the tapered lead-in portion 140. The tapered lead-in portion 140 ramps gradually upward toward the point 400 proximate a peak 250 of the end ridge 118. The sinusoidal wave pattern 110 oscillates about the center line 406, which intersects the sinusoidal wave pattern 110 at transitions 410 between concave portions 412 and convex portions 414 (when viewed from the center 230). In the embodiment of FIG. 14, the centerline 406 of the sinusoidal wave pattern 110 is located on the intrados 90 of the bend 84 (see FIG. 12). In another embodiment, the valleys 252 of the sinusoidal wave pattern 110 are on the intrados 90 of the bend 84 such that the intrados 90 is tangent to the grooves 116. In yet another embodiment, the peaks 250 of the sinusoidal wave pattern 110 are on the intrados 90 of the bend 84 such that the intrados 90 is tangent to the ridges 114.

In reference to FIG. 14, the centerline 406 of the sinusoidal wave pattern 110 has a radius 416. In one embodiment, the bend 84 has a centerline radius 232 (see FIG. 12) in the range of approximately 1.5 inches to approximately 2 inches, such as in the range of 1.7 inches to approximately 2 inches, such as 1.875 inches. The centerline 406 may have a radius in the range of approximately 1 inch to approximately 1.5 inches, such as in the range of approximately 1.3 inches to approximately 1.4 inches, such as 1.35 inches.

Regarding FIG. 15, the arc pattern 150 includes the peak arc 152 that intersects the sinusoidal wave pattern 110 at each peak 250, and a valley arc 154 that intersects the sinusoidal wave pattern 110 at each valley 252. The peak arc 152 and valley arc 154 are separated about the bend 84 by an angle 420 that may be in the range of, for example, approximately 4° to approximately 14°.

Regarding FIG. 16A, the peak arc 152 has the center 182 of the peak arc 152 radially inward from the tube center line 102 of the bend 84. The center 182 is positioned along a midline plane 424 of the serpentine circuit tube 70. The peak arc 152 extends through an angle 160 that may be in the range of, for example, 150° to approximately 170°, such as 160°.The peak arc 152 has an arc length 427 that extends from end point 426 to end point 430 of the peak arc 152.

Regarding FIG. 17A, the valley arc 154 has the center 172 thereof radially outward from the center line 102 of the serpentine circuit tube 70. The valley arc 154 extends through an angle 162 that is less than the angle 160 in FIG. 16A. In one embodiment, the angle 162 is in the range of approximately 100° to approximately 150°, such as 140°.

The valley arc 154 has an arc length 432 between end points 434, 436 of the valley arc 154 that is less than the arc length 427 of the peak arc 152.

Figure 18:
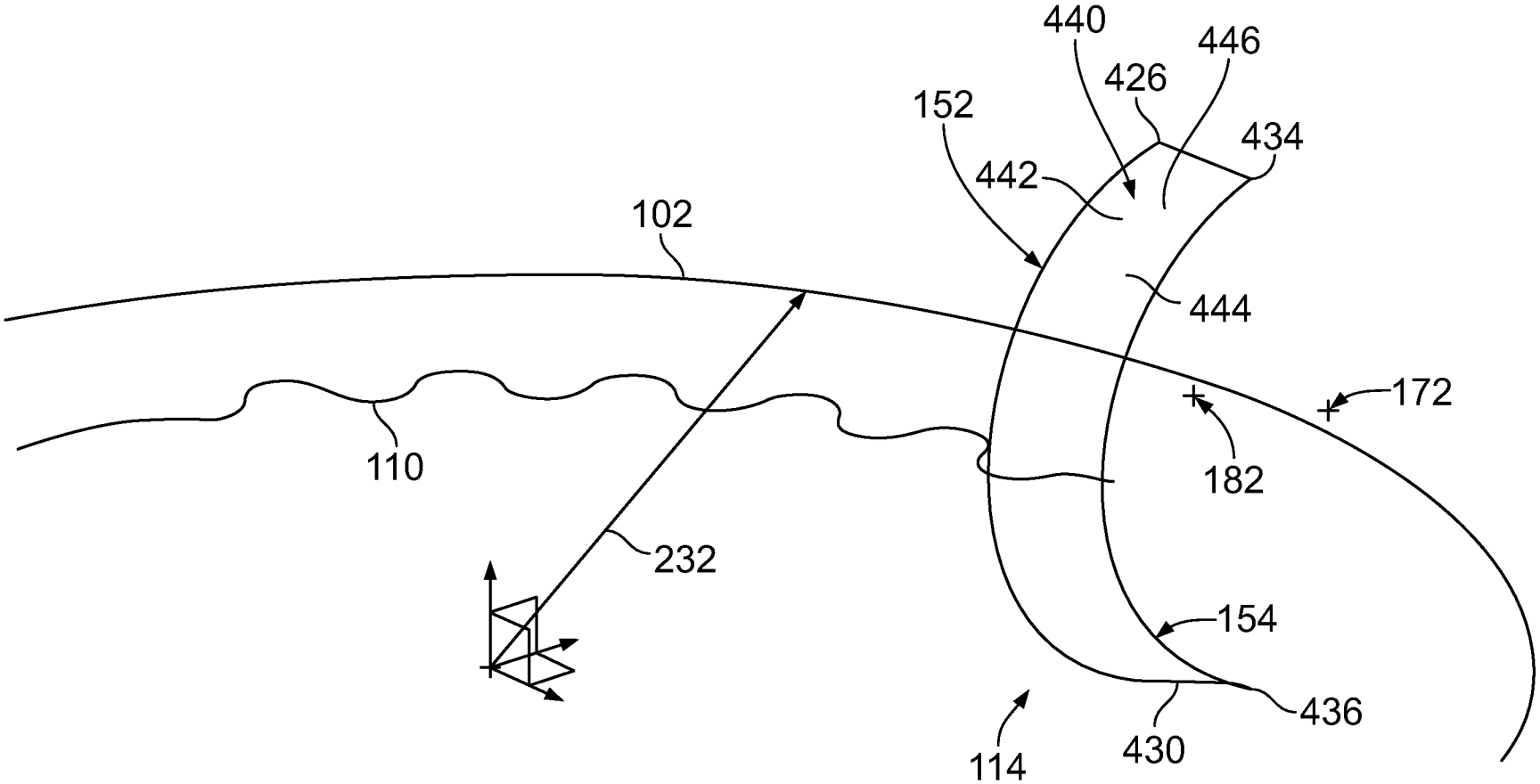
FIG. 18 is a perspective view showing a portion of the sinusoidal pattern, the peak arc, and the valley arc of FIG. 15 and a continuous, curved wrinkled surface portion connecting the peak arc and the valley arc.

Regarding FIG. 18, the continuously curving controlled wrinkled surface 134 (as shown in FIG. 8) of the controlled wrinkled portion 94 may be formed at least a part by connecting the peak arc 152 and the valley arc 154 with a surface portion 440 having a convex surface portion 442, a concave surface portion 444, and a transition 446 that transitions between the convex and concave surface portions 442, 444. The surface portion 440 may be mirrored across a vertical plane that contains peak arc 152 to the opposite side of the ridge 114.

In one embodiment, the continuously curving wrinkled surface 134 is perpendicular to a vertical plane that contains the peak arc 152, as well as a vertical plane that contains the valley arc 154. Referencing FIG. 15, the vertical plane that contains peak arc 152 is defined as being perpendicular to the horizontal plane 424 (see FIG. 8), and contains the origin or center 230 and peak point 250. The vertical plane that contains valley arc 154 is defined as being perpendicular to the horizontal plane 424 and contains the center 230 and valley 252. The vertical planes that contain the peak and valley arcs 152, 154 are separated by angle 420. Regarding FIG. 18, the concave surface portions 442 and convex surface portions 444 connect the peak and valley arcs 152, 154 and provide the undulating three-dimensional profile of the continuously curving controlled wrinkled surface 134 (FIG. 8). Each concave and convex surface portion 442, 444 terminates at two, four pole splines, one of which starts at peak arc end point 426 (FIG. 16A) and ends at valley arc end point 434 (FIG. 17A), while the other four pole spline starts at peak arc end point 430 (FIG. 16A) and ends at valley arc end point 436 (FIG. 17A).

Figure 19:
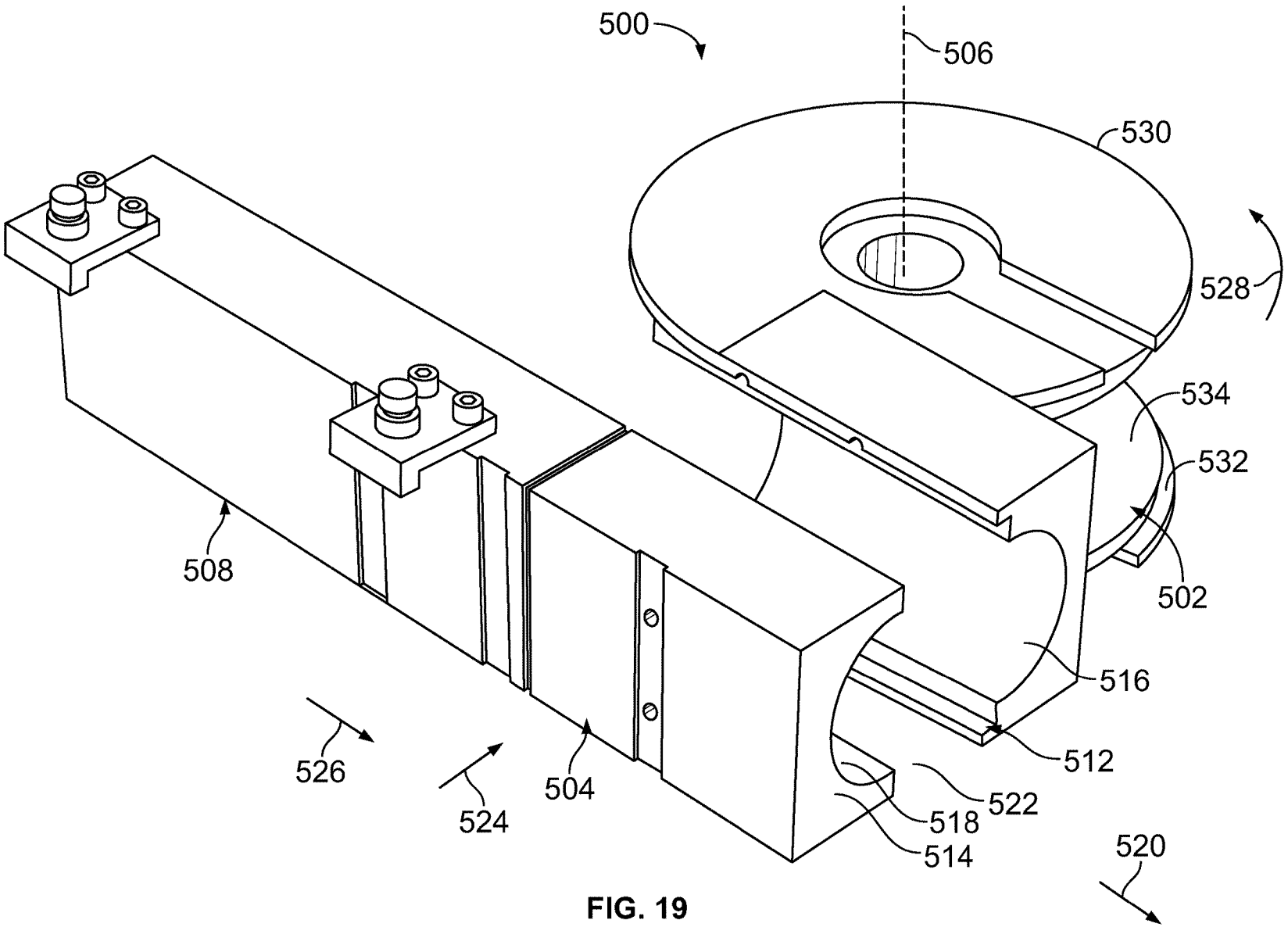
FIG. 19 is a perspective view of a tube bender showing a bend die, a pressure die, and a clamp die of the tube bender.
Figure 20:
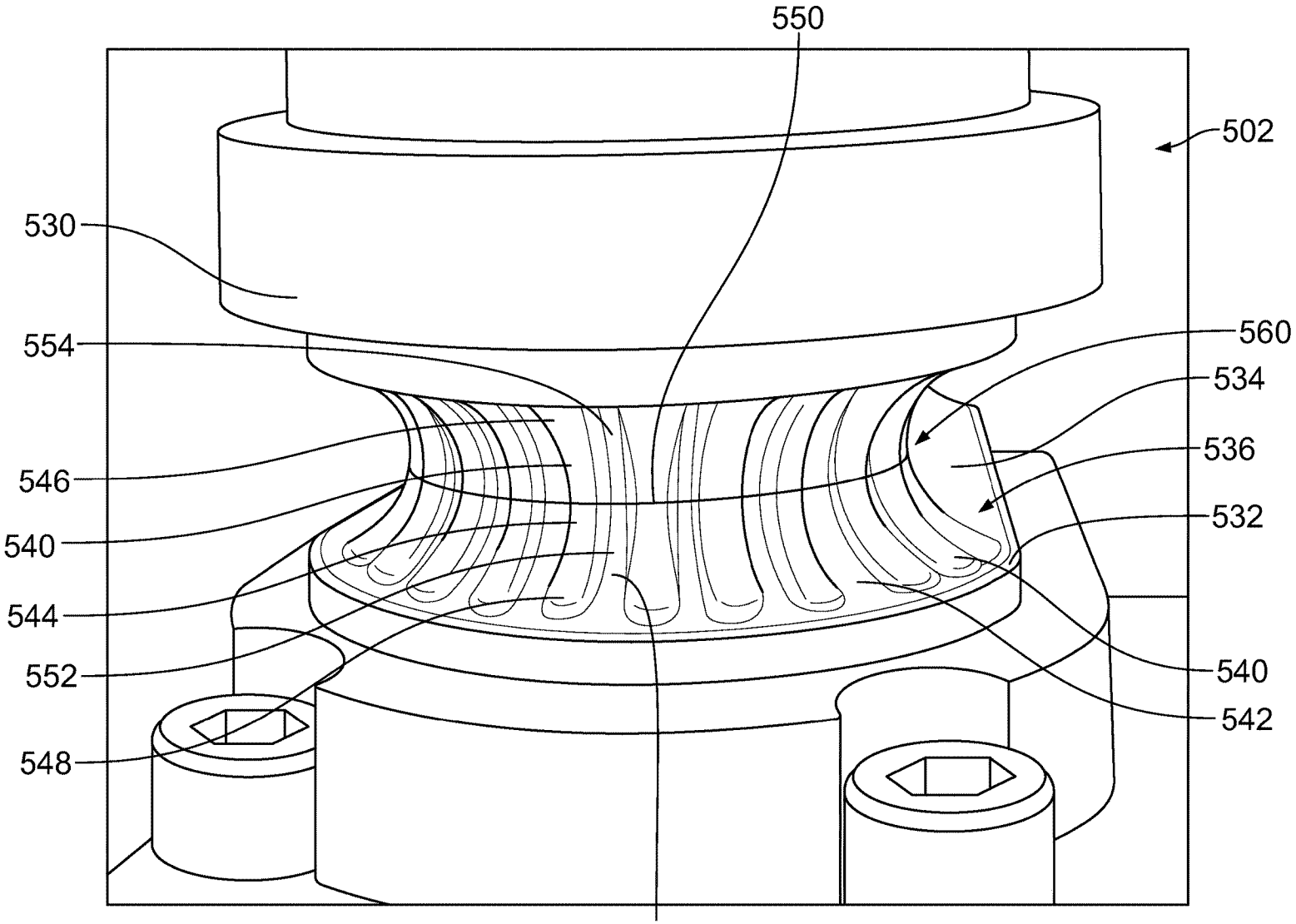
FIG. 20 is a side elevational view of the bending die of FIG. 19 showing ridges and grooves that form corresponding ridges and grooves of the wrinkled portion of the tube.

Regarding FIGS. 19 and 20, a tube bender 500 is provided to bend a segment of the serpentine circuit tube 70 into the bend 84 discussed above. The tube bender 500 includes a bend die 502 and a clamp die 504 that is pivotal about an axis 506. The tube bender 500 includes a pressure die 508 for supporting an outside of the bend 84 and a trailing portion of the serpentine circuit tube 70. The bend die 502 and the clamp die 504 include recesses 512, 514 with surfaces 516, 518 extending thereabout that clamp onto a tube once the tube has been advanced in direction 520 onto a gap 522 between the bend die 502 and the clamp die 504. The clamp die 504 and the pressure die 508 may be actuated in direction 524 to secure a portion of the tube between the clamp die 504 and the bend die 502. The pressure die 508 includes a recess that receives a portion of the tube and may be shifted in direction 526 along with movement of the tube upon the bend die 502 and clamp die 504 being pivoted about the axis 506 in direction 528 to support the outside of the tube during the bending operation.

Regarding FIGS. 19 and 20, the bend die 502 includes an upper part 530, a lower part 532, and a recess 534 that receives a portion of the tube therein as the bend die 502 and clamp die 504 are pivoted in direction 528. The bend die 502 has a wrinkled portion 536 that is the mirror image of the wrinkled portion 94 of the tube so that the bend die 502 imparts the wrinkled pattern 94 into the tube. For example, the wrinkled portion 536 includes ridges 540 that form the grooves 116 (FIG. 8) and grooves 542 that form the ridges 114 (FIG. 8).

Referencing FIG. 20, the ridges 540 each have an intermediate portion 544 and opposite end portions 546. The intermediate portion 544 may have a first width about the bend die 502 and the ends 546, 548 have widths around the bend die 502 that are larger than the width of the intermediate portion 544 such that the ridges 540 flare outwardly as they extend away from a midline 550 of the bend die 502. The grooves 542 may correspondingly have an intermediate portion 552 and opposite end portions 554, 556 that are narrower around the bend die 502 than the intermediate portion 552 due to the increasing width of the ridges 540 as the ridges 540 extend away from the midline 550. The ridges 540 and the grooves 542 have undulating and continuous curved surfaces 560 such that the wrinkled portion 536 forms the continuous wrinkled surface 134 of the tube.

Regarding FIGS. 21-25, a method of forming the bend 84 using the tube bender 500 is provided. The tube bender 500 shown in FIGS. 21-25 has similar components as the tube bend 500 shown in FIG. 19 but with a different orientation of the components. Similar reference numbers will be used to describe the tube benders of FIGS. 20 and 21-25 for ease of discussion.

Figure 21:
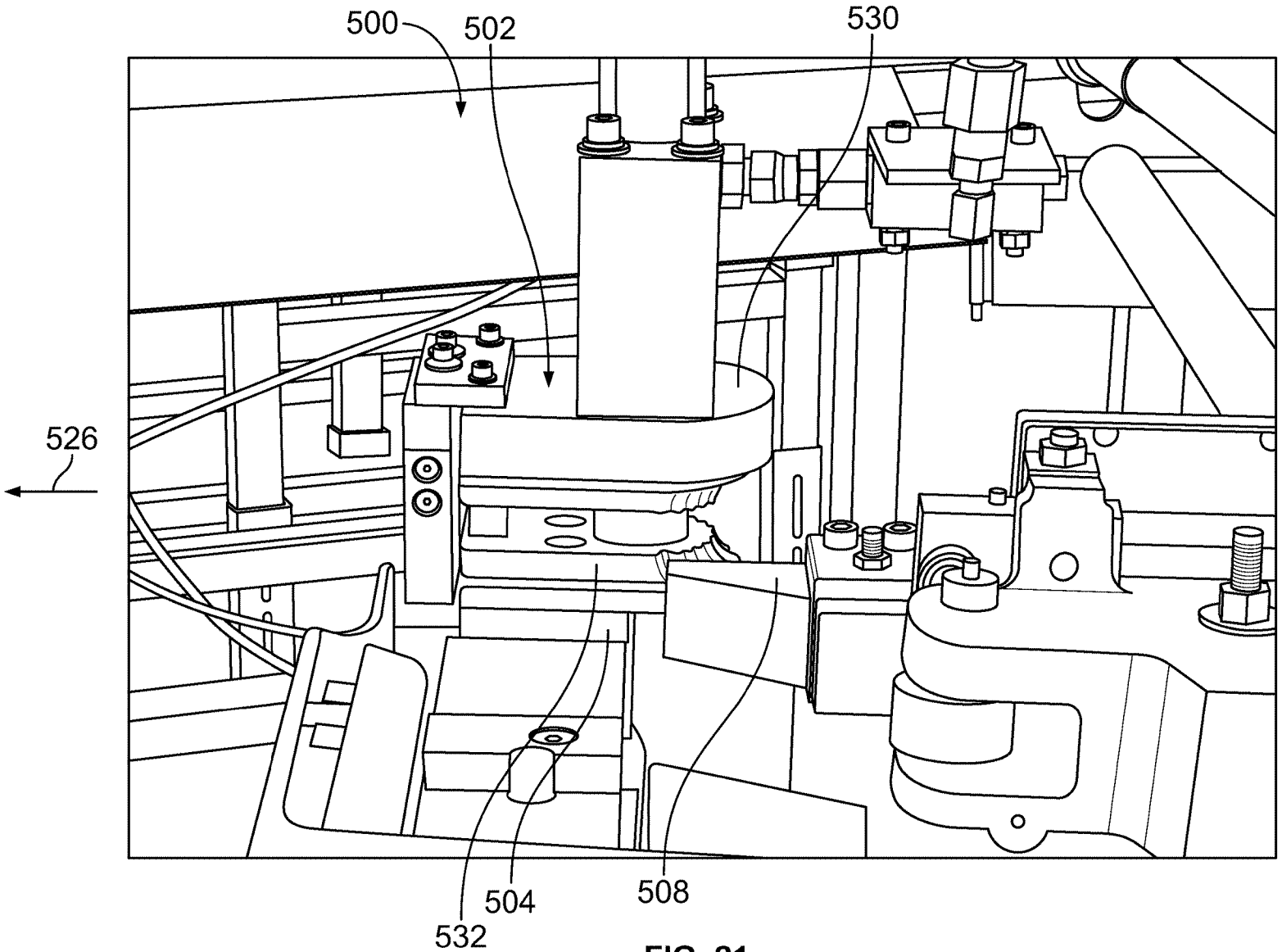
FIGS. 21, 22, 23, 24, 25, and 26 show a process of forming a bend of a serpentine circuit tube using the tube bender of FIG. 19.
Figure 22:
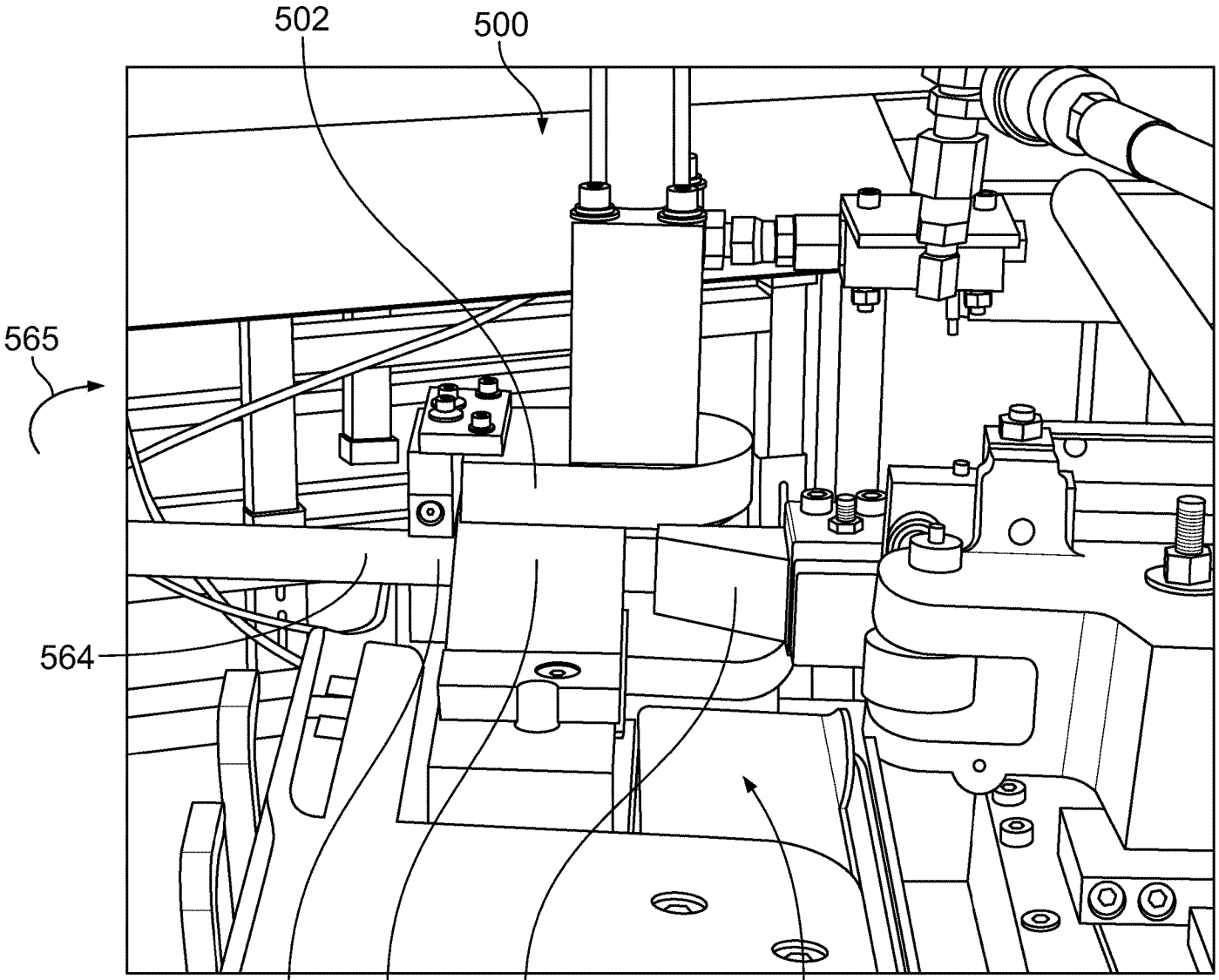

Regarding FIGS. 21 and 22, a tube 564 is advanced into the tube bender 500 so that the pressure die 508 supports an outer surface of the tube 564. In FIG. 22, the bend die 502 and clamp die 504 engage a portion 505 the tube 564 and begin to pivot in direction 565 into the page of FIG. 22.

Figure 23:
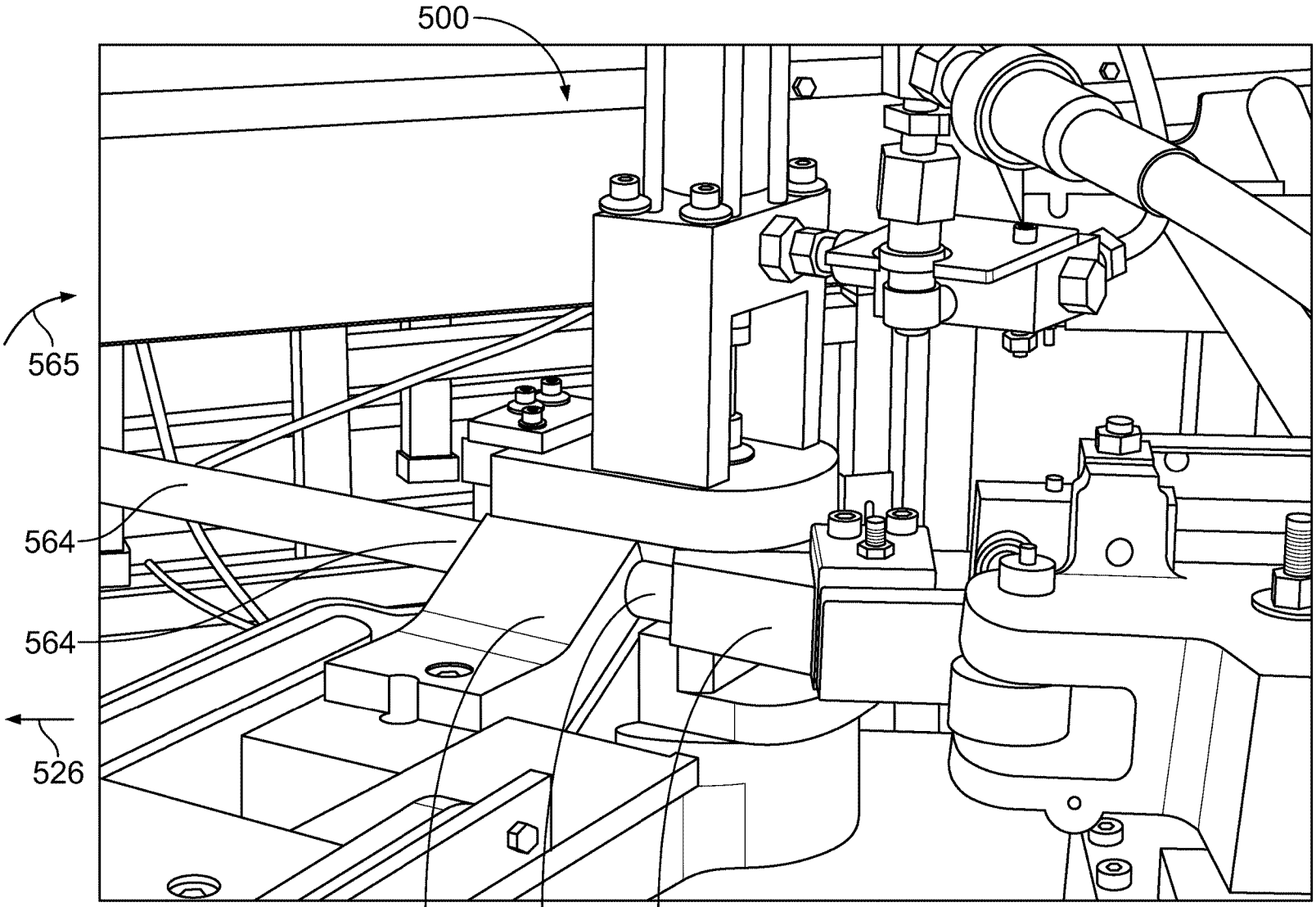
Figure 24:
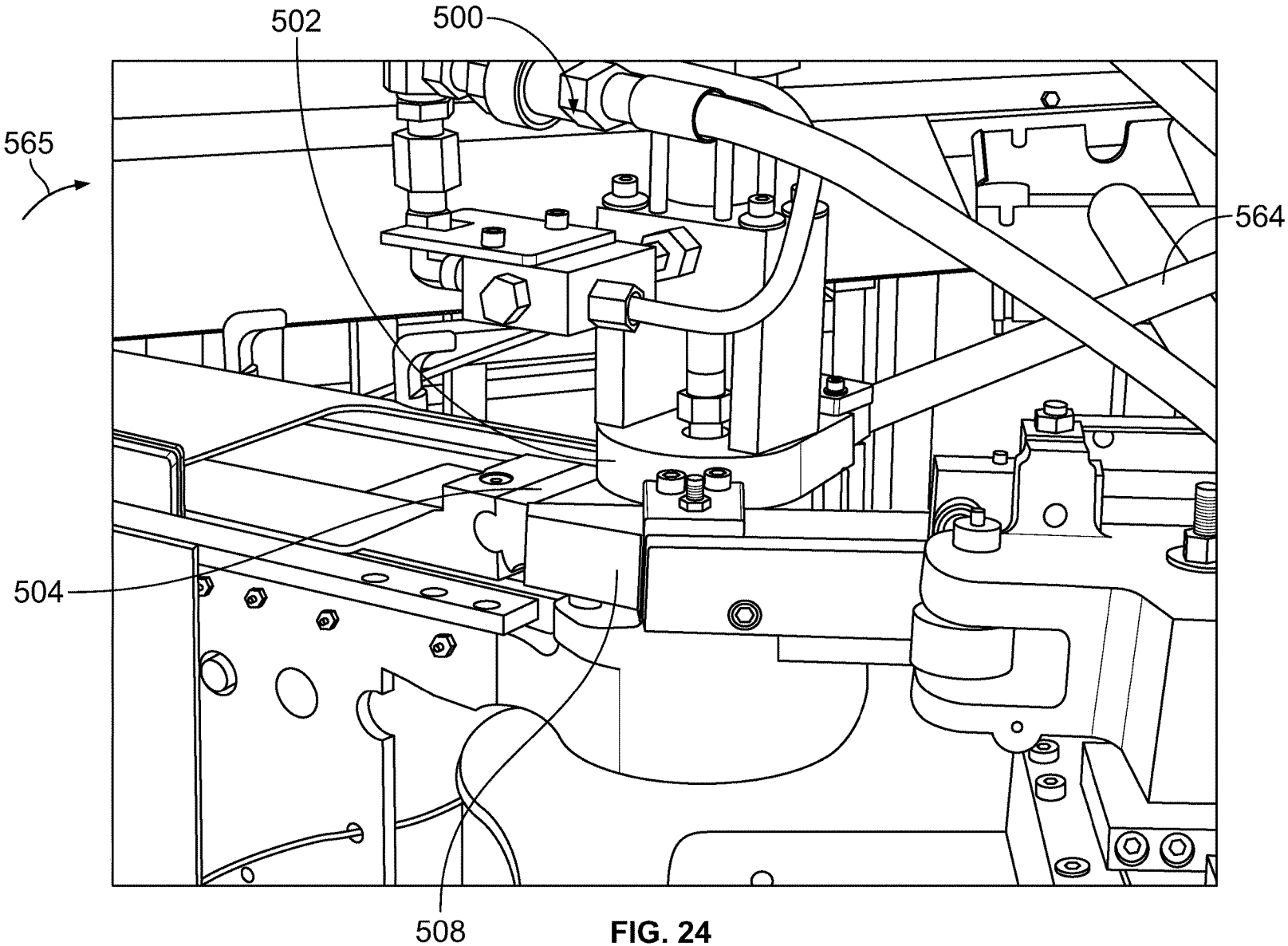

Regarding FIGS. 23 and 24, the bend die 502 and clamp die 504 are pivoted in direction 565 to begin forming the bend 570 in the tube 564. The pressure die 508 continues to support the outside of the tube 506 and is shifted in direction 526 to move with the tube 564 during the bending operation.

Figure 25:
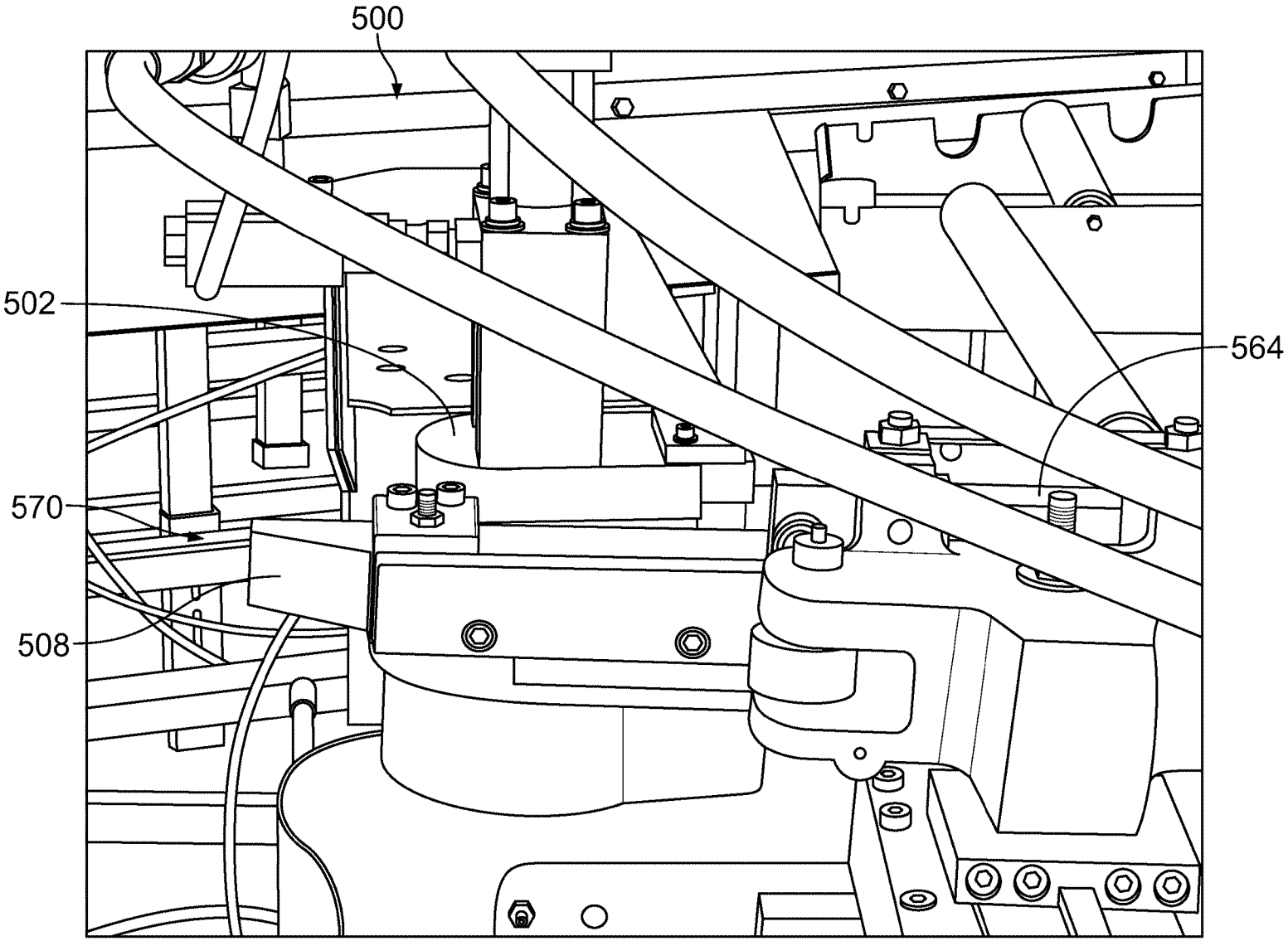

Regarding FIG. 25, the tube bender 500 has formed the bend 570 by bending the tube 564 180 degrees.

Figure 26:
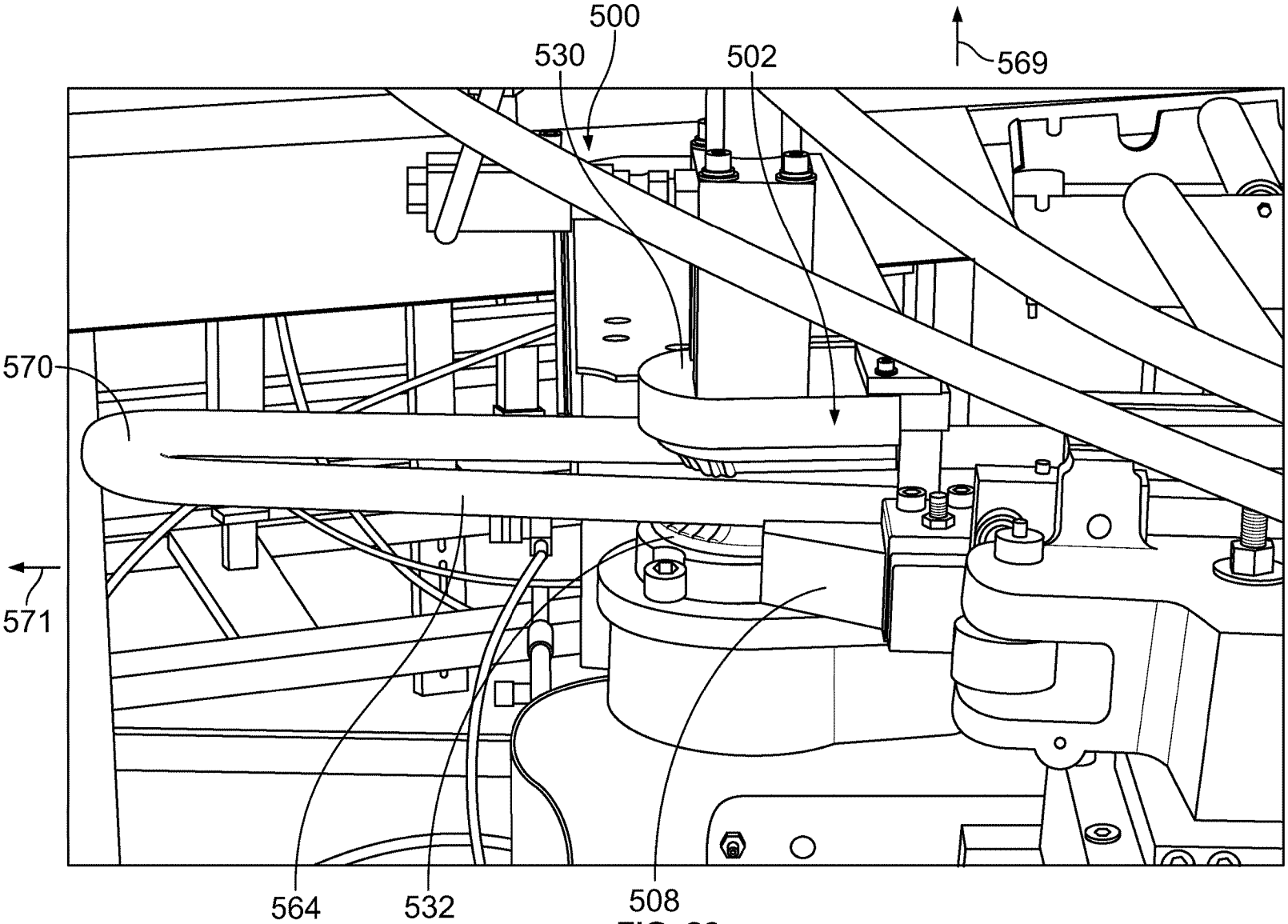

FIG. 26 shows the upper part 530 of the bend die 502 shifted upward in direction 569 from the lower part 532, the clamp die 504 shifted away from the tube 564 (into the page), and the pressure die 508 is retracted from the tube 564. The tube 564 is then shifted in direction 571 to position the next bend location along the tube 564 in the tube bender 500.

Figure 27:
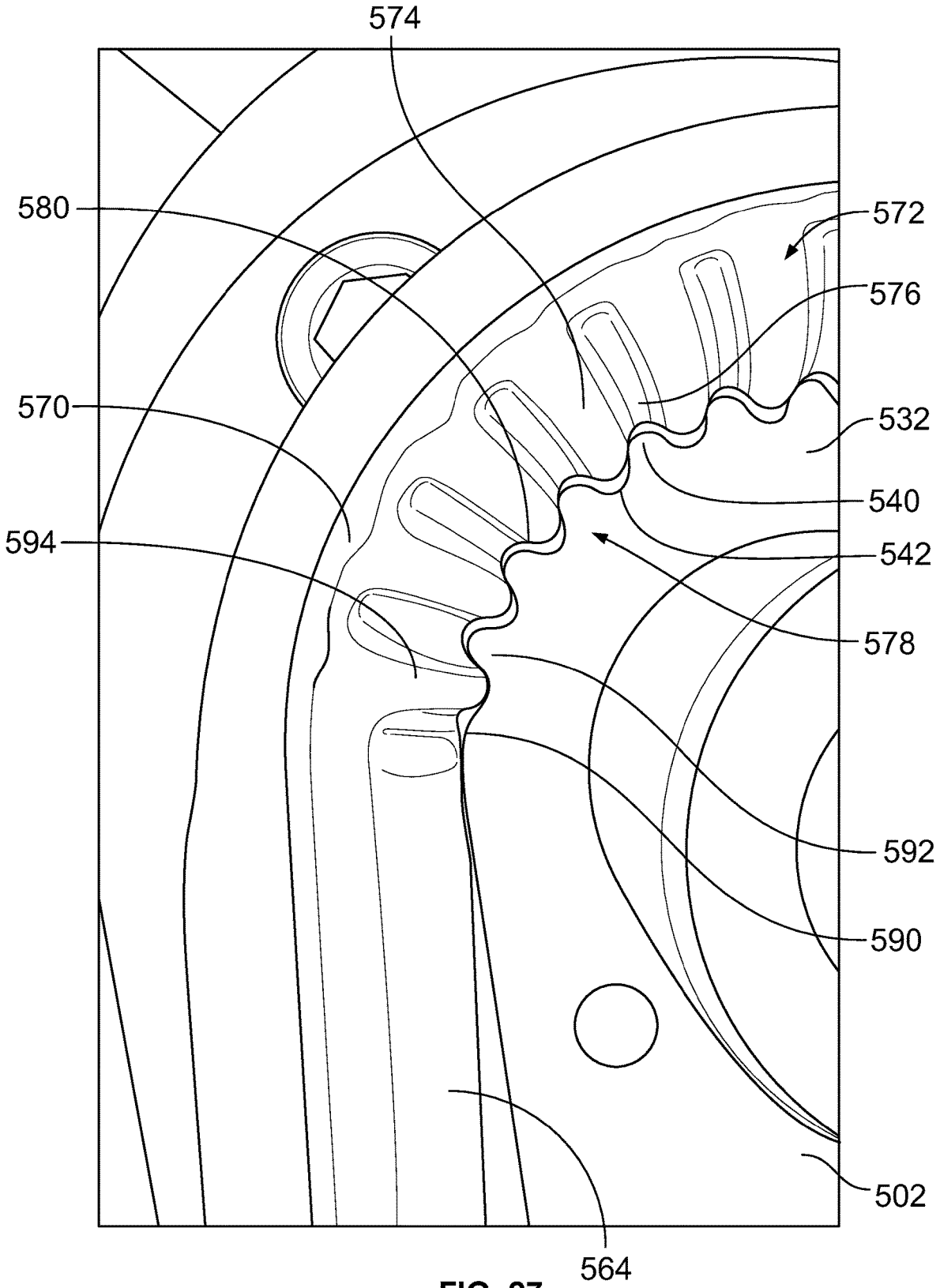
FIG. 27 is a top plan view of the tube bent using the tube bender of FIG. 19 and the lower part of the bending die that shows the meshed engagement between the ridges of the bend wrinkled portion and the ridges of the bend die.

Regarding FIG. 27, the bend 570 is shown having the wrinkled portion 572 including ridges 574 and grooves 576 formed in the inside of the bend 570. FIG. 27 also shows how the lower part 532 have a sinusoidal pattern 578 at the midline 550 (see FIG. 20) of bend die 502 that imparts a sinusoidal wave pattern 580 to the inside of the bend 570. More specifically, the lower part 532 has the lower portions of the ridges 540 that form the grooves 576 in the bend 570 and the lower part 532 has the lower portions of the grooves 542 that receive the ridges 574 of the bend 570. In this manner, the ridges 574 of the tube 564 and the ridges 540 of the bend die 502 form a tightly meshed configuration. Further, the ridges 540 and grooves 542 with the undulating, continuous surface thereon supports the inside of the tube. The upper part 530 (FIG. 26) of the bend die 502 forms a corresponding meshed engagement with the upper portion of the bend 570.

Regarding FIG. 20, the wrinkled portion 536 of the bend die 502 includes, now referring to FIG. 27, a tapered transition portion 590 and an end ridge 592 that cooperate to form an end ridge 594 of the bend 570. The tapered transition portion 590 provides a smooth lead-in to a peak of the end ridge 594 as discussed above with respect to FIG. 9A.

Figure 29:
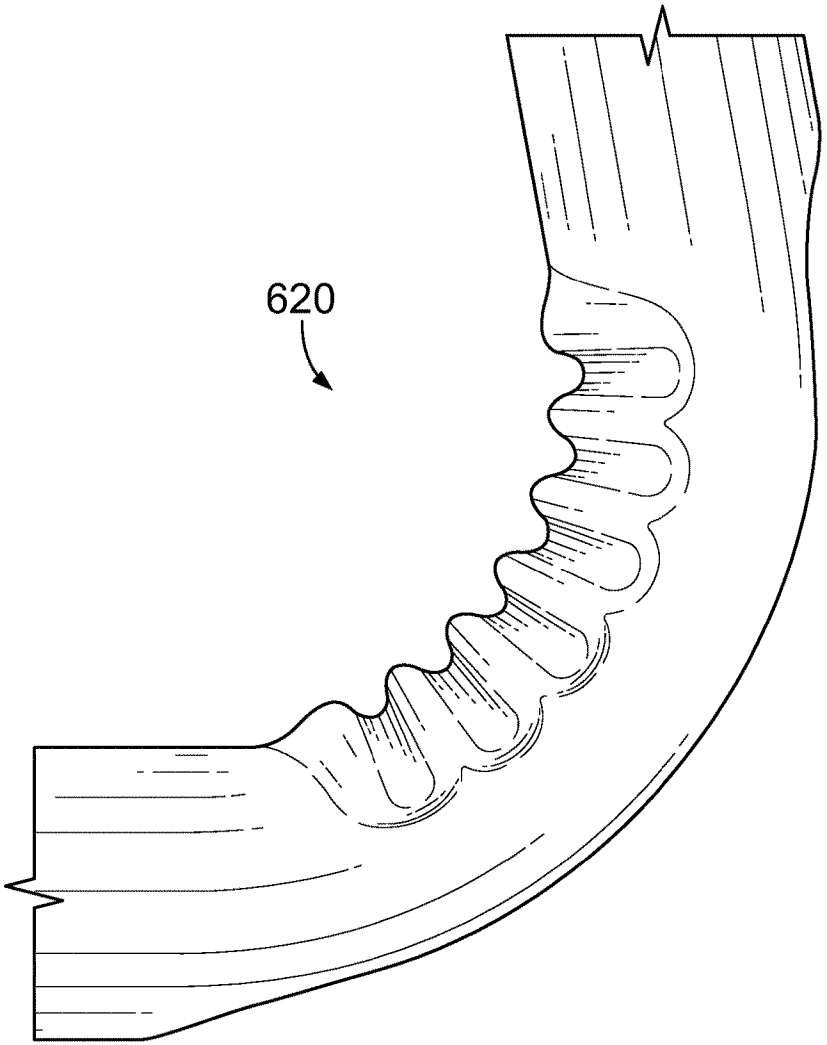
FIGS. 28, 29, and 30 are elevational views of bends having, respectively, ninety degree, eighty degree, and one-hundred degree bend angles.
Figure 28:
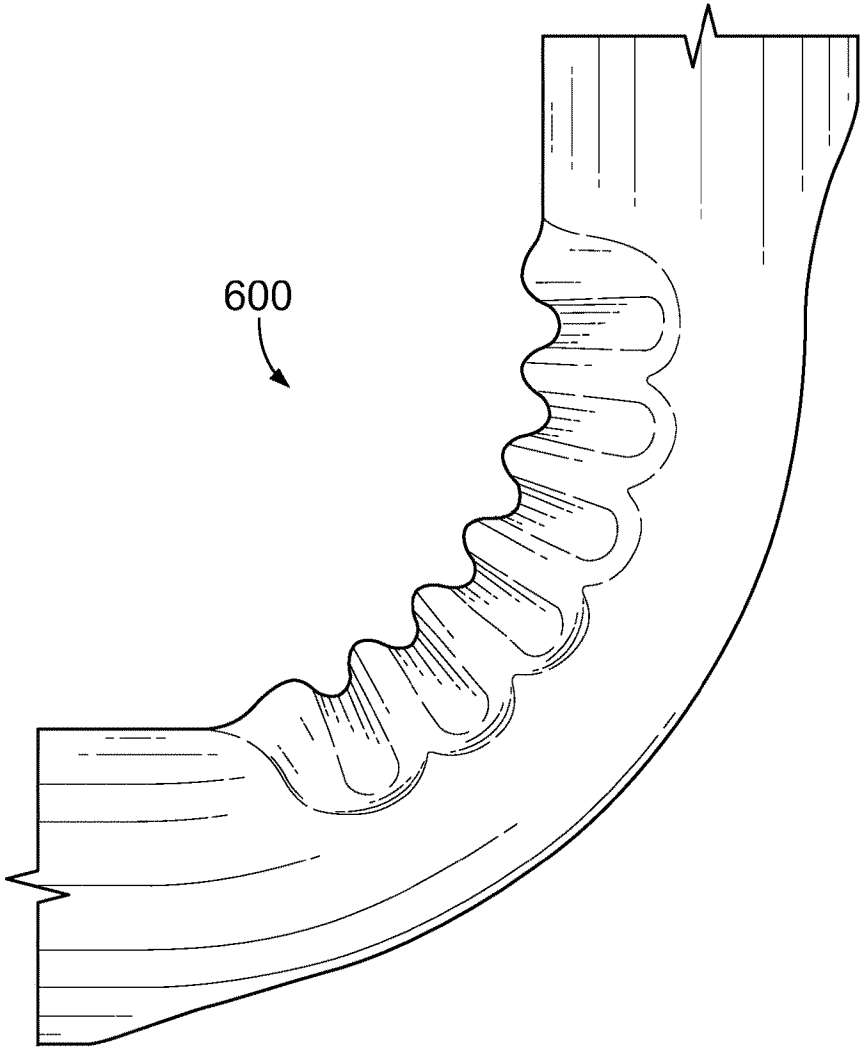
Figure 30:
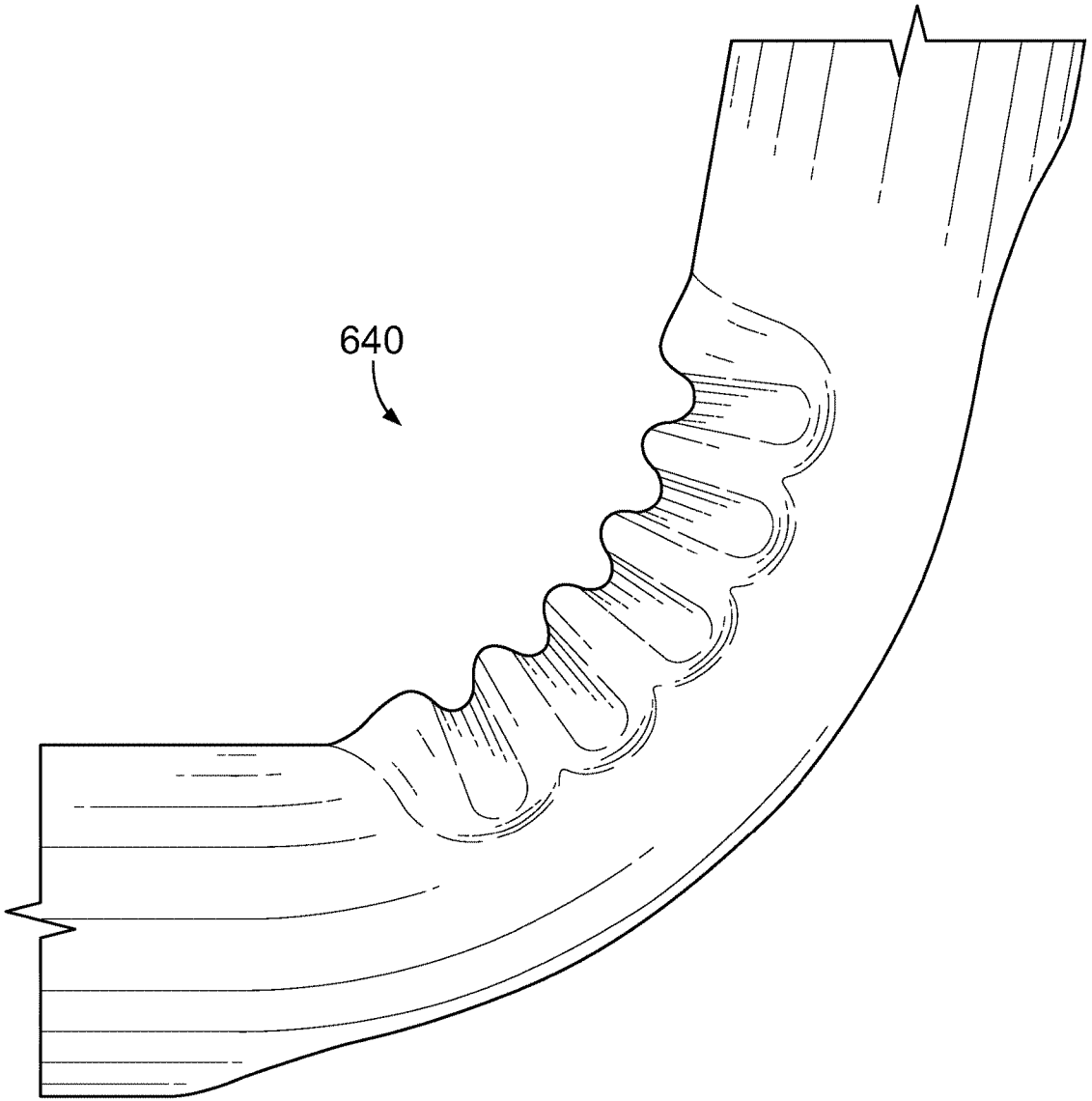

Various types of bends may be provided in accordance with the disclosure here. For example, FIG. 28 shows a 90 degree bend 600, FIG. 29 shows an eighty degree bend 620, and FIG. 30 shows a one-hundred degree bend 640.

Figure 31:
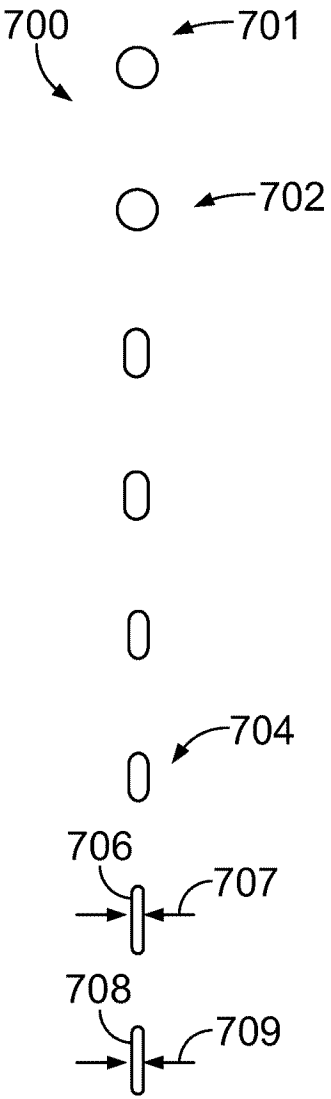
FIG. 31 is a cross-sectional view of a serpentine circuit coil having runs with progressively flattening cross-sections.

Regarding FIG. 31, a cross-sectional view of a serpentine circuit tube 700 is provided that is taken normal to the length of the serpentine circuit tube 700. The serpentine circuit tube 700 similar to serpentine circuit tube 70 and includes runs 701. The runs 701 include runs 702 having a circular cross-section and runs 704 having a non-circular cross-section, such as elliptical or obround. The runs 701 have cross-sections that progressively flatten with the run 706 having a width 707 that is wider than a width 709 of the run 708.

Figure 32:
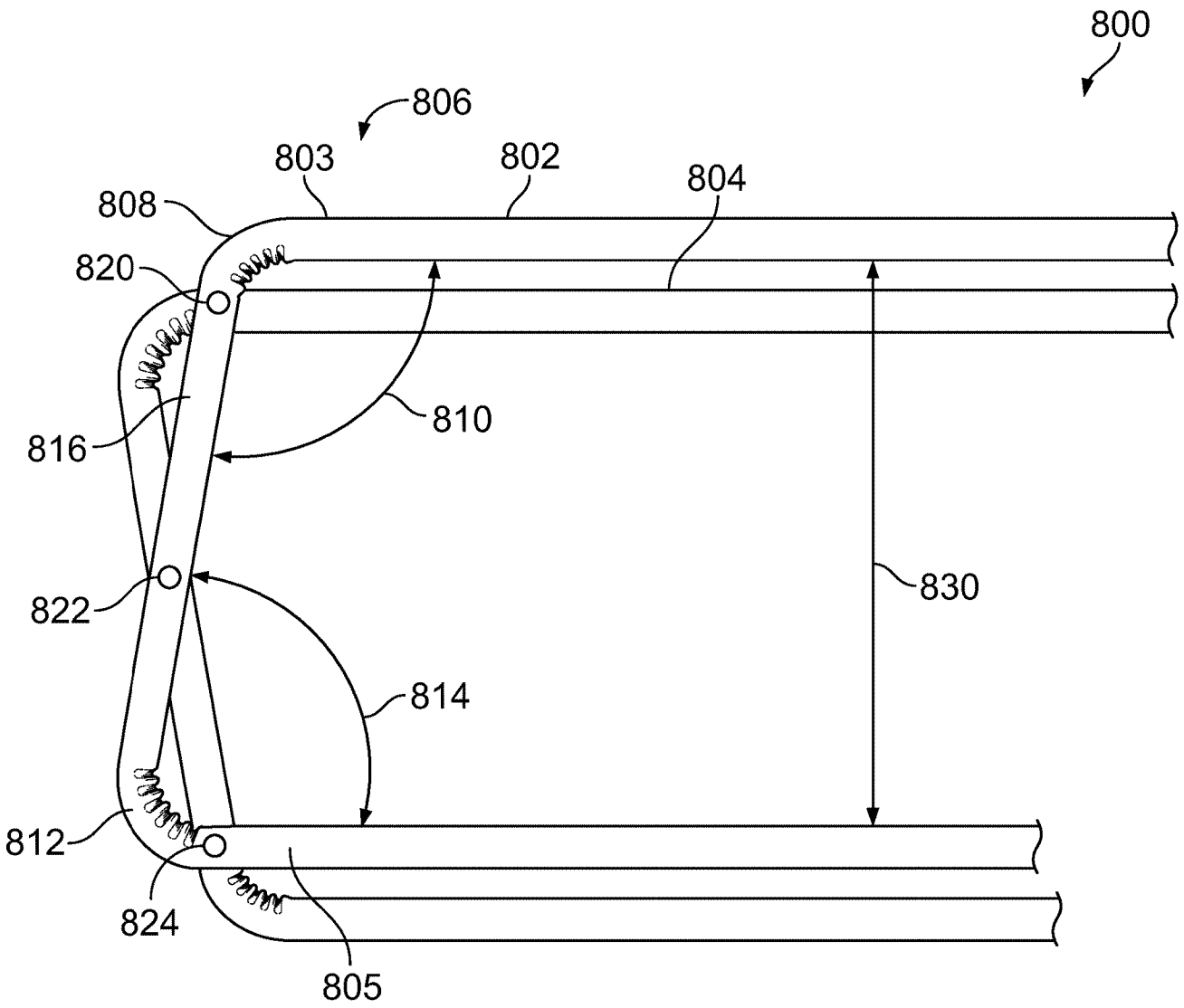
FIG. 32 is an elevational view of compound bends of a pair of serpentine circuit tubes with three points of contact therebetween, each compound bend including a bend of 80 degrees and a bend of 100 degrees.

Regarding FIG. 32, a coil 800 including assembled serpentine circuit tubes 802, 804 is provided. Each serpentine circuit tube 802, 804 includes runs 803, 805, a compound bend 806 including first bend 808 having an first bend angle 810 of 80 degrees, a second bend 812 having a second bend angle 814 of 100 degrees, and a connecting portion 816 connecting the first and second bends 808, 812. The first and second bends 808, 812 have inner controlled wrinkled portions that are similar to the controlled wrinkled portions of the bends discussed above. The serpentine circuit tubes 802, 804 have three contact points 820, 822, 824. Each serpentine circuit tube 802, 804 has a height or distance 830 between the runs 803, 805. The serpentine circuit tubes 802 of coil 800 contact one another. In other embodiments, the coil may include serpentine circuit tubes that do not contact one another.

Figure 33:
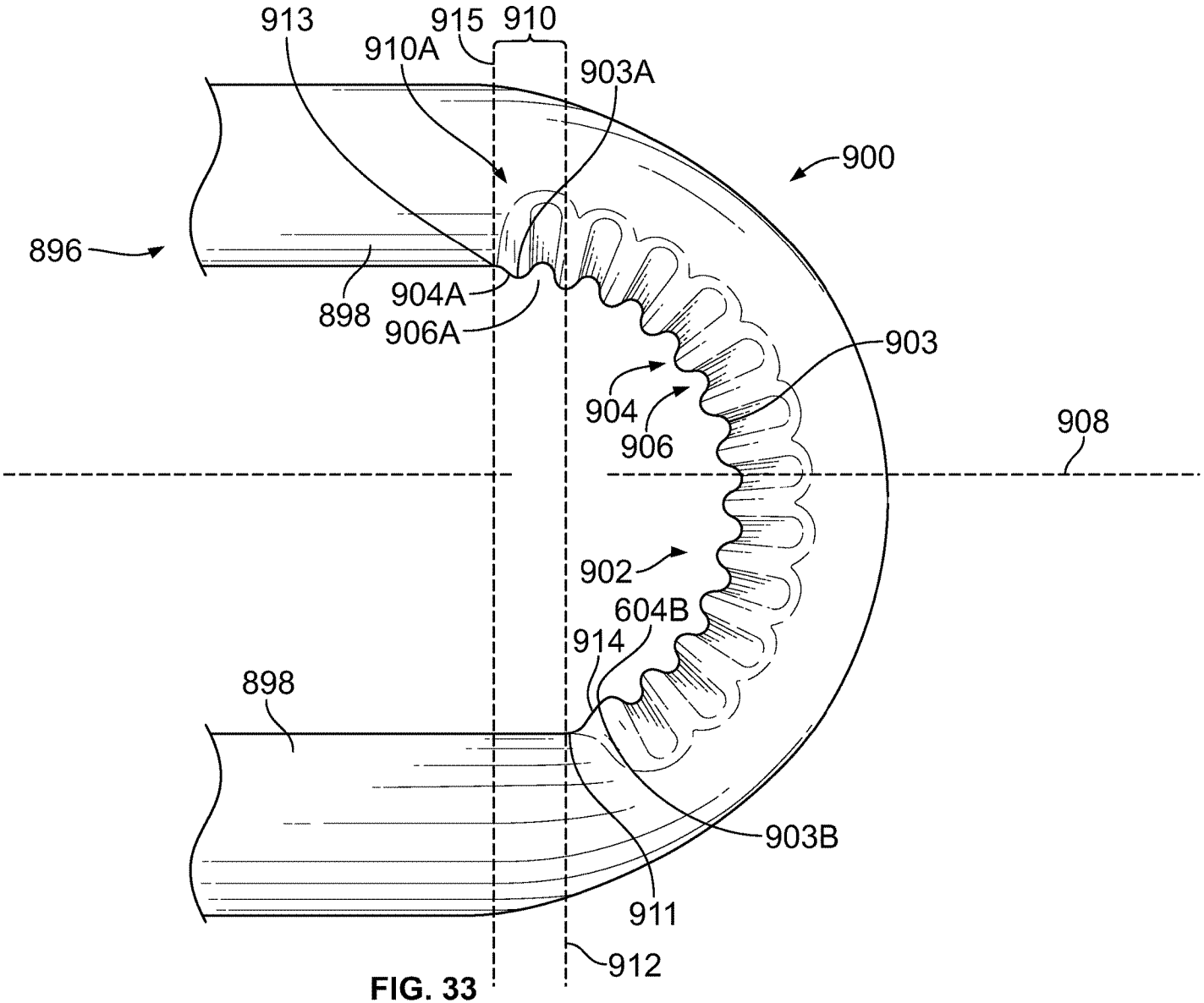
FIG. 33 is an elevational view of a bend having an asymmetrical wrinkle pattern.

With reference to FIG. 33, a portion of a tube 896 is shown that includes straights 898 and a bend 900. The bend 900 is provided that is similar in many respects to the bends discussed above. The bend 900 includes a wrinkled portion 902 having ridges 904 and grooves 906. The wrinkled portion 902 includes a sinusoidal pattern 903 along an intrados of the bend 900 that starts and ends at points 903A, 903B. The tube 896 has tangent points 911, 913 at transitions between the straights 898 and the bend 900.

The wrinkled portion 902 is asymmetrical about a plane 908 that bisects the bend 900. Axes 915, 912 extend perpendicular to the plane 908 and intersect, respectively, the tangent points 913, 911. The tangent points 911, 913 are offset along the plane 908 a distance 910 such that the wrinkled portion 902 extends farther along the tube 896 on one side of the plane 908 than the other. The portion of the wrinkled portion 902 on the one side of the plane 908 (the upper portion in FIG. 33) has an offset portion 910A including at least one ridge 904 and/or at least one groove 906 more than the portion of the wrinkled portion 902 on the other side of the plane 908.

The wrinkled portion 910 has an end groove 906A and an end ridge 904A. In one implementation, the end ridge 904A lacks a tapered lead-in portion. The offset portion 910A may provide a transition for flow in the tube 896 between the nearby straight 898 and the bend 900. Further, the end ridge 904B has a tapered lead-in portion 914 similar to various end ridges discussed above.

Figure 34:
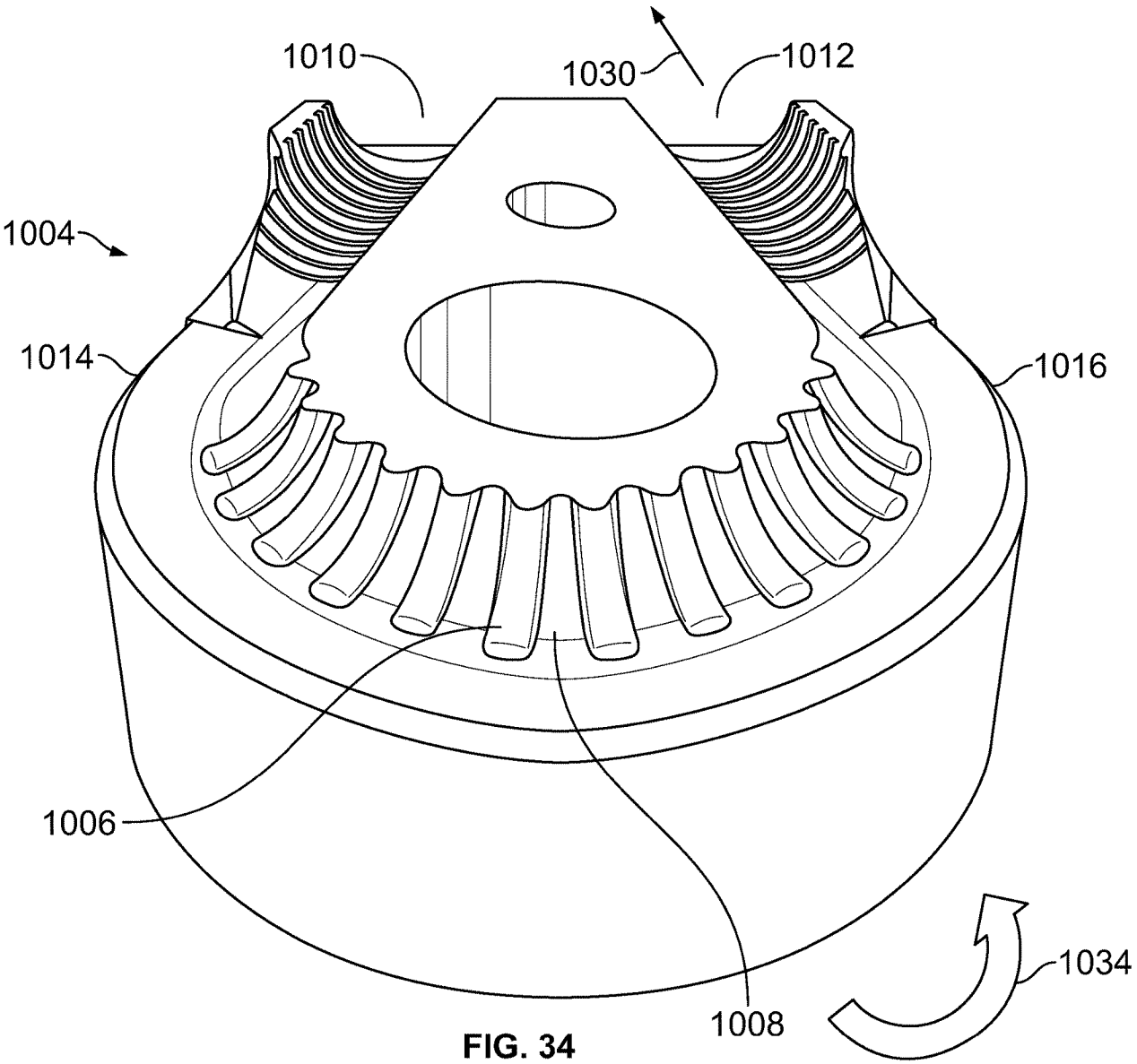
FIG. 34 is a perspective view of a lower portion of a bend die used to form the bend of FIG. 33.
Figure 35:
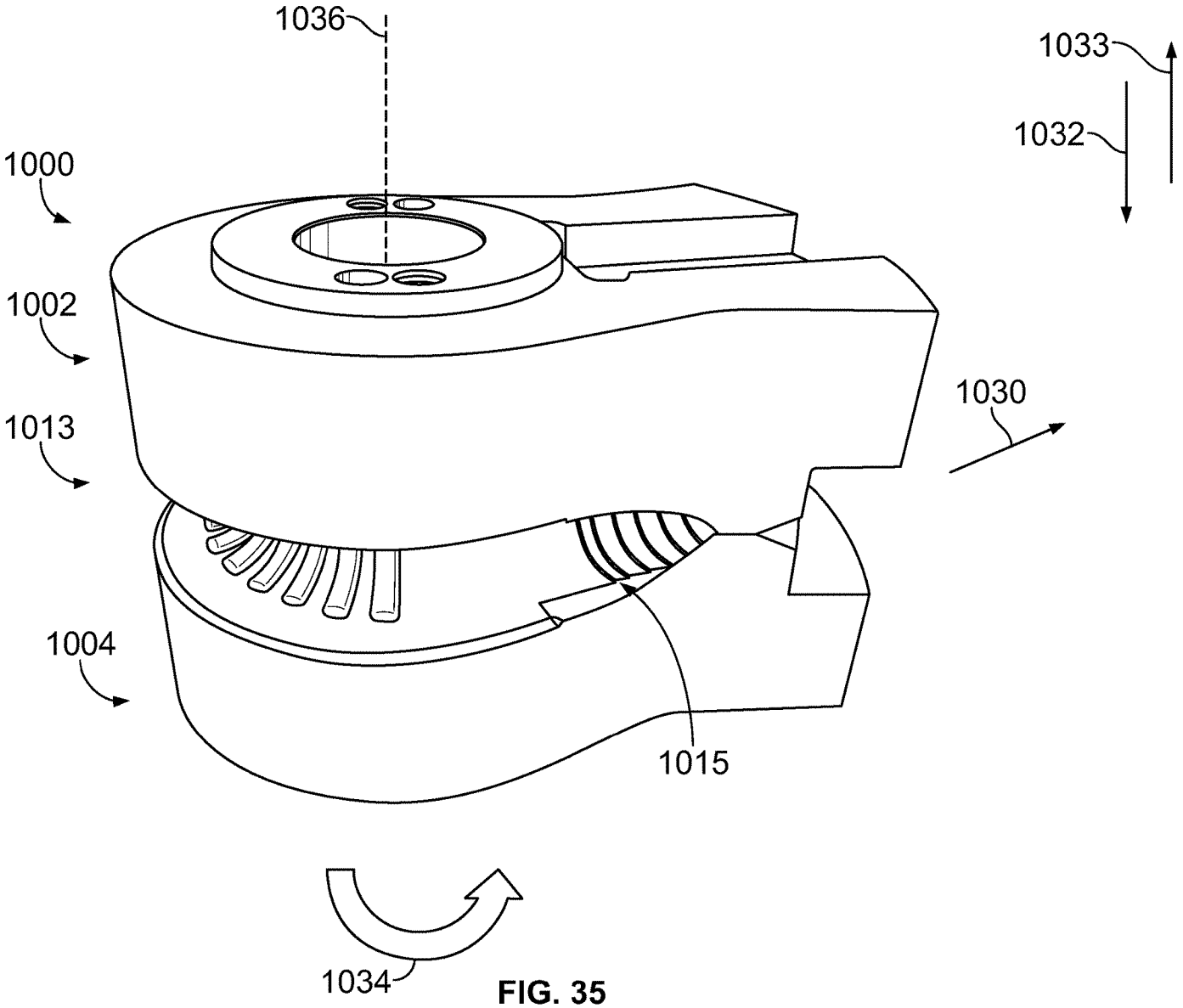
FIG. 35 is a perspective view of the bend die lower portion of FIG. 34 and a corresponding bend die upper portion.

Regarding FIGS. 34 and 35, a bend die 1000 is provided that is similar to the bend die 502 discussed above such that differences will be highlighted. The bend die 1000 is used to form the bend 900 and includes an upper portion 1002 and a lower portion 1004. The upper and lower portions 1002, 1004 have ridges 1006 and grooves 1008 that cooperate to form the ridges 904 and grooves 906 in the bend 900. The upper and lower portions 1002, 1004 each have a pair of channels 1010, 1012. The channels 1010 of the upper and lower portions 1002, 1004 form an opening 1013 at one side 1014 of the bend die 1000 and the channels 1012 of the upper and lower portions 1002, 1004 form another opening 1015 at the second side 1016.

The openings 1013, 1015 permit the bend die 1000 to have a tube fed into either opening 1013, 1015 of the bend die 1000 and allow the bend die 100 to be turned in the corresponding direction to form the bend 900 in the tube. For example and with reference to FIG. 35, a first portion of a tube may be advanced in direction 1030 into channel 1012 of the bend die lower portion 1004. The upper portion 1002 is shifted downward in direction 1032 into engagement with the bend die lower portion 1004 to form the opening 1015 around the tube.

The bend die 1000 is then turned in direction 1034 about axis 1036 while a trailing portion of the tube is supported by a pressure die. The bend die 1000 is turned in direction 1034 to impart the desired angular extent to the bend 900. Once the bend 900 has been formed, the bend die upper portion 1002 is shifted upward in direction 1033 and the tube is shifted relative to the bend die 1000 to position another portion of the tube in the bend die 1000 for bending. Continuing with the example, the tube is repositioned to advance a second portion of the tube into opening 1013, the bend die 1000 is closed, and the bend die 1000 is turned in a direction opposite direction 1034. The process of advancing and bending the tube is repeated until the desired number of bends have been imparted to the tube.

Figure 36:
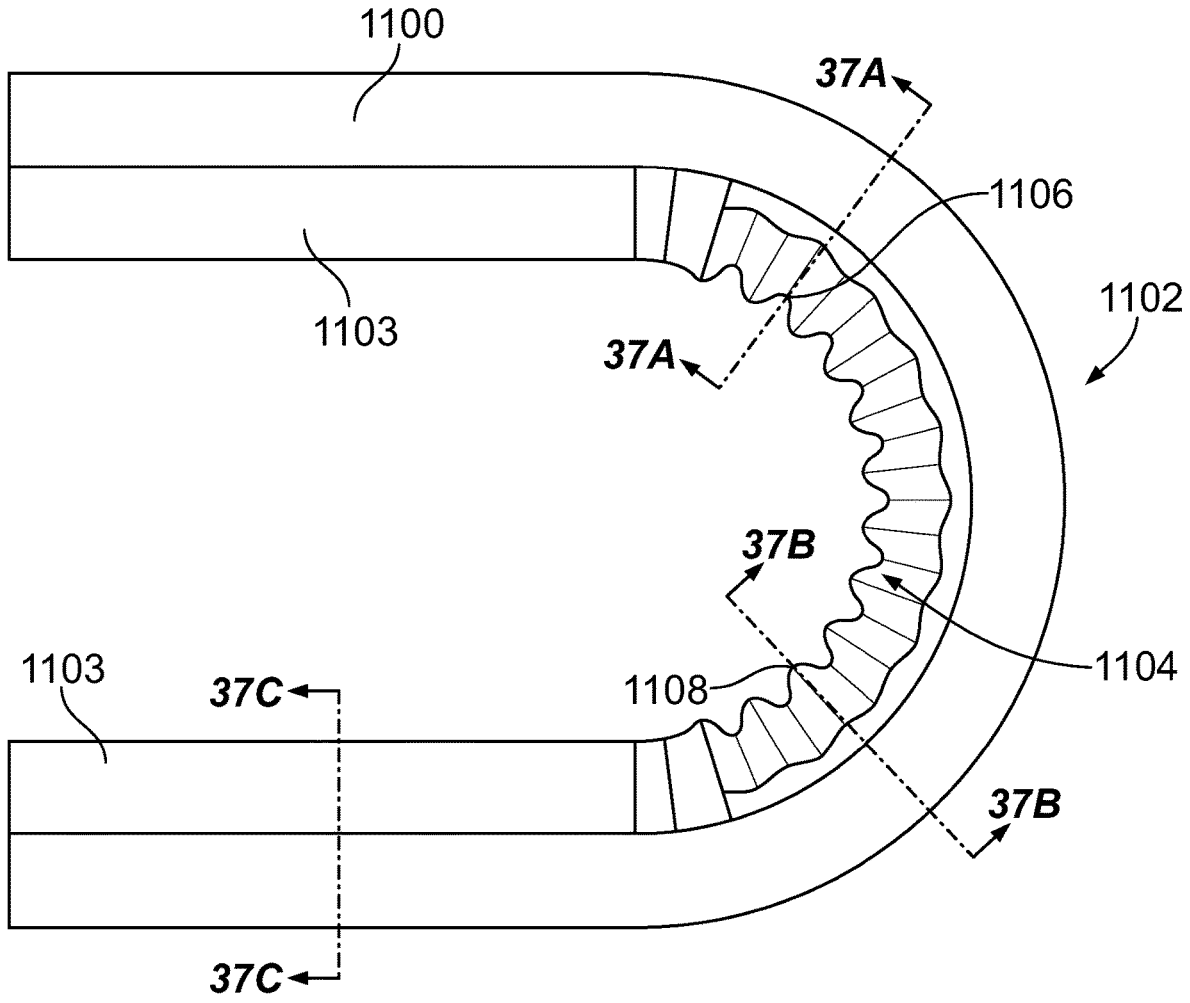
FIG. 36 is a plan view of a tube having a flattened cross-section, the tube including straights and a return bend with a wrinkled portion.

Regarding FIG. 36, a tube 1100 is provided having a return bend 1102 and straights 1103. The return bend 1102 has a wrinkled portion 1104 that is similar to the wrinkled portions discussed above. The wrinkled portion 1104 has valleys 1106 and peaks 1108. The tube 1100 has a flattened cross-section at the valleys 1106, the peaks 1108, and/or the straights 1103. The flattened cross-section of the tube 1100 may enable the tube 1100 to be tightly packed with adjacent tubes, such as in a coil assembly of a cooling tower. The flattened cross-section of the tube 1100 may also improve thermal performance of the tube 1100.

Figure 37A:
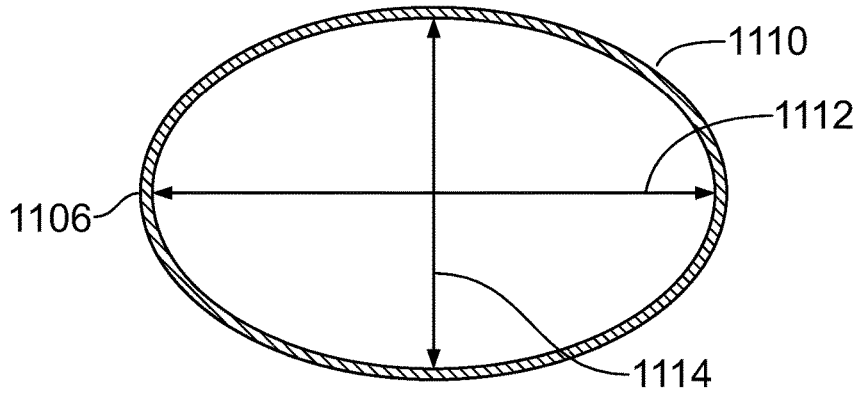
FIG. 37A is a cross-sectional view taken across line 37A-37A in FIG. 36 showing an elliptical cross-section of the tube at a valley of the wrinkled portion.

The flattened cross-section of the tube 1100 may be, for example, an elliptical cross section. Regarding FIG. 37A, the return bend 1102 includes a valley elliptical wall portion 1110 at the valley 1106. The valley elliptical wall portion 1110 has a major dimension 1112 and a minor dimension 1114.

Figure 37B:
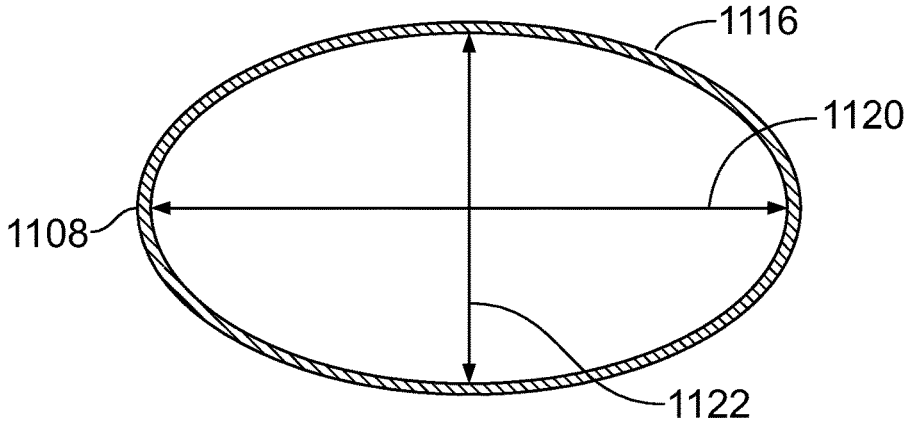
FIG. 37B is a cross-sectional view taken across line 37B-37B in FIG. 36 showing an elliptical cross-section of the tube at a peak of the wrinkled portion.

Regarding FIG. 37B, the return bend 1102 has a peak elliptical wall portion 1116 at the peak 1108, the peak elliptical wall portion 1116 having a major dimension 1120 and a minor dimension 1122. The major dimension 1120 of the peak 1108 is larger than the major dimension 1112 of the valley 1106. In one embodiment, the minor dimension 1122 of the peak 1108 is smaller than the minor dimension 1114 of the valley 1106.

Figure 37C:
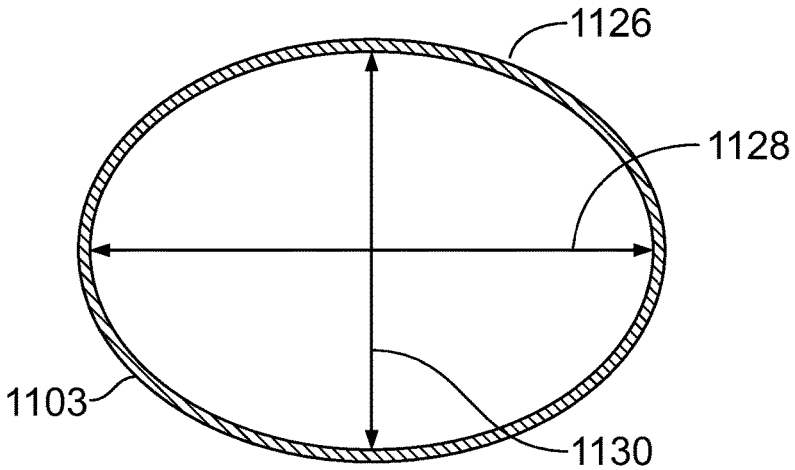
FIG. 37C is a cross-sectional view taken across line 37C-37C in FIG. 36 showing an elliptical cross-section of the tube at one of the straights of the tube.

Regarding FIG. 37C, the return bend 1102 has a straight elliptical wall portion 1126 at the straight 1103, the straight elliptical wall portion 1126 having a major dimension 1128 and a minor dimension 1130. In one embodiment, the major dimension 1128 of the straight 1103 is smaller than the major dimensions 1112, 1120 and the minor dimension 1130 is larger than the minor dimensions 1114, 1122.

The flattened cross-section of the portions of the tube 1100 may be provided in a number of different approaches. For example, the tube bender used to bend the tube and impart the wrinkled portion 1104 may flatten the bend 1102 during the bending procedure. In another approach, the tube initially has an elliptical cross-section and the bending procedure imparts the wrinkled portion 1104 to the bend 1102 without further flattening of the tube. In yet another approach, a tube bender is used to form one or more bends of a tube and a press is used to flatten the tube after the bending procedure.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, it will be appreciated that numerous changes and modifications will occur to those skilled in the art, and it is intended for the present invention to cover all those changes and modifications which fall within the scope of the appended claims. For example, the bends disclosed herein may be utilized in in various heat exchange apparatuses, such as an evaporative condenser, air cooled condenser, closed circuit fluid cooler, closed circuit cooling tower, open circuit cooling tower, dry cooler, ice thermal storage system, thermal storage coils, and/or a hydro-cooling coil, as some examples.

What is claimed is:

1. An indirect heat exchanger pressure vessel comprising:

an inlet header to receive a pressurized working fluid;

an outlet header to collect the pressurized working fluid;

a serpentine circuit tube connecting the inlet and outlet headers and permitting the pressurized working fluid to flow from the inlet header to the outlet header;

the serpentine circuit tube comprising runs and a return bend connecting the runs;

wherein the return bend has an intrados and an extrados;

the return bend having side surface portions intermediate the intrados and the extrados, the return bend having a controlled wrinkled portion between the side surface portions;

the controlled wrinkled portion including alternating ridges and grooves;

wherein the controlled wrinkled portion of the return bend includes a sinusoidal pattern at the intrados of the return bend, the sinusoidal pattern including peaks at the ridges and valleys at the grooves of the return bend;

wherein each ridge extends from the intrados of the return bend toward the side surface portions of the return bend; and wherein each ridge widens as the ridge extends from the intrados toward the side surface portions of the return bend, each ridge having a first width at the intrados that is less than a second width at either of the side surface portions.

2. The indirect heat exchanger pressure vessel of claim 1 wherein the inlet header, the outlet header, and the serpentine circuit tube are configured to operate at an internal pressure of at least 150 psig.

3. The indirect heat exchanger pressure vessel of claim 1 wherein the inlet header, the outlet header, and the serpentine circuit tube are configured to operate at an internal pressure of at least 410 psig.

4. The indirect heat exchanger pressure vessel of claim 1 wherein the inlet header, the outlet header, and the serpentine circuit tube are configured to operate at an internal pressure of at least 1200 psig.

5. The indirect heat exchanger pressure vessel of claim 1 wherein the serpentine circuit tube includes a pair of tangent points at junctures between the return bend and the runs of the serpentine circuit tube;

the return bend having a bend angle;

the controlled wrinkled portion of the return bend spaced from the tangent points along the serpentine circuit tube; and wherein the controlled wrinkled portion of the return bend has an angular extent about an inside of the return bend that is less than the bend angle.

6. The indirect heat exchanger pressure vessel of claim 1 wherein the controlled wrinkled portion of the return bend includes an arc pattern intersecting the sinusoidal pattern of the bend, the arc pattern comprising:

peak arcs intersecting the peaks; and valley arcs intersecting the valleys.

7. The indirect heat exchanger pressure vessel of claim 6 wherein at least one of the peak arcs has a first radius of curvature and at least one of the valley arcs has a second radius of curvature, wherein the first radius of curvature and the second radius of curvature are substantially the same.

8. The indirect heat exchanger pressure vessel of claim 1 wherein the ridges include end ridges adjacent the runs of the serpentine circuit tube; and wherein at least one of the end ridges includes a tapered lead-in portion to smooth the flow of pressurized working fluid about the ridges and grooves.

9. An indirect heat exchanger pressure vessel comprising:

an inlet header to receive a pressurized working fluid;

an outlet header to collect the pressurized working fluid;

a serpentine circuit tube connecting the inlet and outlet headers and permitting the pressurized working fluid to flow from the inlet header to the outlet header;

the serpentine circuit tube comprising runs and a return bend connecting the runs;

the return bend having a controlled wrinkled portion;

the controlled wrinkled portion including alternating ridges and grooves;

wherein the return bend has a bend radius and includes a tubular side wall extending about an interior of the return bend;

wherein the tubular side wall includes:

a first semicircular inner wall portion at each ridge of the return bend, a first outer wall portion, and a pair of first connecting wall portions on opposite sides of the return bend interior connecting the first semicircular inner wall portion and the outer wall portion, wherein the first semicircular inner wall portion, outer wall portion, and the first connecting wall portions are radially aligned; and a second semicircular inner wall portion at each groove of the return bend, a second outer wall portion, and a pair of connecting wall portions on opposite sides of the return bend interior connecting the second semicircular inner wall portion and the second outer wall portion, wherein the second semicircular inner wall portion, second outer wall portion, and the second connecting wall portions are radially aligned.

10. The indirect heat exchanger pressure vessel of claim 9 wherein the first semicircular inner wall portion has a first radius of curvature and the second semicircular wall portion has a second radius of curvature that is substantially the same as the first radius of curvature.

11. The indirect heat exchanger pressure vessel of claim 9 wherein the first semicircular inner wall portion has a first angular extent and the second semicircular inner wall portion has a second angular extent, wherein the first angular extent and the second angular extent are each greater than 90 degrees.

12. The indirect heat exchanger pressure vessel of claim 11 wherein the first angular extent is greater than the second angular extent.

13. The indirect heat exchanger pressure vessel of claim 1 wherein the runs of the serpentine circuit tube comprise a plurality of pairs of runs; and wherein the return bend comprises a plurality of return bends connecting the pairs of runs.

14. The indirect heat exchanger pressure vessel of claim 1 wherein the return bend comprises:

a first bend including a first controlled wrinkled portion of the controlled wrinkled portion;

a second bend including a second controlled wrinkled portion of the controlled wrinkled portion; and a straight portion of the serpentine circuit tube connecting the first and second bends.

15. The indirect heat exchanger pressure vessel of claim 14 wherein the first bend has a first bend angle greater than or equal to 90 degrees and the second bend has a second bend angle less than or equal to 90 degrees.

16. The indirect heat exchanger pressure vessel of claim 1 wherein the return bend comprises a plurality of return bends; and wherein the return bends of the serpentine circuit tube have centerlines that are all coplanar.

17. The indirect heat exchanger pressure vessel of claim 1 wherein the return bend has a bend angle of 180 degrees and the controlled wrinkled portion of the bend has an arc length of less than or equal to 180 degrees.

18. The indirect heat exchanger pressure vessel of claim 1 wherein the runs of the serpentine circuit tube include runs having a non-circular cross-sectional shape.

19. The indirect heat exchanger pressure vessel of claim 1 wherein the controlled wrinkle portion includes at least one tapered lead-in portion.

20. The indirect heat exchanger pressure vessel of claim 1 wherein the serpentine circuit tube has an outer diameter (OD), the serpentine circuit tube has a wall thickness (WT), and the return bend has a centerline radius (CLR);

wherein the return bend has a bend complexity factor (CB) given by the following equation:

$$C_B = \frac{OD^2}{CLR \times WT^2}$$

wherein the bend complexity factor is greater than or equal to 10.

21. The indirect heat exchanger pressure vessel of claim 20 wherein the bend complexity factor is less than or equal to 20.

22. The indirect heat exchanger pressure vessel of claim 1 wherein the serpentine circuit tube includes a plurality of serpentine circuit tubes; and wherein the serpentine circuit tubes contact one another.

23. The indirect heat exchanger pressure vessel of claim 1 wherein the serpentine circuit tube includes a plurality of serpentine circuit tubes; and wherein the serpentine circuit tube return bends do not contact one another.

24. The indirect heat exchanger pressure vessel of claim 1 wherein the return bend of the serpentine circuit tube has a non-circular cross-sectional shape.

25. The indirect heat exchanger pressure vessel of claim 1 wherein the return bend of the serpentine circuit tube has an elliptical cross-sectional shape.

26. The indirect heat exchanger pressure vessel of claim 1 wherein the controlled wrinkled portion is asymmetrical about a plane bisecting the return bend.

27. The indirect heat exchanger pressure vessel of claim 1 wherein the return bend has a bend angle of 180 degrees; and wherein the controlled wrinkled portion is asymmetrical about a plane bisecting the return bend.

28. An indirect heat exchanger pressure vessel comprising:

an inlet header to receive a pressurized working fluid;

an outlet header to collect the pressurized working fluid;

a serpentine circuit tube connecting the inlet header and the outlet header to permit flow of the pressurized working fluid from the inlet header to the outlet header, the serpentine circuit tube including runs and a return bend connecting the runs, the return bend comprising:

an inner portion having a sinusoidal wave pattern at an intrados of the return bend, the sinusoidal wave pattern including peaks and valleys;

wherein the inner portion of the return bend includes an arc pattern intersecting the sinusoidal wave pattern, the arc pattern comprising peak arcs intersecting the peaks and valley arcs intersecting the valleys;

wherein the peak arcs each include a first radius of curvature and a second radius of curvature; and wherein the valley arcs each include a third radius of curvature and a fourth radius of curvature; and wherein the first radius of curvature and the third radius of curvature are substantially the same and the second radius of curvature and the fourth radius of curvature are substantially the same.

29. The indirect heat exchanger pressure vessel of claim 28 wherein the peak arcs have an angular extent that is greater than an angular extent of the valley arcs.

30. The indirect heat exchanger pressure vessel of claim 28 wherein the serpentine circuit tube has a centerline;

wherein the peak arcs each have a center radially inward of the centerline; and wherein the valley arcs each have a center radially outward of the centerline.

31. The indirect heat exchanger pressure vessel of claim 28 wherein the return bend has a midline plane, the sinusoidal pattern being in the midline plane;

wherein the peak arcs are normal to the midline plane; and wherein the valley arcs are normal to the midline plane.

32. The indirect heat exchanger pressure vessel of claim 28 wherein the sinusoidal pattern includes end peak portions adjacent the runs; and wherein at least one of the end peak portions includes a tapered lead-in segment.

33. The indirect heat exchanger pressure vessel of claim 28 wherein the sinusoidal pattern has a period and an amplitude; and wherein at least one of the period and the amplitude varies about the return bend.

34. The indirect heat exchanger pressure vessel of claim 33 wherein the sinusoidal pattern includes a first minimum amplitude adjacent one of the runs, a second minimum amplitude adjacent another one of the runs, and a maximum amplitude intermediate the first and second minimum amplitudes along the intrados of the bend.

35. The indirect heat exchanger pressure vessel of claim 28 wherein the peak and valley arcs each have an angular extent of at least 100 degrees.

36. The indirect heat exchanger pressure vessel of claim 28 wherein the peak arcs have a shape defined by a portion of a first ellipse; and wherein the valley arcs have a shape defined by a portion of a second ellipse.

37. An indirect heat exchanger pressure vessel comprising:

an inlet header to receive a pressurized working fluid;

an outlet header to collect the pressurized working fluid;

a serpentine circuit tube connecting the inlet header and the outlet header to permit flow of the pressurized working fluid from the inlet header to the outlet header, the serpentine circuit tube including runs and a return bend connecting the runs, the return bend comprising:

an inner portion having a sinusoidal wave pattern at an intrados of the return bend, the sinusoidal wave pattern including peaks and valleys;

wherein the inner portion of the return bend includes an arc pattern intersecting the sinusoidal wave pattern, the arc pattern comprising peak arcs intersecting the peaks and valley arcs intersecting the valleys;

wherein the peak arcs have a shape defined by a portion of a first ellipse;

wherein the valley arcs have a shape defined by a portion of a second ellipse;

wherein the first ellipse has a first major dimension and a first minor dimension;

wherein the second ellipse has a second major dimension and a second minor dimension; and wherein the first major dimension is substantially the same as the second major dimension and wherein the first minor dimension is substantially the same as the second minor dimension.

38. A closed circuit cooling tower comprising:

an indirect heat exchanger comprising a plurality of serpentine circuit tubes comprising runs and return bends connecting the runs;

the return bends of at least one of the serpentine circuit tubes including a wrinkled bend having a controlled wrinkled portion;

wherein the wrinkled bend includes:

an intrados;

an extrados;

side surface portions intermediate the intrados and the extrados;

wherein the controlled wrinkled portion is between the side surface portions;

wherein the controlled wrinkled portion includes alternating ridges and grooves;

wherein the controlled wrinkled portion includes a sinusoidal pattern at the intrados of the wrinkled bend, the sinusoidal pattern including peaks at the ridges and valleys at the grooves of the wrinkled bend;

wherein each ridge extends from the intrados of the return bend toward the side surface portions of the wrinkled bend; and wherein each ridge widens as the ridge extends from the intrados toward the side surface portions of the return bend, each ridge having a first width at the intrados that is less than a second width at either of the side surface portions;

a fan operable to generate airflow relative to the serpentine circuit tubes;

an evaporative liquid distribution assembly configured to distribute evaporative liquid onto the serpentine circuit tubes;

a sump to receive evaporative liquid from the serpentine circuit tubes; and a pump operable to pump evaporative fluid from the sump to the evaporative liquid distribution assembly.

39. The closed circuit cooling tower of claim 38 wherein the indirect heat exchanger includes an inlet header to receive pressurized working fluid and an outlet manifold to collect the pressurized working fluid;

wherein the serpentine circuit tubes connect the inlet header and outlet header, the serpentine circuit tubes permitting flow of pressurized working fluid from the inlet header to the outlet header; and wherein the inlet header, the outlet header, and the serpentine circuit tubes are configured to operate at an internal pressure of at least 150 psig.

40. The closed circuit cooling tower of claim 38 wherein the at least one of the serpentine circuit tubes include tangent points at junctures between the wrinkled bend and adjacent runs of the serpentine circuit tube;

the wrinkled bend having a bend angle;

the controlled wrinkled portion of the wrinkled bend spaced from the tangent points along the serpentine circuit tube; and wherein the controlled wrinkled portion of the wrinkled bend has an angular extent about an inside of the first wrinkled return bend that is less than the bend angle.

41. The closed circuit cooling tower of claim 38 wherein the controlled wrinkled portion further include an arc pattern intersecting the sinusoidal pattern, the arc pattern comprising peak arcs intersecting the peaks and valley arcs intersecting the valleys.

42. The closed circuit cooling tower of claim 41 wherein the at least one of serpentine circuit tubes has a centerline;

wherein the peak arcs have centers radially inward of the centerline; and wherein the valley arcs have centers radially outward of the centerline.

43. The closed circuit cooling tower of claim 38 further comprising a direct heat exchanger, the evaporative liquid distribution assembly configured to distribute evaporative liquid onto the direct heat exchanger.

44. The indirect heat exchanger pressure vessel of claim 1 wherein a majority of the ridges are identical; and wherein a majority of the grooves are identical.

45. The indirect heat exchanger pressure vessel of claim 9 wherein the inlet header, the outlet header, and the serpentine circuit tube are configured to operate at an internal pressure of at least 150 psig.

46. The indirect heat exchanger pressure vessel of claim 9 wherein the controlled wrinkled portion of the return bend includes a sinusoidal pattern at an intrados of the return bend, the sinusoidal pattern including peaks at the ridges and valleys at the grooves of the bend;

wherein the controlled wrinkled portion of the return bend includes an arc pattern intersecting the sinusoidal pattern of the bend, the arc pattern comprising:

peak arcs intersecting the peaks; and valley arcs intersecting the valleys.

47. The indirect heat exchanger pressure vessel of claim 46 wherein at least one of the peak arcs has a first radius of curvature and at least one of the valley arcs has a second radius of curvature, wherein the first radius of curvature and the second radius of curvature are substantially the same.

48. The indirect heat exchanger pressure vessel of claim 9 wherein the ridges include end ridges adjacent the runs of the serpentine circuit tube; and wherein at least one of the end ridges includes a tapered lead-in portion to smooth the flow of pressurized working fluid about the ridges and grooves.

49. The indirect heat exchanger pressure vessel of claim 9 wherein the serpentine circuit tube has an outer diameter (OD), the serpentine circuit tube has a wall thickness (WT), and the return bend has a centerline radius (CLR);

wherein the return bend has a bend complexity factor ($C_B$) given by the following equation:

$$C_B = \frac{OD^2}{CLR \times WT}$$

wherein the bend complexity factor is greater than or equal to 10.

50. The indirect heat exchanger pressure vessel of claim 49 wherein the bend complexity factor is less than or equal to 20.

* * * * *